US006044831A

United States Patent [19]

Takagi et al.

[11] Patent Number: 6,044,831

[45] Date of Patent: Apr. 4, 2000

[54] FUEL VAPOR FEED CONTROLLING APPARATUS FOR LEAN BURN TYPE INTERNAL COMBUSTION ENGINE

[75] Inventors: Naoya Takagi; Toshimi Murai, both of Susono; Yoshihiko Hyodo, Gotenba; Zenichiro Mashiki, Toyota; Tetsuji Nagata, Kariya, all of Japan

[73] Assignee: Toyota Jidosha Kabushiki Kaisha, Toyota, Japan

[21] Appl. No.: 08/990,466

[22] Filed: Dec. 15, 1997

[30] Foreign Application Priority Data

| | | | |
|---|---|---|---|
| Dec. 16, 1996 | [JP] | Japan | 8-335738 |
| Dec. 19, 1996 | [JP] | Japan | 8-339782 |
| Dec. 19, 1996 | [JP] | Japan | 8-339787 |
| Nov. 12, 1997 | [JP] | Japan | 9-321812 |
| Nov. 21, 1997 | [JP] | Japan | 9-321810 |
| Nov. 21, 1997 | [JP] | Japan | 9-321811 |

[51] Int. Cl.[7] ..... F20D 41/04

[52] U.S. Cl. ..... 123/698; 123/520

[58] Field of Search ..... 123/520, 698, 123/295

[56] References Cited

U.S. PATENT DOCUMENTS

| | | | |
|---|---|---|---|
| 5,438,967 | 8/1995 | Ito . | |
| 5,613,481 | 3/1997 | Kitagawa et al. | 123/698 |
| 5,765,372 | 6/1998 | Mitobe et al. | 123/385 |

FOREIGN PATENT DOCUMENTS

| | | |
|---|---|---|
| 44 02 588 A1 | 8/1994 | Germany . |
| 195 38 786 A1 | 4/1997 | Germany . |
| 4-194354 | 7/1992 | Japan . |
| 4-295150 | 10/1992 | Japan . |
| 5-71430 | 3/1993 | Japan . |
| 5-223017 | 8/1993 | Japan . |
| 6-137190 | 5/1994 | Japan . |
| 6-147033 | 5/1994 | Japan . |
| 6-200794 | 7/1994 | Japan . |
| 8-177572 | 7/1996 | Japan . |

*Primary Examiner*—Erick R. Solis
*Attorney, Agent, or Firm*—Oliff & Berridge, PLC

[57] ABSTRACT

A fuel vapor feed controlling apparatus of a lean burn internal combustion engine suppresses either one of a rich misfire or a surge when fuel vapor is fed into the engine. A purge controlling unit controls an amount of fuel vapor fed from a fuel reservoir to the engine in response to an operational condition of the engine. A first compensation unit compensates the amount of fuel vapor such that an engine revolution speed of the engine may be identical with a target revolution speed. The purge controlling unit performs a purge control based on a compensation value compensated by the first compensation unit.

22 Claims, 57 Drawing Sheets

FIG. 19

| COMPENSATION COEFFICIENT \ VAPOR CONCENTRATION | C1 | C2 | C3 | C4 | |
|---|---|---|---|---|---|
| K1 | K1' | K1" | K1''' | K1'''' | ---- |
| K2 | K2' | K2" | K2''' | K2'''' | ---- |
| K3 | K3' | K3" | K3''' | K3'''' | ---- |
| K4 | K4' | K4" | K4''' | K4'''' | ---- |
| ⋮ | ⋮ | ⋮ | ⋮ | ⋮ | |
| K12 | K12' | K12" | K12''' | K12'''' | ---- |

LOW CONCENTRATION C1<C2<C3 HIGH CONCENTRATION

K'>K">K'''>K''''

Qp : OBTAINED FROM MAP IN OPERATIONAL CONDITION
Qp : TARGET VALUE IN CASE OF CONTROLLING FLOW RATE

ΔP = ATMOSPHERIC PRESSURE − INTAKE MANIFOLD PRESURE

FUEL VAPOR FEED CONTROLLING APPARATUS FOR LEAN BURN TYPE INTERNAL COMBUSTION ENGINE

BACKGROUND OF THE INVENTION

1. Field of the Invention

The present invention relates to a fuel vapor feed controlling apparatus for a lean burn type internal combustion engine for feeding fuel vapor (vapor) generated in, for example, a fuel reservoir to an intake system in response to an operational condition of the lean burn type internal combustion engine.

2. Description of the Related Art

Conventionally, a generally used engine, the fuel from a fuel injection valve is injected to an intake port so that uniform or homogeneous mixture of the fuel and air is fed to a combustion chamber in advance. An intake passage is opened/closed by a throttle valve which works in cooperation with an accelerator operation.

An amount of intake air (finally, an amount of gas uniformly mixed fuel and air) to be fed in the combustion chamber of the engine is adjusted by the open/close operation of the throttle valve to thereby control the engine output.

However, in the technology depending upon the above-described so-called homogeneous combustion, a large intake vacuum is generated in the throttling action of the throttle valve so that a pumping loss is remarkable to reduce the efficiency. In contrast, a so-called "stratified combustion" technology is well known in which the throttle degree of the throttle valve is made small and the fuel is fed directly to the combustion chamber whereby a combustible mixture is present in the vicinity of a spark plug to increase an air/fuel ratio of the portion in question to enhance ignitability. In this technology, when the engine is operated in a low load, the injected fuel is locally fed to an around the spark plug, and at the same time, the throttle valve is fully opened to execute the stratified combustion. As a result, the pumping loss is reduced and the fuel consumption rate is enhanced.

The internal combustion engine for the above-described "stratified combustion" takes combustion conditions such as a stratified combustion, a weak stratified combustion, a homogeneous lean combustion and a homogeneous combustion in this order when the load is changed from a low level to a high level, for example.

As described above, the stratified combustion means a combustion in which a mixture gas layer having a high air/fuel ratio is present in the vicinity of a spark plug to form a layer with respect to the other gas in the other portion.

The weak stratified combustion means the case where the stratified degree is small in comparison with the stratified combustion.

The homogeneous lean combustion means the case where the fuel and air are homogeneous but the ratio of the fuel is low.

The homogeneous combustion means the case where the fuel and air are homogeneous and the ratio of the fuel is high.

Also, in the case where such a "stratified combustion" takes place or the lean burn takes place, in some cases, swirls would be formed in the mixture of the injected fuel. Namely, a swirl control valve (SCV) is provided in the intake port and the opening degree of the SCV is adjusted to thereby control the strength of the swirls. As a result, it is possible to enhance the combustion property with a small amount of fed fuel.

By the way, a fuel vapor feed controlling apparatus for a lean burn type internal combustion engine for temporarily storing the fuel vapor (vapor) from the fuel reservoir or the like in a canister and feeding the stored vapor into the intake system in response to the operational condition of the internal combustion engine is well known (Japanese Patent Application Laid-Open No. Hei 4-194354).

In this system, a purge control valve is interposed in a purge passage for connecting the canister for fuel vapor adsorption and the intake passage for fuel evaporation. Then, the purge control valve is controlled so that a suitable amount of fuel purge (which is an amount of the vapor introduced into the intake passage, and which will hereinafter be referred to as a purge amount) may be obtained in response to the operational condition of the engine (for example, in the case where the engine load is large, the vapor is fed).

However, in the lean combustion region, since the device for detecting the air/fuel ratio is not provided, in many cases, there is no index or factor for controlling the fuel purge amount.

More specifically, in the conventional internal combustion engine, an air/fuel ratio sensor such as an oxygen sensor or the like is usually interposed in the exhaust passage, and the actual air/fuel ratio is detected on the basis of the output signal therefrom. A fuel injection amount or the like is suitably controlled in a feed-back manner so that the air/fuel ratio of the mixture separately calculated may be the target air/fuel ratio. However, in the above-described oxygen sensor, the detection is performed around the target air/fuel ratio (A/F) of, for example, 14.5. In the case where the air/fuel ratio exceeds this, it is impossible to detect the purge amount.

For this reason, when the fuel vapor feed amount is controlled in such a lean combustion region, in the case where the air/fuel ratio is not detected or in the case where the precision of the detected air/fuel ratio is worse, the precision of the calculation of the purge amount becomes worse. Then, if the fuel vapor feed controlling apparatus is controlled in accordance with the purge amount determined by a vacuum pressure, there is a fear that a misfire or a surge would be generated when the vapor is rich.

Also, the case where the load of the engine is shifted from a high level to a low level means the same as the case the combustion condition is shifted from the homogeneous combustion or homogeneous lean combustion to the stratified combustion or the weak stratified combustion or the like. In such a case, the purge-prohibition is set. The combustion condition is unstable by the purge gas fed to the combustion chamber with a time lag due to the purge transfer delay through the intake pipe when the combustion conditions are changed. As a result, there is a fear that a rich misfire and a surge would be generated.

SUMMARY OF THE INVENTION

In view of the above, the present invention has been made, and therefore an object of the present invention is to provide a fuel vapor feed controlling apparatus for a lean burn internal combustion engine, in which when a fuel vapor is fed into the lean burn internal combustion engine, even in the case where the air/fuel ratio is not detected, or in the case where the detecting air/fuel ratio precision is not satisfactory, it is possible to suppress a rich misfire or a surge without degrading the calculation of the feed amount of the fuel vapor.

Another object of the present invention is to provide a fuel vapor feed controlling apparatus for a lean burn internal combustion engine, in the idle operation, the base fuel is effectively saved and it is possible to keep a stability of the idle Revolution speed irrespective of the concentration of the vapor.

Still another object of the present invention is to provide a fuel vapor feed controlling apparatus for a lean burn internal combustion engine, in which even in the case where the misfire or surge due to the purge occurs, it is possible to effectively reduce the fuel and to keep a good drivability to enhance the fuel consumption rate.

Yet another object of the present invention is to provide a fuel vapor feed controlling apparatus for a lean burn internal combustion engine, in which in switching combustion modes, it is possible to prevent the degradation of the combustion.

By the way, in an internal combustion engine, in order to purify the exhaust gas, in many cases, an NOx absorbing reducer catalyst is disposed in an exhaust passage. In the case where an NOx absorbing reducer catalyst is disposed in an exhaust passage in order to purify the NOx contained in the exhaust gas, in the lean combustion (stratified combustion) condition, it is likely that the NOx to be trapped by the catalyst is saturated and the vacuum pressure within a brake booster for assisting the brake operation with the vacuum pressure would be insufficient.

For this reason, it is necessary to forcibly discharge and purify the NOx absorbed, and in order to keep the brake vacuum pressure, it is necessary to temporarily close the throttle valve to lower the air/fuel ratio to enrich the mixture in the stoichiometric air/fuel ratio or in the rich condition. Then, if the air/fuel ratio is controlled in the rich condition, and the further fuel vapor is fed, there is a fear that the air/fuel ratio to be controlled is deviated from the necessary air/fuel ratio. As a result, the combustion state is unstable to cause a rich misfire.

Also, in the lean combustion (stratified combustion) state, at a high land, an air density (intake density) is small. Accordingly, the air/fuel ratio tends to be rich in comparison with the low land. Accordingly, if the purge is executed in such a condition, the lean combustion or stratified combustion is unstable. The misfire would occur.

Further another object of the present invention is to provide a fuel vapor feed controlling apparatus for a lean burn internal combustion engine, in which the purge is effected to the intake system in the internal engine in order to process the fuel vapor generated from the fuel storing means, and in which the air/fuel ratio is suitable controlled in the lean combustion (stratified combustion) state to thereby avoid the generation of the rich misfire caused by the turbulence of the air/fuel ratio.

Next, an example of a fuel vapor feed controlling apparatus for feeding a stored vapor into the intake system in response to the operational condition of the internal combustion engine while storing temporarily the fuel vapor from the fuel reservoir or the like in the canister is shown in Japanese Patent Application Laid-Open No. 8-177572.

In this technique, a purge control valve is provided in a purge passage, for fuel vapor, for connecting the canister for absorbing the fuel vapor and the intake passage. The purge control valve is duty controlled in order to obtain the suitable fuel purge amount (introduction amount of the vapor to the intake passage, hereinafter referred to as a purge amount) in response to the operational condition of the engine. Also, in this technique, the learned control is performed to suppress the variation of the air/fuel ratio by using an oxygen sensor. Then, in the lean control, the fuel injection amount actually injected from the fuel injection valve is compensated by the fuel purge amount.

However, if this technology is applied to the engine that may take the lean combustion, the following problems occur. Namely, in the lean combustion region, it would be difficult to exactly detect the actual air/fuel ratio with the current oxygen sensor. There is a case where no index for exactly controlling the fuel purge amount is provided.

More specifically, an air/fuel ratio sensor such as an oxygen sensor is disposed in the exhaust passage of the conventional engine, the actual air/fuel ratio is detected by its output signal, and the fuel injection amount or the like is fed back suitably so that the air/fuel ratio of the mixture becomes the target air/fuel ratio calculated in another way. However, the above-described sensor detects the air/fuel ratio in the case where the air/fuel ratio (A/F) is at, for example, the stoichiometric one. If the air/fuel ratio exceeds this, it is impossible to exactly detect the air/fuel ratio or to detect the purge amount.

For this reason, in such a lean combustion region, when the fuel vapor feed amount is to be controlled, in the case where the air/fuel ratio is not detected or in the case where the detected air/fuel ratio is not correct, the calculation precision of the purge amount becomes worse. Then, if the control based upon such a poor precision detection is executed, the exhaust emission is worse or the spark smoke or misfire would occur.

In addition, in the case where the purge amount is detected more than the actual one, the fuel injection amount is reduced by compensation. -In such a case, if the injection timing is fixed, the fuel amount around the spark plug is insufficient to cause a misfire.

Still further another object of the present invention is to provide a fuel vapor feed controlling apparatus for a lean burn internal combustion engine, for feeding the fuel vapor to the lean burn engine, in which it is possible to suppress an unstable combustion with an output variation, and the suitable fuel injection is maintained to keep the suitable combustion.

(1) According to the present invention, a first feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; and a first compensation means for compensating for the fuel vapor amount so that an engine revolution speed of the internal combustion engine may be identical with a target Revolution speed, characterized in that the purge controlling means performs a purge control on the basis of a compensation value compensated for by the first compensation means.

The purge control means for controlling a fuel vapor amount, to be introduced from the purge passage to the intake system, in response to an operational condition of the internal combustion engine may include, for example, a purge control valve disposed in the purge passage for controlling the fuel vapor amount of the fuel vapor to be introduced into the intake system, an operational condition detecting means for detecting the operational condition of the internal combustion engine and a purge control valve controlling means for controlling an opening degree of the purge control valve in response to the operational condition detected by the operational condition detecting means. In the purge control, it is easiest to adjust the opening degree of the purge control valve. The invention is not limited to this. This may be applied also to the following features. However, for the sake of simplification of the explanation, an example of the opening degree adjustment of the purge control valve is used for purge control.

The fuel vapor generated from the fuel storing means is fed through the purge passage to the intake system of the internal combustion engine. In this case, the purge control valve provided in the purge passage is controlled so that the fuel vapor amount of the fuel vapor to be introduced into the intake system is controlled. Namely, the operational condition of the internal combustion engine is detected by the operational condition detecting means. The purge valve is controlled by the purge control valve controlling means in its operational condition. In this case, the first compensation means compensates for the fuel vapor amount so that an engine revolution speed of the internal combustion engine may be identical with a target Revolution speed. The purge control valve controlling means controls the purge control valve on the basis of the compensation value compensated by the first compensation means. For this reason, the purge amount corresponds to the compensation value and the engine revolution speed is controlled suitably to be identical with the target Revolution speed.

(1-1) In this case, the present invention may be suitably applied to the case where the target Revolution speed of the internal combustion engine to be referenced by the first compensation means is the idle Revolution speed.

Namely, if the control according to the present invention is applied to the idle mode of the lean combustion state, it is possible to keep a suitable lean combustion in the idle mode.

(1-2) Furthermore, the fuel feed amount controlling means for adjusting the fuel feed amount in correspondence with the compensation result by the first compensation means in the idle mode of the lean combustion state may be provided.

Thus, the suitable fuel feed amount is ensured in the idle mode in the lean combustion state. The good idle operation is ensured.

(2) According to the present invention, a second feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; and a second compensation means for compensating for the fuel vapor amount in response to an engine revolution speed of the internal combustion engine, wherein the purge controlling means performs a purge control on the basis of a compensation value compensated for by the second compensation means.

It is preferable that the second feature is applied to a lean burn internal combustion engine (for example, a sleeve interior injection type internal combustion engine) in which a change of the intake pipe vacuum pressure is small over the entire region of the operational condition (substantially constant), or the intake air amount per unit revolution is kept substantially constant. In the second feature, specifically, the opening degree of the purge valve is controlled in response to the operational condition. In this case, the fuel vapor amount is compensated for in response to the engine revolution speed by the second compensation means. The purge valve opening degree is compensated for and controlled in accordance with the compensation value.

In many cases, in the lean burn internal combustion engine, in the normal operational condition, the throttle valve is operated at a substantially fully opened state. Since the fuel is injected directly to the interior of the sleeve, it is unnecessary to control the mixture condition by controlling the intake air.

For instance, if the throttle valve is fully opened substantially over the entire region of the operation conditions, the intake air amount, i.e., the vacuum pressure is kept constant. For this reason, if the purge amount is to be controlled in response to at least one of the air intake amount, the load (=air amount/engine revolution speed), and intake pipe vacuum pressure, in the case where the same amount of purge is effected for the stratified combustion at a low Revolution speed and for the homogeneous combustion at a high Revolution speed, the combustion instability or misfire would occur on the low Revolution speed side. Therefore, in the lean burn internal combustion engine in which the intake pipe vacuum pressure is kept substantially constant, the purge amount is controlled in response to the engine revolution speed.

(3) According to the present invention, a third feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; and a third compensation means for compensating for the fuel vapor amount in response to an output variation of the internal combustion engine, characterized in that the purge controlling means performs a purge control on the basis of a compensation value compensated for by the third compensation means.

In this case, the fuel vapor amount is compensated for in response to the output variation of the internal combustion engine, and the purge is controlled in accordance with the compensated amount. It is therefore possible to maintain the smooth operation of the internal combustion engine even if the output variation occurs.

(3-1) In this case, it is possible to provide a fuel feed amount controlling means for adjusting the fuel feed amount in response to the output variation of the internal combustion engine. According to this, since the fuel is fed in response to the output variation of the internal combustion engine, it is possible to further ensure the suitable fuel amount.

(4) According to the present invention, a fourth feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; and a fourth compensation means for compensating for the fuel vapor amount in response to a combustion condition of the internal combustion engine, characterized in that the purge controlling means performs a purge control on the basis of a compensation value compensated for by the fourth compensation means.

In this case, the fuel vapor amount is compensated for in response to the combustion condition of the mixture. The combustion condition means the combustion state of the mixture in the combustion chamber, for example, the degree of the stratified combustion, or the combustion switching condition among the stratified combustion, the weak stratified combustion, homogeneous lean combustion and the homogeneous combustion. The fuel vapor amount is compensated in response to each condition to ensure the optimum fuel amount in response to each condition.

(4-1) With respect to the fourth feature, a control delay means for delaying a time to start a change of an opening degree of a purge valve or a change of a fuel injection condition change in switching combustion conditions may be provided. By the delay, it is possible to prevent from hunching in switching.

(4-2) Furthermore, a change speed controlling means for controlling an opening degree changing speed of a purge control valve or a fuel injection condition changing speed in response to the combustion condition may be provided. Thus, the purge valve opening degree and the fuel injection condition are gradually changed in switching the combustion states. Therefore, the combustion may be stabilized.

(4-3) In this case, it is possible to change the fuel injection condition changing speed at every combustion condition switch. Thus, the changing speeds such as the purge valve opening degree or the like in combustion condition switch are made different from each other, the combustion stability may be further enhanced in comparison with the case like (4-3) in which the changing speed is simply changed.

(4-4) Furthermore, it is possible to provide a fuel vapor feed controlling apparatus provided with a fuel feed amount controlling means for adjusting the feed amount of the fuel in response to the switch mode upon switching the combustion states of the internal combustion engine. By changing the feed amount of the fuel in the combustion mode switch, the combustion may be further stabilized.

(5) In any one of the first to fourth features of the invention, it is possible to provide an injection condition changing means for changing the fuel injection condition in response to the compensation of the fuel vapor amount.

If the fuel injection condition of the fuel injection amount, the fuel injection timing, the fuel injection direction or the like is changed in response to the compensation of the fuel vapor amount, it is possible to ensure the more stable combustion.

(5-1) It is possible to provide a concentration detecting means for detecting a concentration of the fuel vapor and a fifth compensation means for compensating for an opening degree of a purge valve or a fuel injection condition in response to the concentration of the fuel vapor. In this case, since the opening degree of the purge control valve or the fuel injection condition is compensated for in response to the concentration, the control precision is enhanced.

(5-2) Furthermore, the injection condition changing means changes the injection amount compensation amount as the fuel injection condition. It is preferable to limit the change of the injection amount compensation amount by the guard value.

The guard value is used for the restriction so that the change of the compensation amount more than necessary may be suppressed. It is possible to prevent the combustion instability or misfire due to the excessive compensation.

(5-3) Incidentally, conventionally, a regular vehicle has a canister for storing the fuel vapor generated from the fuel storing means for storing the fuel for driving the internal combustion engine. Accordingly, according to the present invention, the above-described purge passage may communicate the intake system of the internal combustion engine and the canister with each other.

(5-4) The present invention may be applied to a wide variety of lean burn internal combustion engines including the intake pipe injection type one as well as the sleeve interior direct fuel injection type lean burn engine except for the above-described feature (2).

(6) A fifth feature of the present invention is directed to the case in which if the mixture would be abruptly enriched in the midway of the lean combustion operation, this is expected to reduce the feed of the fuel vapor. The fifth feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; an air/fuel ratio judging means for judging a shift from an air/fuel ratio corresponding to a lean combustion to an air/fuel ratio that is richer than the former air/fuel ratio in the lean combustion operation; and a fuel restricting means for restricting at least a purge amount out of the purge amount of fuel vapor determined by the purge control means and a fuel amount to be injected from a fuel injection valve of the internal combustion engine when the air/fuel ratio judging means judges that the air/fuel ratio is to be enriched.

In the lean burn internal combustion engine according to the present invention, when the lean combustion operation is effected, the fuel vapor generated in the fuel reservoir is fed to the intake system. In the lean combustion condition, a small amount of fuel is fed into a large amount of air. In such a condition where the fuel amount is small, the air/fuel ratio of the combustible mixture to be fed into the internal combustion engine is lean. Then, in the operational condition where air/fuel ratio is enriched, the affect of the fuel vapor against the air/fuel ratio is considerably large.

Therefore, according to the present invention, in the case where it is judged by the judging means that the air/fuel ratio of the combustible mixture is richer than the air/fuel ratio of the mixture in the normal lean combustion condition, at least the fuel vapor amount to be fed is restricted by the fuel restricting means. For this reason, the affect given to the air/fuel ratio is reduced by the fuel vapor is reduced to thereby suitably control the air/fuel ratio to prevent the rich misfire without any turbulence.

In this case, the air/fuel judging means has a wide concept including as the judgement content not only the case where the air/fuel ratio is actually directed on the rich side but also the case where the air/fuel ratio would be expected to be rich in view of the various conditions. Also, in the air/fuel ratio judging means, the richer air/fuel ratio than the air/fuel ratio corresponding to the lean combustion means the case where the air/fuel ratio is relatively enriched. This may mean, for example, the case where the stratified combustion (strong lean) to the homogeneous lean combustion (weak lean), the case where the lean combustion is changed to the stoichiometric air/fuel ratio combustion, the case where the lean combustion is changed to the rich combustion, and so on.

Also, the restriction by the fuel restricting means includes the action for prohibiting the fuel injection or the purge and the action for reducing the feed amount.

(6-1) By the way, in a lean burn internal combustion engine, it is general that the nitrogen oxide reducer catalyst is provided in the exhaust system in order to remove the nitrogen oxide from the exhaust gas.

In this case, in the case where at least the lean combustion such as a stratified combustion is effected, the air/fuel ratio of the combustible mixture is temporarily enriched by the rich spike control means, so that the nitrogen oxide absorbed in the nitrogen oxide reducer catalyst provided in the exhaust passage of the internal combustion engine is released or purified.

In such a case, the air/fuel ratio judging means may be constructed to judge that the air/fuel ratio is in the rich condition when the amount of the nitrogen oxide absorbed to the nitrogen oxide reducer catalyst is larger than a predetermined amount.

In the case where the amount of the nitrogen oxide absorbed to the nitrogen oxide reducer catalyst is larger than a predetermined amount, the air/fuel ratio of the combustible mixture is temporarily enriched by the rich spike controlling means so that the nitrogen oxide absorbed in the nitrogen oxide reducer catalyst provided in the exhaust passage of the internal combustion engine is released or purified. Reversely, this may means that, in the case where the amount of the nitrogen oxide absorbed to the nitrogen oxide reducer catalyst is larger than the predetermined amount, the air/fuel ratio of the combustible mixture is richer than the air/fuel ratio in the normal lean combustion (stratified combustion). The structure of air/fuel ratio judging means may be simplified because the information to be used in the rich spike controlling means may be used as its judgement condition.

Then, since the purge amount is reduced before the rich spike, the rich misfire may be prevented in advance.

(6-2) Subsequently, in some cases, in a vehicle, there is provided a brake booster is provided for assisting a brake operation of the vehicle by utilizing a vacuum pressure within the intake passage. In this case, a vacuum producing means for producing the vacuum pressure for the brake by throttling the air flow rate of the intake passage is provided.

In this case, the above-described air/fuel ratio judging means may be constructed to make a judgement in accordance with the operational condition of the vacuum producing means.

The brake booster is operated on the basis of the vacuum pressure within the intake passage. In order to maintain the vacuum pressure for the brake booster, when the vacuum producing means is operated, the throttle valve is temporarily closed. the intake air amount is reduced to enrich the air/fuel ratio. Accordingly, if the case where the vacuum producing means is to be operated is detected, it is possible to judge that the air/fuel ratio of the combustible mixture is richer than the air/fuel ratio of the normal lean combustion (stratified combustion).

In this case, the air/fuel ratio is judged directly from the vacuum pressure amount or from the operation for throttling the intake amount for increasing the intake pipe vacuum pressure for maintaining the brake vacuum. Accordingly, it is possible to reduce the purge amount before the air/fuel ratio is enriched, to prevent the misfire in advance.

(6-3) Furthermore, in the case where the brake booster is provided, a vacuum pressure amount detecting means for detecting the vacuum pressure amount within the brake booster may be provided. In this case, the above-described air/fuel ratio judging means may be constructed to make a judgement in accordance with the vacuum amount detected by the vacuum pressure amount detecting means.

In the case where the vacuum pressure amount detected by the vacuum pressure amount detecting means is smaller than a predetermined amount, this is the same as the case where it is necessary to operate the vacuum pressure producing means as described in the item (6-2). Accordingly, it is judged that the air/fuel ratio of the combustible mixture is enriched more than the air/fuel ratio of the normal lean combustion (stratified combustion) condition. In this case, it is possible to reduce the purge amount and to prevent the misfire before the enrichment of the air/fuel ratio in the same manner as in the item (6-2).

(6-4) Also, an intake density detecting means for detecting an intake density is provided so that the air/fuel ratio judging means may make a judgement on the basis of the intake density detected by the intake density detecting means.

In the case where the intake density is lower than the reference value, it is judged that the air/fuel ratio of the combustible mixture is enriched more than the air/fuel ratio of the normal lean combustion (stratified combustion) condition.

In the case where the vehicle travels in high land, since the purge amount is reduced when the intake density is lowered, it is possible to prevent the misfire caused by the enrichment of the air/fuel ratio under the condition that the oxygen per unit volume is insufficient.

(6-5) When it is judged by the air/fuel judgement means that the air/fuel ratio is enriched, it is possible to provide an injection condition changing means for changing the fuel injection condition together with the restriction of the purge amount by the fuel restricting means.

In this case, since the injection amount is compensated for as the purge amount is reduced, it is possible to ensure more suitable combustion.

(6-6) It is possible to provide a concentration detecting means for detecting a fuel vapor concentration and a compensation means for compensating for the fuel injection condition or the purge amount in response to the concentration of the fuel vapor.

Since the purge amount or the fuel injection condition is compensated for in response to the fuel vapor concentration, it is possible to ensure more suitable combustion.

(6-7) Incidentally, conventionally, a regular vehicle has a canister for storing the fuel vapor generated from the fuel storing means for storing the fuel for driving the internal combustion engine. Accordingly, according to the present invention, the above-described purge passage may communicate the intake system of the internal combustion engine and the canister with each other.

(6-8) The above-described features may be combined as much as possible.

(7) According to the present invention, a sixth feature of the invention resides in a fuel vapor feed controlling apparatus for a lean burn internal combustion engine comprising: a purge passage for purging fuel vapor, generated from a fuel storing means for storing fuel of the internal combustion engine, to an intake system of the internal combustion engine; a purge controlling means for controlling a fuel vapor amount, to be introduced from the purge passage to the intake system, in response to an operational condition of the internal combustion engine; a fuel vapor compensation means for compensating for the fuel vapor amount in response to an operation condition of the internal combustion engine; an injection amount changing means for changing the fuel injection amount to the internal combustion engine on the basis of the compensated fuel vapor amount; and a correction controlling means for increasing and decreasing the fuel vapor amount in response to the operational condition after the injection amount change and for controlling a fuel injection timing on an advance side or on a retard side.

In this case, an output variation may be exemplified as the operational condition after the fuel injection amount has been changed. Within the scope of the spirit of the invention, it is possible to use other elements showing other operational conditions such as an engine revolution speed, a combustion pressure or the like.

In the case where the operational condition is not stable after the fuel injection amount has been changed by the injection amount changing means, for example, in the case where the output variation is not suppressed, the correction controlling means decreases the fuel vapor amount to change the injection timing on the advance side.

In the case where the operational condition is stable after the fuel injection amount has been changed by the injection amount changing means, for example, in the case where the output variation is suppressed, the correction controlling means increases the fuel vapor amount to change the injection timing on the retard side.

In the case where the operational condition is not stable after the fuel injection amount has been changed by the injection amount changing means, like the large output variation, the fuel vapor amount is decreased and at the same time, the injection timing is changed on the advance side. Accordingly, the output variation is suppressed, and the operational condition may be directed to the stability.

Also, in the case where the operational condition is stable after the fuel injection amount has been changed by the injection amount changing means, it is possible to increase the fuel vapor amount since the combustion is stabilized. It is therefor possible to readily perform the process of the vapor, and at the same time, it is possible to keep the stable combustion since the injection timing is changed on the retard direction.

(7-2) Also, it is possible to provide a reference value setting means for setting a stability judgment standard of the operational condition in response to the engine revolution speed and a stability judgement means for judging the stability of the internal combustion engine in accordance with a change width on the basis of the reference value set by the reference value setting means.

Thus, it is possible to judge the stability with a variation width from the reference value, and it is possible to control the fuel vapor amount in response to the variation width, to make it easy the control. Also, at a high Revolution speed or in the homogeneous combustion, the variation width is narrow. The compensation is smaller than the compensation amount at a low Revolution speed or in the stratified combustion (lean burn). As a result, it is possible to prevent the malfunction of the compensation of the fuel injection amount.

(7-3) Furthermore, the operational condition includes a change rate ΔDLN of the torque variation of the internal combustion engine and a torque variation change ΔTDLN of the internal combustion engine. It is possible to provide a compensation means for compensating for at least one of the fuel vapor amount and the fuel injection amount from the torque variation and the torque variation change. By this compensation, it is possible to prevent the rich misfire caused by the purge with a more precision.

BRIEF DESCRIPTION OF THE DRAWINGS

In the accompanying drawings:

FIG. 19 is a chart showing a relationship between the vapor concentration and the compensation coefficient used in the control shown in FIGS. 12 to 18;

DESCRIPTION OF THE PREFERRED EMBODIMENTS

An embodiment of the present invention will now be described in greater detail with reference to the accompanying drawings.

FIGS. 1 through 43 show embodiments embodying the first to fourth features of the present invention.

Figure 1:
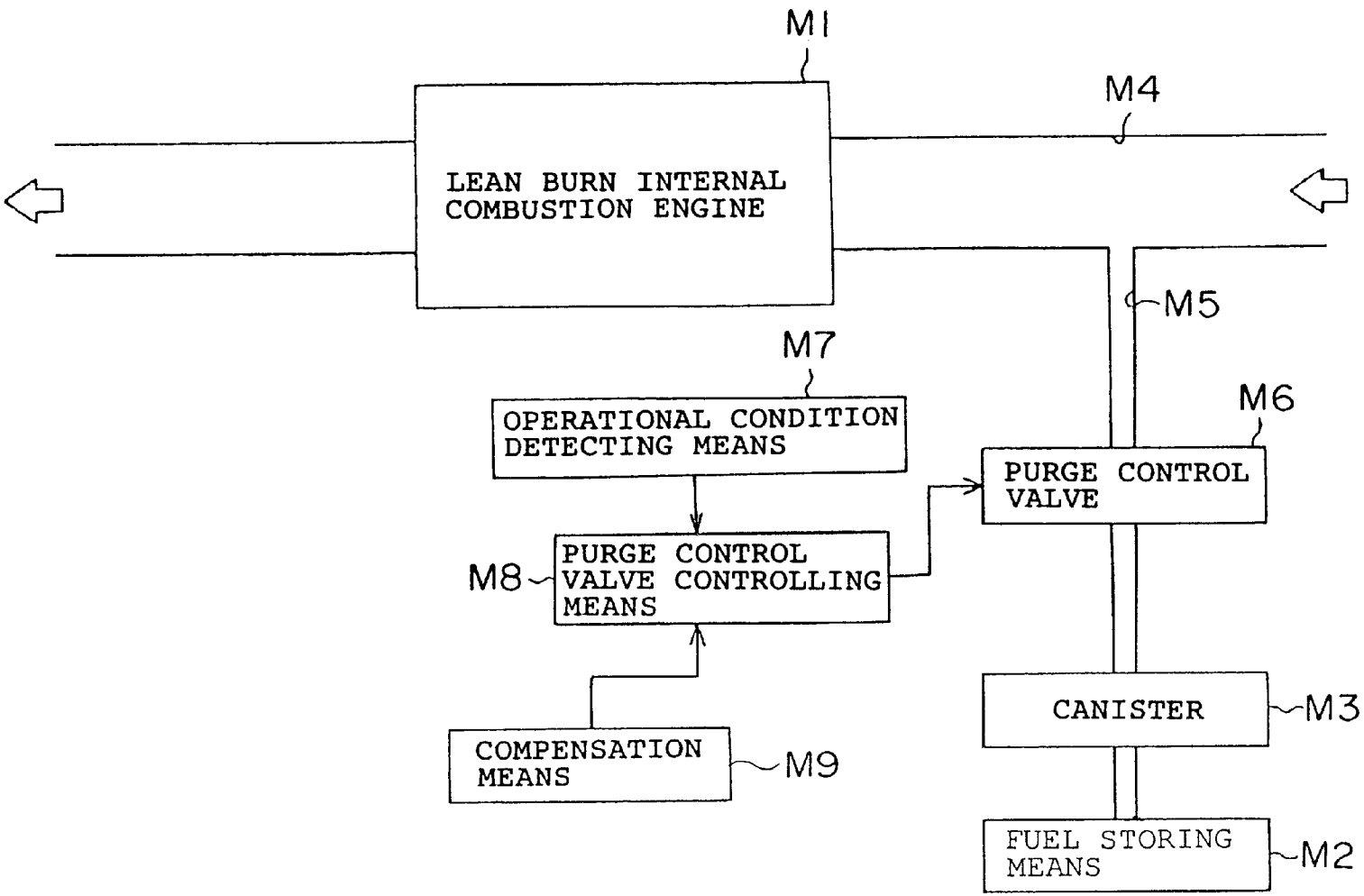
FIG. 1 is a schematic diagram showing a basic concept of the present invention.

FIG. 1 is a view showing an outline of the apparatus according to the present invention. In FIG. 1, M1 denotes a lean burn type internal combustion engine in which a fuel storing means M2 for storing fuel for driving the lean burn type internal combustion engine M1 is provided in a vehicle body (not shown). A canister M3 for storing evaporated fuel generated from the fuel storing means M2 is connected to the fuel storing means M2.

A purge passage M5 is provided for communicating the canister M3 and an intake system M4 of the internal combustion engine M1 with each other. A purge control valve M6 for controlling the fuel vapor amount of the evaporated fuel to be introduced into the intake system M4 is provided in the midway of the purge passage M5 as a purge controlling means for controlling, in response to the operational condition of the internal combustion engine, the fuel vapor amount to be introduced from the purge passage M5 to the intake system. Also, the operational condition detecting means M7 for detecting the operational condition of the internal combustion engine is provided as a purge controlling means. Furthermore, a purge control valve controlling means M8 for controlling the purge control valve in response to the operational condition detected by the operational condition detecting means M7 is provided.

Furthermore, a compensation means M9 for compensating the fuel vapor amount is connected to the purge control valve controlling means M8. The purge control valve controlling means M8 compensates for and controls the purge control valve M6 on the basis of the compensation value of the fuel vapor amount compensated for by the compensation means M9.

The following compensation means may be provided as an embodiment of the compensation means M9.

(1) First Compensation Means

A first compensation means is a compensation means for compensating for the fuel vapor amount so that the engine revolution speed of the internal combustion engine is identical with the target Revolution speed.

(2) Second Compensation Means

A second compensation means is a compensation means for compensating for the fuel vapor amount in response to the engine revolution speed of the internal combustion engine.

(3) Third Compensation Means

A third compensation means is a compensation means for compensating for the fuel vapor amount in response to the output variation of the internal combustion engine.

(4) Fourth Compensation Means

A fourth compensation means is a compensation means for compensating for the fuel vapor amount in response to the combustion of the internal combustion engine.

(5) Fifth Compensation Means

Figure 2:
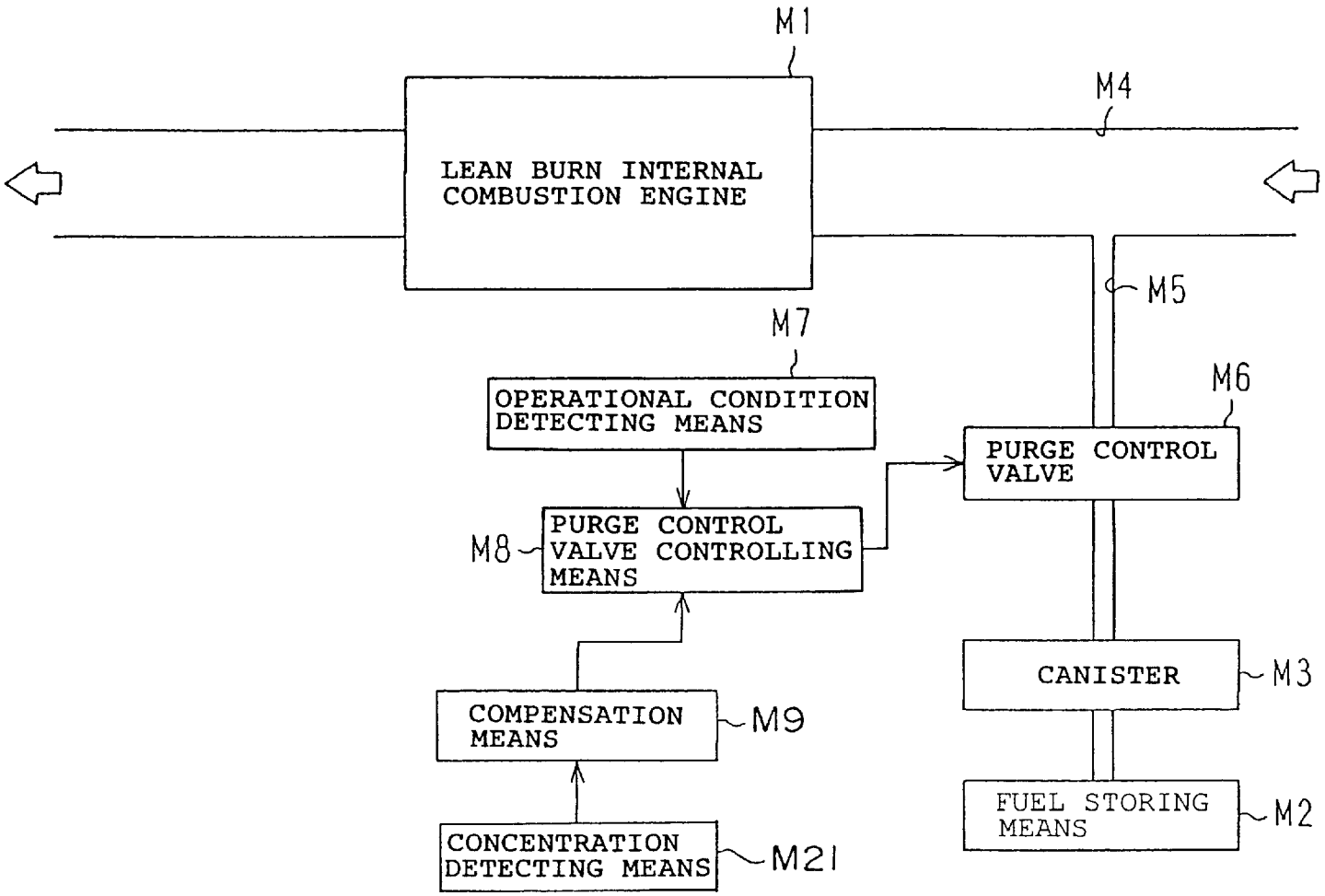
FIG. 2 is a basic conceptional view in case of provision of a concentration detecting means according to the present invention.

A fifth compensation means requires the provision of a concentration detecting means M21 for detecting the concentration of the fuel vapor as a prerequisite as shown in FIG. 2. Then, the fifth compensation means compensates for the fuel injection condition or the opening degree of the purge control valve in response to the concentration of the fuel vapor detected by the In concentration detecting means.

(6) Combination of Compensation Means

The first to fourth means are applied independently or in any combination according to the present invention. The fifth compensation means is applied in parallel with the first to fourth compensation means according to the present invention.

Figure 3:
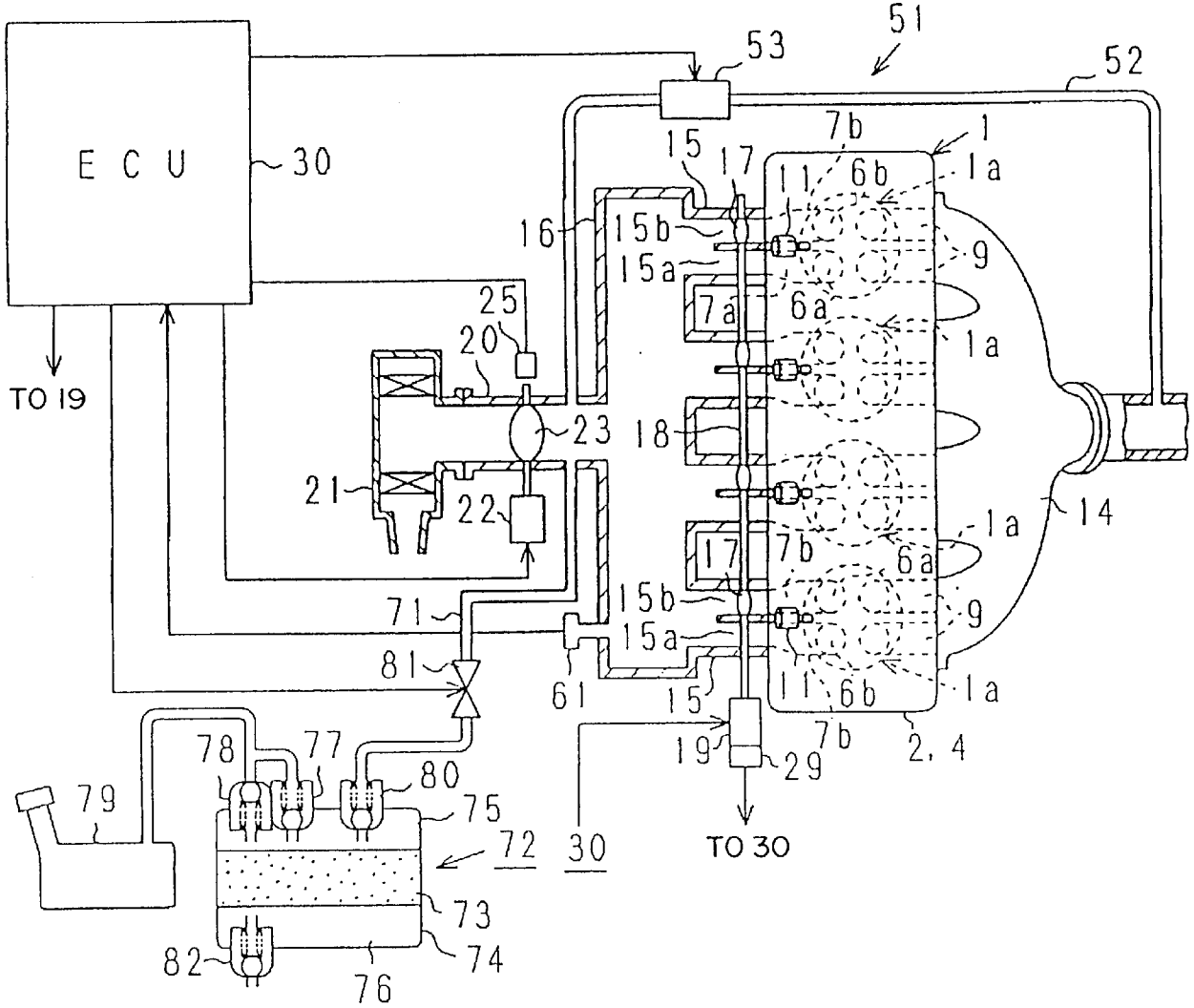
FIG. 3 is a schematic view showing a fuel vapor feed controlling apparatus for an engine in accordance with an embodiment of the invention.
Figure 4:
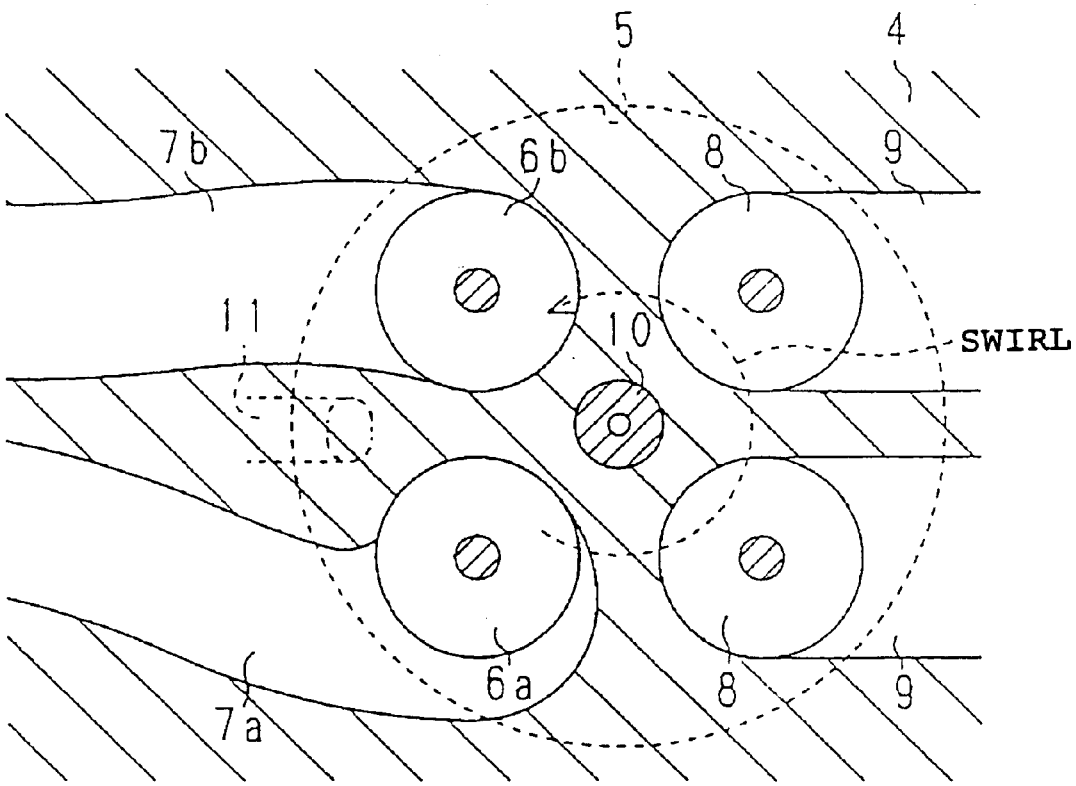
FIG. 4 is an enlarged cross-sectional view showing a cylinder portion of the engine.

FIG. 3 is a schematic diagram showing a fuel vapor feed controlling means of a sleeve interior injection type engine mounted on a vehicle. The engine 1 is provided with, for example, four cylinders 1*a* as an internal combustion engine. A structure of each cylinder 1*a* is shown in FIG. 4. As shown in FIGS. 3 and 4, the engine 1 is provided with pistons within a cylinder block 2 which pistons are reciprocated within the cylinder block 2. A cylinder head 4 is provided in an upper portion of the cylinder block 2. A combustion chamber 5 is formed between each piston and the cylinder head 4.

Also, in this embodiment, as shown in FIG. 4, four valves are arranged per one cylinder 1*a*. More specifically, there are provided a first intake valve 6*a*, a second intake valve 6*b*, a first intake port 7*a*, a second intake port 7*b*, a pair of exhaust valves 8 and 8, and a pair of exhaust ports 9 and 9, respectively.

As shown in FIG. 4, the first intake port 7*a* is a helical intake port and the second intake port 7*b* is a straight port extending substantially straightly. A spark plug 10 is provided in a central portion of an inner wall of the cylinder head 4. A light voltage is applied to the spark plug 10 from the ignitor 12 through a distributor (not shown). The sparking timing of the spark plug 10 is determined by the timing of outputting the high voltage from the ignitor 12. Furthermore, a fuel injection valve 11 is provided as a fuel injection means around the peripheral portion of the inner wall of the cylinder head in the vicinity of the first intake valve 6*a* and the second intake valve 6*b*. Namely, in the embodiment, the fuel from the fuel injection valve 11 is injected directly into the cylinder 1*a*. Thus, it is possible to conduct so-called stratified combustion (lean burn) together with the effect of a swirl control valve SCV 17 in addition to homogenous combustion.

As shown in FIG. 3, the first intake port 7*a* and the second intake port 7*b* of each cylinder 1*a* are connected to a surge tank 16 through a first intake passage 15*a* and a second intake passage 15*b* formed in each intake manifold 15. A swirl control valve (SCV) 17 is disposed in each second intake passage 15*b*. These SCVs 17 are connected to a stepping motor 19 through a common shaft 18. This stepping motor 19 is controlled on the basis of the output signal from an electronic controlling unit (hereinafter simply referred to as "ECU") to be described later.

The surge tank 16 is connected to an air cleaner 21 through an intake duct 20. A throttle valve 23 which is opened and closed by another stepping motor 22 is disposed in the intake duct 20. Namely, the throttle valve 23 according to this embodiment is of so-called electronic controlling type and the stepping motor 22 is basically driven on the basis of the output signal from the ECU 30 to thereby open and close the throttle valve 23. Then, the amount of the intake air to be introduced into the combustion chamber 5 through the intake duct 20 is adjusted by the opening and closing of the throttle valve 23.In this embodiment, the intake passage as an intake system is constituted by the intake duct 20, the surge tank 16, the first intake passage 15*a* and the second intake passage 15*b*. Also, a throttle sensor 25 is provided in the vicinity of the throttle valve 23 for detecting the opening degree (throttle opening degree TA).

In this sleeve interior injection type internal combustion engine according to the embodiment, in comparison with an intake pipe injection type internal combustion engine, the throttle valve 23 is maintained at a full throttle side except for an extremely low load operation. In this condition, the throttle valve is controlled to be opened and closed.

Also, the throttle valve 23 is drivingly opened or closed to adjust the idle Revolution speed control (ISC) of the internal combustion engine, i.e., the intake air amount. Incidentally, upon the homogenous combustion, the Revolution speed is controlled by the opening and closing of the electronic throttle vale 23, and upon the stratified combustion, it is controlled by the fuel injection amount, and the Revolution speed is controlled by the EGR amount, the ignition timing and the throttle valve opening/closing.

An exhaust manifold 14 is connected to the exhaust ports 9 of each cylinder. The burnt exhaust gas is purified by an exhaust gas purifying catalyst such as a three-element catalyst, NOx purifying catalyst and the like through the exhaust manifold 14 and is discharged to an exhaust duct 13. Incidentally, an air/fuel ratio sensor may be disposed upstream or downstream of the catalyst to control the fuel injection.

Furthermore, in the embodiment, a well know exhaust gas recirculation (EGR) system 51 is provided. The EGR system 51 includes an EGR passage 52 as an exhaust gas recirculation passage and an EGR valve 53 as an exhaust gas recirculation valve disposed in the midway of the EGR passage 52. The EGR passage 52 is provided for communicating the intake duct 20 downstream of the throttle valve 23 and the exhaust duct.

Also, the EGR valve 53 is internally provided a valve seat, a valve body and a stepping motor (any of which is not shown) which constitute the EGR mechanism. The opening degree of the EGR valve 53 is varied by intermittently changing the valve body to the valve seat by the stepping motor. Then, the EGR valve 53 is opened so that the part of the exhaust gas discharged to the exhaust duct is caused to flow to the EGR passage 52. The exhaust gas is caused to flow to the intake duct 20 through the EGR valve 53. Namely, the part of the exhaust gas is recirculated into the sucked mixture by the EGR system 51. At this time, the opening degree of the EGR valve 53 is adjusted to adjust the recirculation amount of the exhaust gas.

A purge controlling unit 72 for feeding the fuel vapor into the intake duct 20 is mounted on the intake duct 20. A canister 74 having an activated charcoal layer 73 is provided in the purge controlling unit 72. A fuel vapor chamber 75 and an air chamber 76 are formed on both sides of the activated charcoal layer 73 within the canister 74. The fuel vapor chamber 75 is connected to a fuel reservoir 79 as the fuel storing means through a pair of check valves 77 and 78 juxtaposed to each other and allowing the flow in the opposite directions to each other.

A joint pipe 71 is connected as a purge passage between the fuel vapor chamber 75 and the intake duct 20 downstream of the throttle valve 23. A first solenoid valve 81 and a check valve 80 for allowing the flow only in the direction toward the intake duct 20 from the fuel vapor chamber 75 is provided in the joint pipe 71. The solenoid valve 81 is a control valve for making it possible to perform the duty control by the ECU 30 to be described later and is used as a purge control valve.

The duty control means a control for adjusting the opening degree in response to a duty ratio of the input pulse signal. The solenoid valve 81 may be a linear valve.

The air chamber 76 is in communication with the atmosphere through a check valve 82 for allowing the flow only on the side of the air chamber 76.

When the feed of the fuel vapor to the intake duct 20 is to be stopped, the solenoid valve 81 is opened by the control of the ECU 30 to be described later. At this time, the fuel vapor generated within the fuel reservoir 79 is caused to flow into the fuel vapor chamber 75 through the check valve 78 and subsequently to be absorbed onto the activated charcoal within the activated charcoal layer 73.

When the pressure within the fuel reservoir 79 is lowered, the check valve 77 is opened. Accordingly, the fuel reservoir 79 is prevented from being deformed due to the pressure drop within the fuel reservoir 79 by the check valve 77.

In contrast, when the fuel vapor is to be fed into the intake duct 20, the solenoid valve 81 is opened by the ECU 30. Then, the air is discharged to the air chamber 76 through the check valve 82, and the air is fed into the activated charcoal layer 13. At this time, the fuel absorbed on the activated charcoal is separated to thus cause the air (fuel vapor) containing the fuel component to flow into the fuel vapor chamber 75. Subsequently, the fuel vapor is fed into the intake duct 20 through the check valve 80 and the solenoid valve 81.

Figure 5:
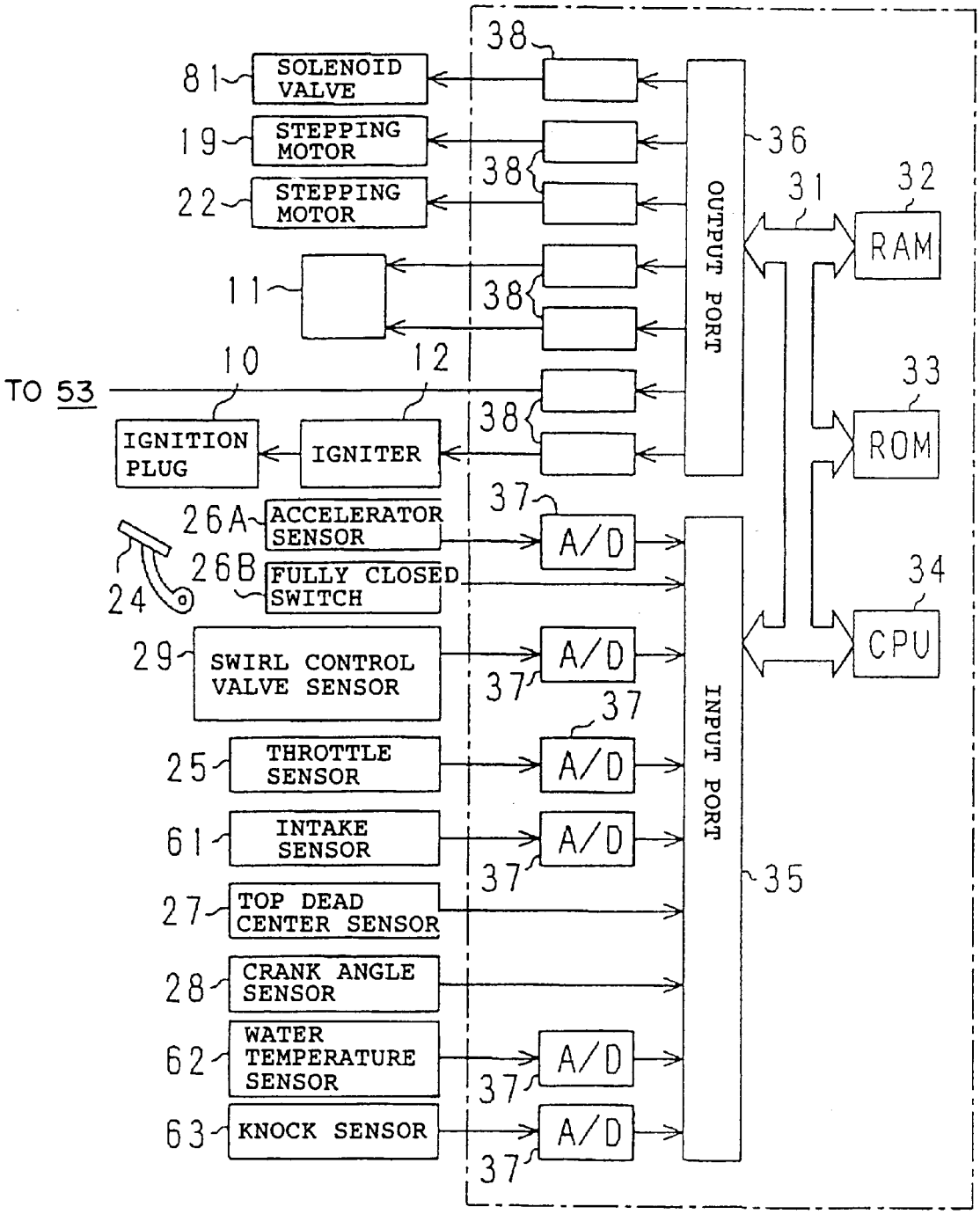
FIG. 5 is a mechatronic block diagram showing a scheme of an ECU.

By the way, as shown in FIG. 5, the above-described ECU 30 is composed of a digital computer provided with a RAM (random access memory) 32, a ROM (read only memory) 33, a CPU (central processing unit) 34 composed of a microprocessor, an input port 35 and an output port 36 connected to each other through a two-way bus 31. In this embodiment, the fuel feed controlling means, the purge control valve controlling means, the first compensation means, the second compensation means, the third compensation means, the fourth compensation means, and the fifth compensation means are constituted by the ECU 30. These components are made by a combination of a hardware and a software. The software is written in the ROM and is loaded on the CPU to realize the respective means.

An accelerator sensor 26A is connected to an accelerator pedal 24 of the vehicle for generating an output voltage in proportion to a step amount of the accelerator pedal 24. An accelerator degree ACCP is detected by the accelerator sensor 26. The output voltage of the accelerator sensor 26A is inputted into the input port 35 through an AD convertor 37.

A fully closed switch 26B is provided to the accelerator pedal 24 for detecting the condition that the step amount of the accelerator pedal 24 is zero. Namely, the fully closed switch 26B generate a "1" signal as a fully closed signal XIDL in the case where the step amount of the accelerator pedal 24 is zero and generates a zero signal in other cases. Then, the output voltage of the fully closed switch 26B is inputted into the input port 35.

Also, for example, a top dead center sensor 27 generates an output pulse when the piston of the first cylinder 1*a* reaches the intake top dead center. This output pulse is inputted into the input port 35. A crank angle sensor 28 generates an output pulse through every 30° CA rotation of the crankshaft. This output pulse is inputted into the input port. The engine revolution speed NE is calculated or read-in in the CPU 34 from the output pulse of the top dead center sensor 27 and the output pulse of the crank angle sensor 28.

Furthermore, the rotational angle of the above-described shaft 18 is detected by a swirl control valve sensor 29 by which the opening degree of the swirl control valve (SCV) 17 may be detected. Then, the output of the swirl control valve sensor 29 is inputted into the input port 35 through the A/D convertor 37.

In addition, the throttle opening degree TA is detected by the throttle sensor 25. The output of the throttle sensor 25 is inputted into the input port 35 through the A/D convertor 37.

In addition, in this embodiment, an intake pressure sensor 61 is provided for detecting a pressure (intake pressure PIM) within the surge tank 16. Furthermore, a water temperature sensor 62 is provided for detecting a temperature of cooling water for the engine 1 (cooling water temperature THW). Also, the outputs of the two sensors 61 and 62 are inputted into the input port 35 through the A/D convertor 37.

Moreover, a knock sensor 63 is provided on the cylinder block 2 of the engine 1 as a knock detecting means for detecting a knock of the engine 1. This knock sensor 63 is a kind of a vibration pickup having, for example, a characteristic such that a detecting ability is adjusted by the resonance due to the identification between the frequency of vibrations generated by the knock and the intrinsic frequency of vibrations of the detecting element. Also, the output of the knock sensor 63 is inputted into the input port 35 through the A/D convertor 37. Incidentally, in order to detect the torque variation, a combustion pressure sensor for detecting the combustion pressure may be additionally used.

Also, the ECU 30 has a gate signal generator which outputs an opening/closing signal to the input port 35 on the basis of the signal from the CPU 34. Namely, the detection signal from the knock sensor 63 is inputted into the input port 35 in accordance with the open gate signal from the CPU 34. It is interrupted by the closed gate signal. Thus, a constant period is set in the detection of the knock (judgement).

On the other hand, connected through the associated driver circuits 38 to the output port 36 are the respective fuel injection valves 11, the respective stepping motors 19 and 22, the ignitor 12, the EGR valve 53 (stepping motor) and the solenoid valve 81. The fuel injection valve 11, the stepping motors 19 and 22, the ignitor 12, the EGR valve 53, the solenoid valve 81 and the like are suitable controlled in accordance with the control program stored in the ROM 33 on the basis of the signals of respective sensors and the like 25 to 29 and 61 to 63 in the ECU 30.

The respective sensors and the like 25 to 29 and 61 to 63 constitute the operational condition detecting means. The programs for the various controls in the fuel vapor feed controlling apparatus for the engine provided with the above-described structure in accordance with the embodiment will now be described with reference to the flowchart.

Control in Stop of Vehicle at Idle condition

Control by First Compensation Means

Figure 6:
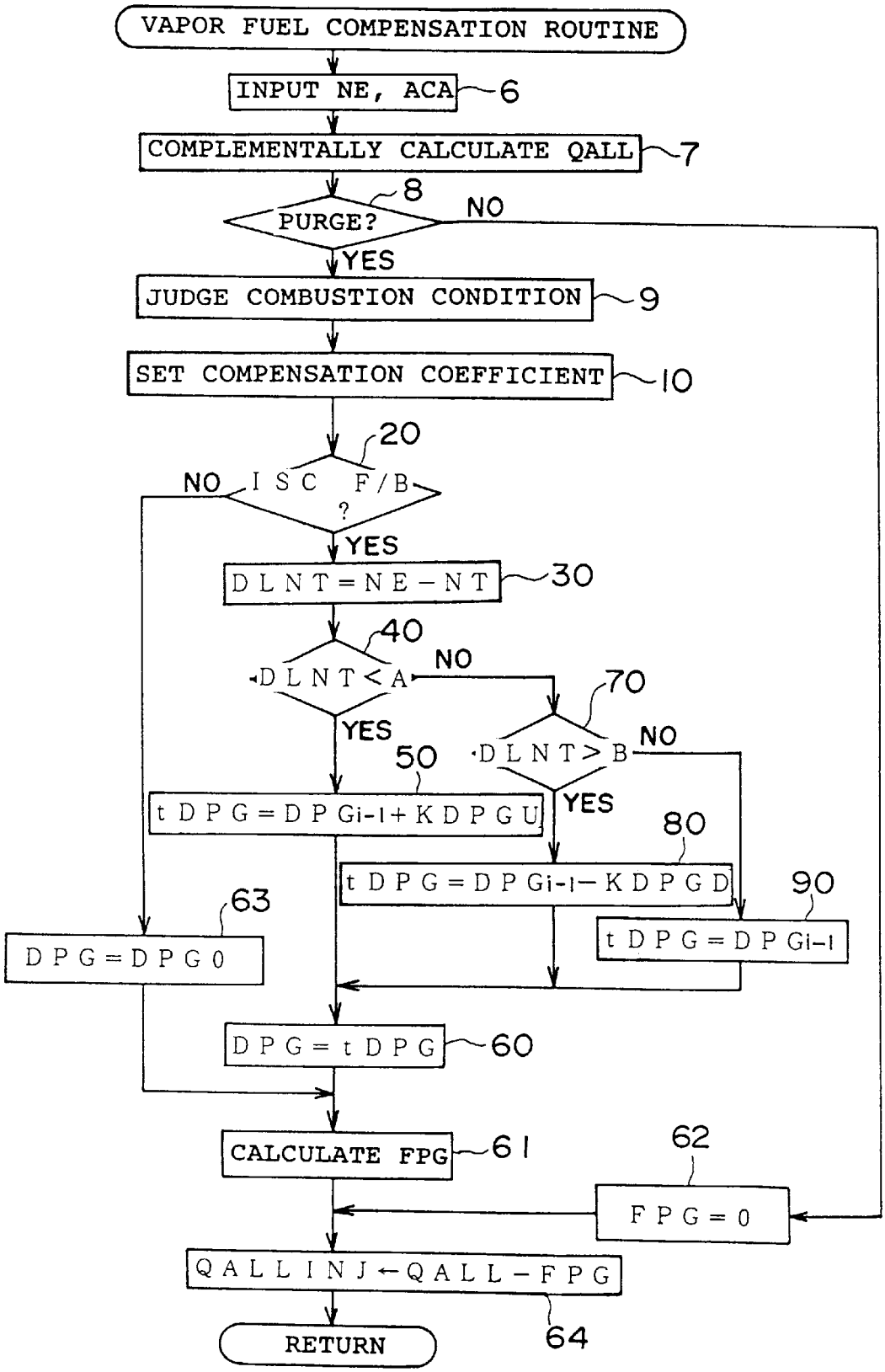
FIG. 6 is a flowchart showing a "purge control routine" in a standstill in an idle state executed by the ECU.

FIG. 6 is a flowchart showing a "purge control routine" in the stop of the vehicle in the idle condition. The ECU 30 (CPU) executes the operation in an interrupt at every predetermined period. Incidentally, this example is the case where the characterizing points of the above-described (1) and (1-1) are executed and the fuel vapor amount is compensated for so that the engine revolution speed is identical with the target revolution speed.

Namely, first of all, although not shown, the basic fuel injection amount corresponding to the accelerator opening degree and the engine revolution speed is complementally calculated from a map for determining a mutual relation between the engine revolution speed and accelerator opening degree and the basic fuel injection amount in step 7. A plurality of kinds of maps corresponding to the operational conditions or the combustion conditions are prepared as injection amount maps. A suitable one is selected from these maps.

In step 8, it is judged whether or not the purge is effected. If the purge is effected, in step 9, the current condition is judged from the accelerator opening degree ACA. A value of each compensation coefficient in the purge control in correspondence with each combustion condition is read from the ROM 33. The various compensation coefficients are, for example, purge duty renewal amounts KDPGU and KDPGD.

Incidentally, the engine 1 may take one of the stratified combustion, the weak stratified combustion, the homogeneous lean combustion and the homogeneous combustion under the control of the ECU 30. A combustion mode FMODE is set at zero on the basis of the engine revolution speed NE and the accelerator opening degree ACCP in the case where the combustion condition is the stratified combustion, the combustion mode FMODE is set at "1" in the case where the combustion condition is the weak stratified combustion, the combustion mode FMODE is set at "2" in the case where the combustion condition is the homogeneous lean combustion, and the combustion mode FMODE is set at "3" in the case where the homogeneous combustion is executed.

Then, in the case where the current combustion condition is not the stratified combustion, the judgement for this is "NO" to thereby finish this control routine once. In the case where the current combustion condition is the stratified combustion, the judgement for this is "YES" to shift to step 20.

In step 20, it is judged whether or not the feed-back control of the idle speed control (ISC) is effected. In this case, it is judged whether or not another ISC control routine is executed. If the ISC control routine is not executed, it is judged that the engine revolution speed NE is not stable, and this judgement is "NO" to shift to step 63. If the ISC control routine is executed, it is judged that the engine revolution speed NE is stable, and this judgement is "YES" to shift to step 30.

In step 30, a deviation DLNT between the engine target Revolution speed NT and the actual engine revolution speed NE is calculated for the first compensation means. Subsequently, in step 40, it is judged whether or not the deviation DLNT is smaller than the first judgement value A (rpm). In step 40, in the case where the deviation is less than the first judgement value A, i.e., when the engine is stable, the process is shifted to step 50 and a temporarily demanded purge duty value tDPG is calculated. The temporarily demanded purge duty value tDPG is one obtained by adding the purge duty renewal amount KDPGU to the previous value $DPG_{i-1}$ (finally demanded duty value obtained by the previous control routine).

The purge duty renewal amount KDPGU is one obtained through experiments or the like in advance and is stored in the ROM 33. Subsequently, in step 60, the temporarily demanded purge duty value tDPG calculated in the above-described step 50 as the finally demanded duty value DPG is set to thereby finish the control routine.

Also, in the above-described step 40, if the deviation DLNT is equal to or more than the judgement value A, it is judged that any variation is present in the engine revolution speed, and in step 70, it is judged whether or not the deviation DLNT is smaller than a second judgement value B (rpm). Incidentally, the relationship of A<B is established. In step 70, in the case where it is judged that the deviation DLNT exceeds the second judgement value B, the process is shifted to step 80 and the temporarily demanded purge duty value tDPG is calculated. The temporarily purge duty value tDPG is one obtained by subtracting the purge duty renewal amount KDPGD from the previous value $DPG_{i-1}$ (the finally demanded duty value obtained in the previous control routine). The purge duty renewal amount KDPGD is predetermined by experiments or the like and is stored in the ROM 33.

Incidentally, the values of the above-described purge duty renewal amounts KPGU and KDPGD may be varied according to the operational condition or the combustion condition. For example, the values may be large for the homogeneous combustion, whereas the values may be small for the stratified combustion. Thus, a large amount of purge may be introduced when the homogeneous combustion takes place, wherein the purge variation is suppressed in the stratified combustion. It is therefore possible to stabilize the combustion. Also, in switching the combustions, if the purge duty renewal amounts KDPGU and KDPGD are changed skipwise so that the values are renewed to the renewal amounts corresponding to the combustion after switching, it is possible to stabilize the combustion after switching.

Subsequently, in step 60, the temporarily demanded purge duty value tDPG calculated in the above-described step 80 as the finally demanded duty value DPG is set.

Also, in the above-described step 70, it is judged that the deviation DLNT is equal to or less than the judgement value B, the process shifts to step 90 so that the temporarily demanded purge duty value tDPG is calculated. The temporarily demanded purge duty value tDPG is the finally demanded duty value $DPG_{i-1}$ of the previous operation.

Subsequently, the process shifts to step 60 and the temporarily demanded purge duty value tDPG which has been obtained in step 90 is set as the finally demanded duty value DPG.

Incidentally, in the case where it is judged in step 20 that the ISC control routine is not executed, that is, unless the ISC is stable in F/B, the duty value DPGO temporarily stored in the previous stable mode is substituted for the finally duty value DPG as the PDG (step 63).

Accordingly, ECU 30 duty controls the solenoid valve 81 on the basis of the finally demanded duty value DPG obtained in step 60 or 63.

Figure 7:
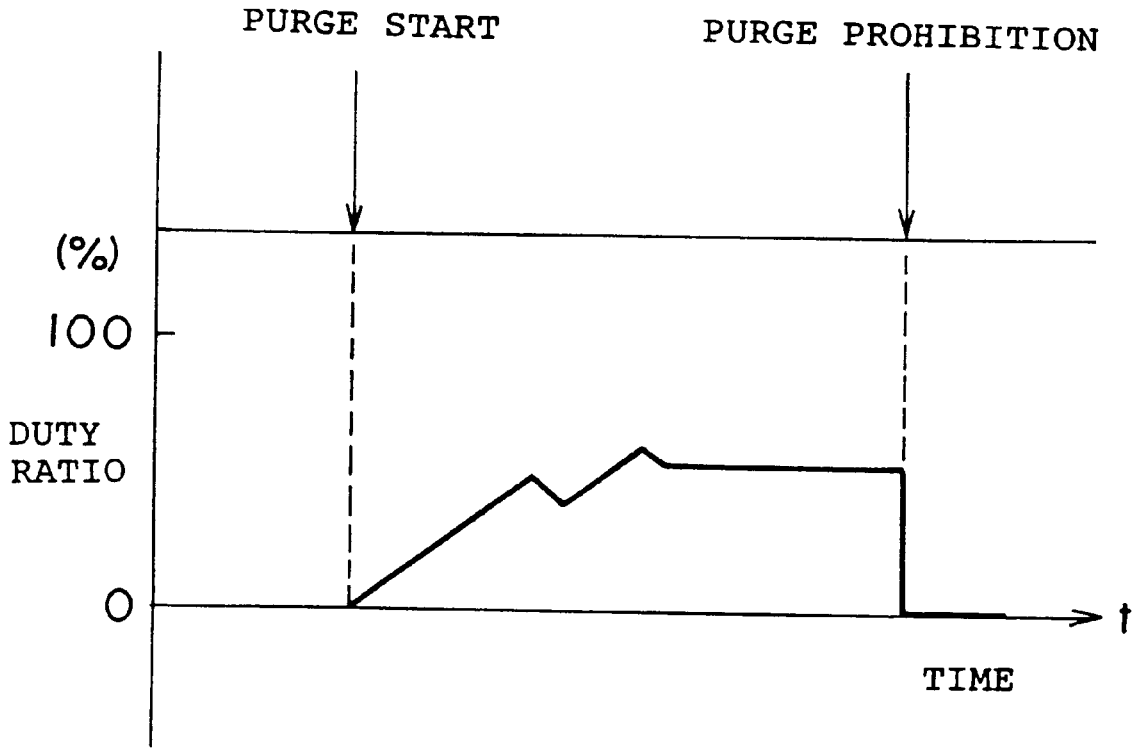
FIG. 7 is a graph showing a state of a duty control.

Incidentally, as shown in the graph of FIG. 7, if the purge execution conditions to be described later are established, the control of the purge control valve in accordance with the duty control is such that the duty ratio is raised from zero at the time of the start of the purge, the magnitude of the duty ratio is controlled in accordance with a predetermined control, and the duty ratio becomes zero at the moment when the purge prohibition command is effected.

If the duty ratio is determined in step 60, then the fuel vapor compensation amount is calculated from the duty ratio. Namely, since the purge amount is determined in accordance with the opening degree of the purge control valve determined by the duty ratio, the intake pipe vacuum pressure and the like, if the concentration of the fuel vapor contained in the purge gas is known, the fuel vapor amount is known (step 61). This fuel vapor amount is fed to the internal combustion engine. Therefore, in step 64, the fuel vapor amount is subtracted as the compensation amount from the basic fuel injection amount obtained in advance in accordance with the formula:

$$\text{Final fuel injection amount (QALLINJ)} = \text{basic fuel injection amount (QALL)} - \text{fuel vapor amount compensation amount (FPG)} \quad (1).$$

Accordingly, the fuel injection amount to be finally fed into the internal combustion engine may be compensated for.

Incidentally, in the case where the operation is out of the purge mode in step 8, the fuel vapor amount compensation amount is zero in step 62 and the basic fuel injection amount obtained in advance is used as the final fuel injection amount QALLINJ without any modification.

Thereafter, the fuel injection is performed in accordance with a separately determined fuel injection program.

In the "purge control routine" in FIG. 6, in step 40, if the deviation DLNT between the target engine revolution speed NT and the engine revolution speed NE that is the actually engine revolution speed is less than the first judgement value A, the actual Revolution speed NE is less than the target engine revolution speed NT. Accordingly, in order to increase the amount of the purge, the temporarily demanded purge duty renewal amount KDPGU is added to the previous value (the finally demanded duty value obtained by the previous control routine) $DPG_{i-1}$ to thereby obtain the temporarily purge duty value tDPG. The solenoid valve 81 is controlled under the condition that the temporarily purge duty value tDPG is the finally demanded duty value DPG. As a result, the amount of the purge of the fuel vapor is increased to increase the engine revolution speed.

Also, in the "purge control routine" in FIG. 6, in step 70, if the deviation DLNT between the target engine revolution speed NT and the engine revolution speed NE that is the actually engine revolution speed exceeds the second judgement value B, the actual Revolution speed NE is higher than the target engine revolution speed NT. Accordingly, in order to decrease the amount of the purge, the demanded duty value tDPG is the value obtained by subtracting the purge duty renewal amount KDPGU from the previous value (the finally demanded duty value obtained by the previous control routine) DPGi-l (step 80). Then, the temporarily demanded purge duty value tDPG is used as the finally demanded duty value DPG. As a result, the amount of the purge of the fuel vapor is decreased to decrease the engine revolution speed.

Furthermore, in the "purge control routine" in FIG. 6, if the deviation DLNT between the target engine revolution speed NT and the engine revolution speed NE that is the actually engine revolution speed is equal to higher than the first judgement value A and equal to or less than the second judgement value B, in step 90, the temporarily demanded purge duty value tDPG is used as the finally demanded duty value DPG obtained by the previous routine. Then, the temporarily demanded purge duty value tDPG is the finally demanded duty value DPG. As a result, in the case where the deviation falls within the above-described range, the purge amount of the fuel vapor is deemed to be kept constant.

Incidentally, the purge execution conditions in the sleeve interior direct injection type internal combustion engine are: the warming-up completion, i.e., the state where the cooling water temperature has been raised exceeding a predetermined temperature, and a state where a predetermined time, i.e., 30 sec has lapsed after the cranking completion.

Figure 8:
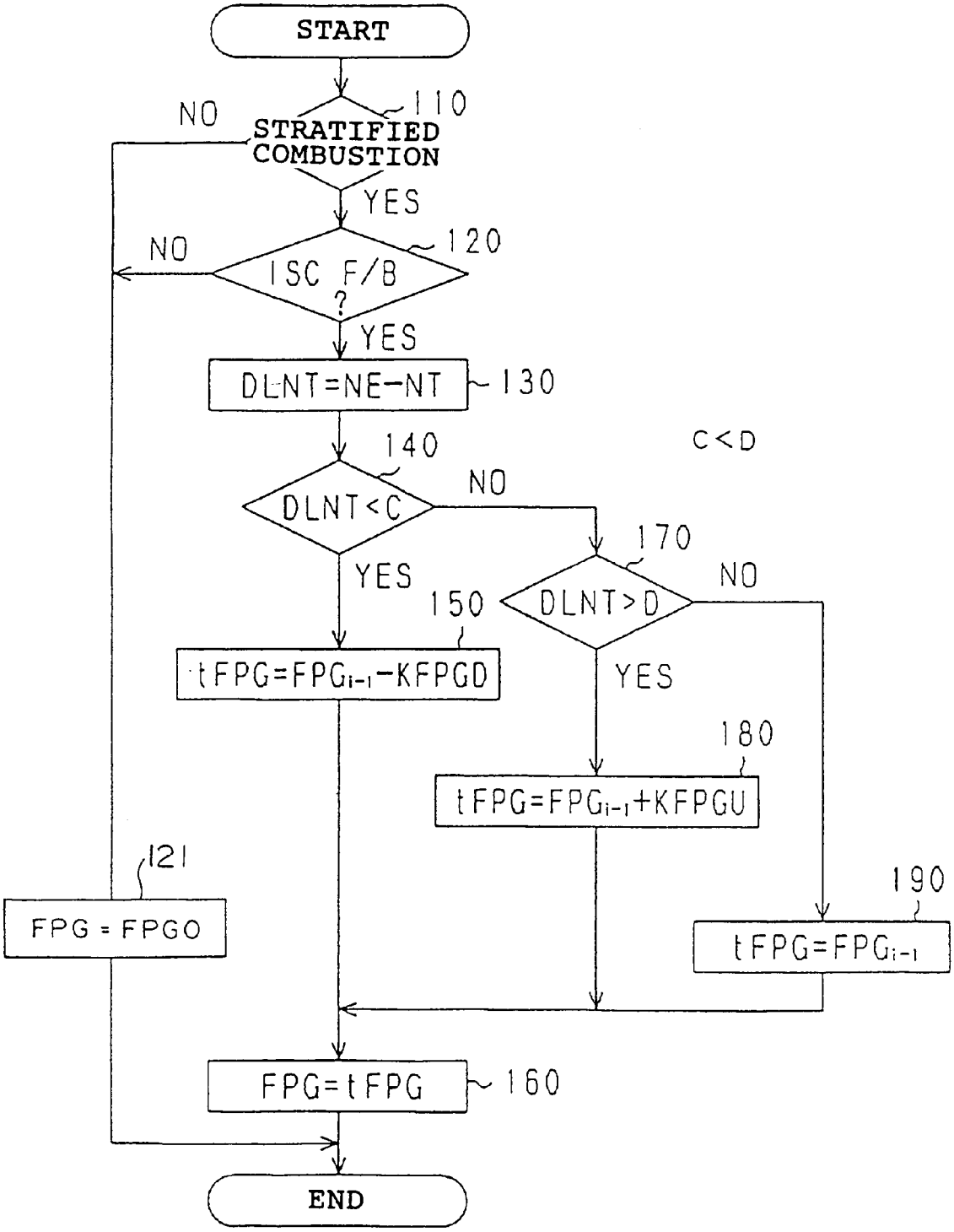
FIG. 8 is a flowchart showing a "fuel injection amount compensation value calculating routine" in a standstill in an idle state executed by the ECU.

FIG. 8 is a flowchart showing a "routine for calculating a compensation amount of a fuel injection amount" at a standstill of the vehicle in an idle condition in accordance with the embodiment. The ECU 30 executes interrupts at every predetermined time interval. In this example, the fuel feed amount adjustment shown in the item (1-2) is performed in addition to the feature of (1-1). This is attained by the fuel feed amount controlling means.

In this case, the fuel vapor amount compensation amount FPG is used as a control parameter instead of the duty ratio. The final fuel injection amount QALLINJ finally fed is given in the same manner as in item (1) as follows:

final fuel injection amount=basic fuel injection amount−fuel vapor amount compensation amount Accordingly, if the fuel vapor amount compensation amount FPG is increased, the final fuel injection amount QALLINJ is decreased to obtain a lean mixture, whereas if the fuel vapor amount compensation amount FPG is decreased, the final fuel injection amount QALLINJ is increased to obtain a rich mixture.

When the process shifts to this routine, first of all, the ECU 30 judges in step 110 whether or not the current combustion condition is the stratified combustion. In this case, judgement as to whether or not the stratified combustion is effected is judged on the basis of the current engine revolution speed NE and the current accelerator opening degree ACCP. Then, in the case where the combustion condition is not the stratified combustion, the judgement is "NO" to thereby once complete the control routine. In the case where the current combustion condition is the stratified combustion, the judgement is "YES" and the process shifts to step 120.

In step 120, it is judged whether or not the feed-back control of the idle speed control (ISC) is effected. In this case, it is judged whether or not another ISC control routine is effected. If the ISC control routine is not executed, the engine revolution speed NE is deemed to be unstable, and the judgement is "NO". Furthermore, the FPG temporarily stored in the previous stable condition is RPGO in step 121 and is substituted for the current FPG value to thereby once stop the control routine. If the ISC control routine is effected, the engine revolution speed NE is deemed to be stable, and the judgement is "YES". The process shifts to step 130.

In step 130, the deviation DLNT between the target engine revolution speed NT and the actual engine revolution speed NE is calculated as the first compensation means. Subsequently, in step 140, it is judged whether or not the deviation DLNT is less than the third judgement value C (rpm). If it is judged in step 140 that the deviation DLNT is less than the third judgement value C, the process shifts to step 150 to calculate the temporary fuel vapor amount compensation amount tFPG. The temporary fuel vapor amount compensation amount tFPG is one obtained by subtracting the fuel compensation renewal amount KFPGD from the previous value (the final fuel vapor amount compensation amount obtained by the previous control routine) $FPG_{i-1}$.

The fuel compensation renewal amount KFPGD is obtained through experiments or the like in advance and is stored in the ROM 33. Subsequently, in step 160, the temporary fuel vapor amount compensation amount tFPG calculated in the above-described step 150 is set as the final fuel vapor amount compensation amount FPG to finish the control routine.

Also, if, in step 140, the deviation DLNT is equal to or greater than the third judgement value C, in step 170, it is judged whether or not the deviation DLNT is greater than the fourth judgement value D (rpm). Incidentally, the relationship of C<D is established. In the same step 170, it is judged that the deviation DLNT exceeds the fourth judgement value D, the process shifts to 180 to calculate the temporary fuel vapor compensation amount tFPG. The temporary fuel vapor amount compensation amount tFPG is obtained by adding the fuel compensation renewal amount KFPGU to the previous value (the final fuel vapor amount compensation amount obtained by the previous control routine) $FPG_{i-1}$. The fuel compensation renewal amount KFPGU is obtained through experiments or the like in advance and is stored in the ROM 33.

Subsequential, in step 160, the temporary fuel vapor amount compensation amount tFPG calculated in the above-described step 180 is set as the final fuel vapor amount compensation amount FPG to finish the control routine.

Also, if, in the above-described step 170, the deviation DLNT is less than the fourth judgement value D, the engine revolution speed is deemed to be stable in a certain range, the process shifts to step 190 to calculate the temporary fuel vapor amount compensation amount tFPG. The temporary fuel vapor amount compensation amount tFPG is the previous value $FPG_{i-1}$. Subsequently, the process shifts to step 160, the final fuel vapor amount compensation amount $FPG_{i-1}$ obtained in the above-described step 190 is set as the final fuel vapor amount compensation amount FPG to finish the control routine.

The above-described routine corresponds to the steps 10 to 61 and 63 of FIG. 6. The ECU 30 calculates the final fuel injection amount QALLINJ in accordance with the above-described formula (1) with the same means as that of step 64 of FIG. 6.

The ECU 30 executes the injection control of the fuel injection valve 11 in accordance with the final injection amount in which the compensation amount is reflected on the basic fuel injection amount.

In the "fuel injection amount compensation value calculating routine" of FIG. 8, if the deviation DLNT is less than the third judgement value C, in step 150, one obtained by subtracting the fuel compensation renewal amount KFPGD from the previous value of the final fuel vapor amount compensation amount $FPG_{i-1}$ is the temporary fuel vapor amount compensating amount tFPG. This value is used as the final fuel vapor amount compensation amount FPG.

The obtained final fuel vapor amount compensation amount FPG is smaller than the previous FPG. Because the DLNT is less than C and the engine revolution speed is low, the value of the FPG is decreased to make rich the final fuel injection amount QALLINJ obtained in accordance with the above-described formula (1) to increase the engine revolution speed.

Also, in the "fuel injection amount compensation value calculating routine" of FIG. 8, in step 170, if the deviation DLNT exceeds the fourth judgement value D, in step 180, one obtained by adding the fuel compensation renewal amount KFPGD to the previous value of the final fuel vapor amount compensation amount $FPG_{i-1}$ is used as the temporary fuel vapor amount compensating amount tFPG. Then, this temporary fuel vapor amount compensation amount tFPG is used as the final fuel vapor amount compensation amount FPG.

This final fuel vapor amount compensation amount FPG is replaced into the formula (1) when the final fuel injection amount QALLINJ is calculated in the other routine. As a result, corresponding to the increment of the FPG, the final fuel injection amount QALLINJ is leaned to decrease the engine revolution speed.

Also, in the "fuel injection amount compensation value calculating routine" of FIG. 8, if the deviation DLNT is equal to or more than the third judgement value C and equal to or less than the fourth judgement value D, in step 190, the previous final fuel vapor amount compensation amount $FPGi-_1$ is used as the temporary fuel vapor amount compensating amount tFPG. Then, this temporary fuel vapor amount compensation amount tFPG is used as the final fuel vapor amount compensation amount FPG. As a result, in the case where the deviation DLNT falls within the above-described range, the fuel vapor amount compensation amount is kept constant.

In the examples of FIGS. 6 and 8, as described above, the purge amount of the fuel vapor is increased or decreased in response to the deviation DLNT between the target Revolution speed NT and the actual Revolution speed NE and the fuel injection amount is increased or decreased in response to the deviation DLNT to be converged to the idle target Revolution speed NT.

Namely, the finally demanded duty value DPG is obtained in response to the deviation DLNT between the target Revolution speed NT and the actual Revolution speed NE, the solenoid valve 81 is controlled in accordance with this value, the final fuel vapor amount compensation amount FPG is calculated and the fuel injection amount is increased or decreased on the basis of this value.

As a result, in the idle condition in which the stratified combustion is effected, it is possible to effectively reduce the base fuel. Furthermore, irrespective of the rich or lean mixture of the fuel vapor, it is possible to maintain a stability of the idle Revolution speed, which also contributes to the fuel consumption rate.

Running Control in Idle-Off Mode

Control by Third Compensation Means

Figure 9:
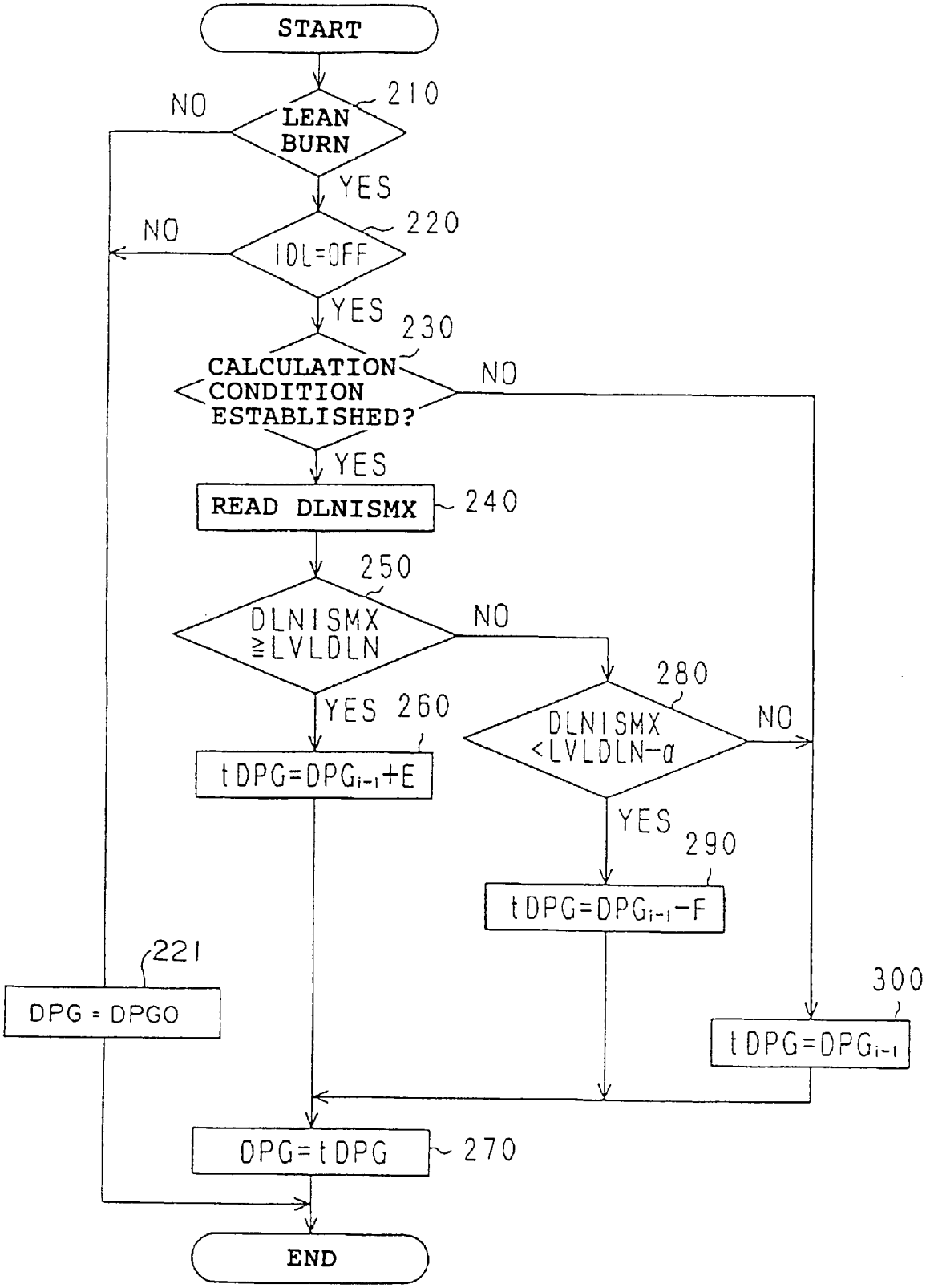
FIG. 9 is a flowchart showing a "purge control routine" in an idle-off state executed by the ECU.

FIG. 9 is a flowchart showing a "purge control routine" during the travel or drive of the vehicle in the idle-off mode in the embodiment of the invention, and the ECU 30 executes the interrupts at a predetermined time interval. The control in this case is an example of the feature (3) for compensating for the fuel vapor amount in response to the torque variation (output variation).

When the process shifts to this routine, first of all, ECU 30 judges in step 210 whether or not the current combustion condition is in a less level of the homogenous combustion condition, i.e., the stratified combustion condition, the weak stratified combustion or the homogeneous lean combustion condition or whether or not it is in a level of the homogeneous combustion condition. Namely, it is judged whether the combustion mode FMODE is "0", "1", "2" or "3". In this case, in the case where the combustion mode FMODE is out of "0", "1" and "2", it is judged that the combustion mode is not in the lean drive. Thus, the control routine is once stopped. In the case where, in step 210, the combustion mode FMODE is "0", "1" or "2", it is judged that the combustion mode is in the lean drive. The judgement is "YES" and the process shifts to step 220. In step 220, in accordance with the fully closed signal XIDL, it is judged whether or not the idle is off. In the case where the fully closed signal XIDL is "1", the idle is not off, and the DPG temporarily stored in the previous stable mode is DPGO in step 221. This is substituted for the current DPG value to once stop the control routine. If the fully closed signal XIDL is "0", the judgement is "YES" so that the process shifts to step 230.

In step 230, it is judged whether or not the calculation conditions of the torque variation value DLNISMX are established. In this case, if the torque variation value DLNISMX is calculated in another routine, it is deemed that the calculation conditions are established. If the torque variation value DLNISMX is not calculated in that routine, it is deemed that the calculation conditions are not established. Namely, the torque variation value DLNISMX is calculated at every predetermined interval of the engine revolution speed. The control routine is processed immediately after the calculation in the cyclic period. Accordingly, normally, the judgement is "YES" in step 230. Incidentally, in the case where the torque variation value DLNISMX is not calculated as in the case where the Revolution speed variation is remarkable, it is deemed that the calculation conditions are not established. The process shifts to step 300.

Incidentally, the torque is represented by a difference in angular speed between predetermined crank angles. Accordingly, in the embodiment, the difference in torque between zero and 720°CA (in terms of crank angles) in the same cylinder is calculated as the torque variation. Also, in this embodiment, since the engine has four cylinders, the average value of the torque variations of these cylinders is the torque variation value DLNISMX. The torque variation may be detected directly by the torque sensor but it may be substituted by the engine revolution speed or the combustion pressure.

If, in step 230, it is judged that the calculation conditions are established, in step 240, the torque variation value DLNISMX is read in. In the next step 250, it is judged whether or not the torque variation value DLNISMX is equal to or greater than the target torque variation value LVLDLN as the fifth judgement value. If the torque variation value DLNISMX is equal to or greater than the target torque variation value LVLDLN, in step 260, the purge duty renewal amount E is added to the previous value of the finally demanded duty value $DPG_{i-1}$ as the temporarily demanded purge duty value tDPG. The purge duty renewal amount E is obtained by experiments or the like in advance and is stored in the ROM 33.

Subsequently, in step 270, the temporary purge duty value tDPG calculated in the above-described step 260 is set as the finally demanded duty value DPG to finish the control unit.

Also, if, in step 280, the torque variation value DLNISMX is less than the target torque variation value LVLDLN, in step 280, it is judged whether or not the torque variation value DLNISMX is smaller than one obtained by subtracting a predetermined value $\alpha$ from the target torque variation value LVLDLN. If the torque variation value DLNISMX is smaller than one obtained by subtracting the predetermined value $\alpha$ from the target torque variation value LVLDLN, in step 290, the purge duty renewal amount F is subtracted from the previous finally demanded duty value $DPG_{i-1}$. The purge duty renewal amount F is obtained by experiments or the like in advance and is stored in the ROM 33.

Subsequently, in step 270, the temporary purge duty value tDPG calculated in the above-described step 290 is set as the final demanded duty value DPG to finish the control routine.

Also, in step 280, in the case where the torque variation value DLNISMX is equal to or more than a value obtained by subtracting the predetermined value α from the target torque variation value LVLDLN, the process shifts to step 300. In the case where the process shifts from step 230 or step 280 to step 300, the temporarily demanded purge duty value tDPG is the previous value of the finally demanded duty value DPGi-i. Subsequently, the process shifts to step 270, and the temporary demanded purge duty value tDPG obtained in the step 300 is set as the finally demanded duty value DPG to stop the control routine.

Accordingly, ECU 30 duty controls the solenoid valve 81 on the basis of the finally demanded duty value DPG.

The above-described routine corresponds to the steps 10 to 60 and 63 of FIG. 6. The ECU 30 converts the DPG to the FPG in step 61 and calculates the final fuel injection amount QALLINJ in accordance with the above-described formula (1) in the same manner as in step 64 of FIG. 6.

In the "purge control routine" of FIG. 9, if the torque variation value DLNISMX is equal to or more than the target torque variation value LVLDLN, in order to increase the purge amount, the temporarily demanded purge duty value tDPG is obtained by adding the purge duty renewal amount E to the previous value (the finally demanded duty value obtained in the previous control routine) $DPG_{i-1}$. As a result, the purge amount of the fuel vapor is increased to increase the engine revolution speed.

Also, in the "purge control routine" of FIG. 9, if the torque variation value DLNISMX is less than the value obtained by subtracting the predetermined value α from the target torque variation value LVLDLN, in order to decrease the purge amount, the temporarily demanded purge duty value tDPG is obtained by subtracting the purge duty renewal amount F from the previous value (the finally demanded duty value obtained in the previous control routine) $DPG_{i-1}$. As a result, the purge amount of the fuel vapor is decreased to decrease the engine revolution speed.

Furthermore, in the "purge control routine" of FIG. 9, if the torque variation value DLNISMX is less than the target torque variation value LVLDLN and if the torque variation value DLNISMX is equal to or more than the value obtained by subtracting the predetermined value α from the target torque variation value LVLDLN, in step 300, the temporarily demanded purge duty value tDPG is the finally demanded duty value DPG. Then, the temporarily demanded purge duty value tDPG is used as the finally demanded duty value DPG. As a result, in the case where the torque variation value DLNISMX falls within the above-described range, the purge amount of the fuel vapor is deemed to be kept constant.

Figure 10:
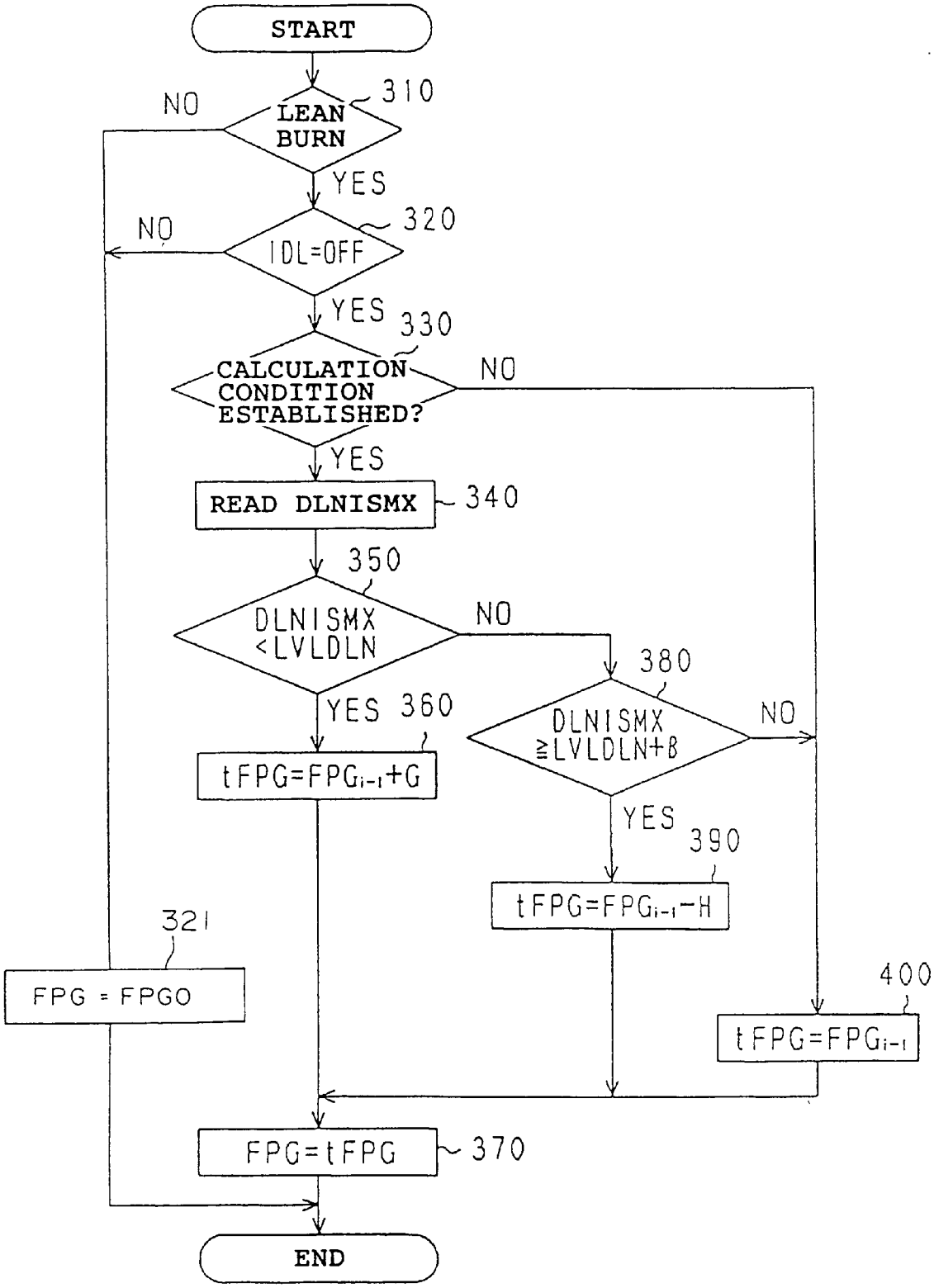
FIG. 10 is a flowchart showing a "fuel injection amount compensation value calculating routine" in an idle-off state executed by the ECU.

Next, FIG. 10 is a flowchart showing a "fuel injection amount compensation value calculating routine" during the travel or drive of the vehicle in the idle-off mode in the embodiment of the invention, and the ECU 30 executes the interrupts at a predetermined time interval. The control in this case is an example of the feature (3) for adjusting the fuel feed amount in response to the output variation in the internal combustion engine with the third compensation means.

When the process shifts to this routine, first of all, ECU 30 judges in step 310 whether or not the current combustion condition is in a less level of the homogenous combustion condition, i.e., the stratified combustion condition, the weak stratified combustion or the homogeneous lean combustion condition or whether or not it is in a level of the homogeneous combustion condition. Namely, it is judged whether the combustion mode FMODE is "0", "1", "2" or "3". In this case, in the case where the combustion mode FMODE is out of "0", "1" and "2", it is judged that the combustion mode is not in the lean drive. Thus, the control routine is once stopped. In the case where, in step 310, the combustion mode FMODE is "0", "1" or "2", it is judged that the combustion mode is in the lean drive. The judgement is "YES" and the process shifts to step 320.

In step 320, in accordance with the fully closed signal XIDL, it is judged whether or not the idle is off. In the case where the fully closed signal XIDL is "1", the idle is not off, and the DPG temporarily stored in the previous stable mode is DPGO in step 321. This is substituted for the current DPG value to once stop the control routine. If the fully closed signal XIDL is "0", the judgement is "YES" so that the process shifts to step 330.

In step 330, it is judged whether or not the calculation conditions of the torque variation value DLNISMX are established. The judgement of step 330 is performed in the same manner as in step 230 of the control routine of FIG. 9.

If, in step 330, it is judged that the calculation conditions are established, in step 340, the torque variation value DLNISMX is read in. In the next step 350, it is judged whether or not the torque variation value DLNISMX is less than the target torque variation value LVLDLN as the sixth judgement value. If the torque variation value DLNISMX is less than the target torque variation value LVLDLN, in step 360, the fuel compensation renewal amount G is added to the previous value of the final fuel vapor amount compensation amount FPGi-l as the temporary fuel vapor amount compensation amount tFPG. The fuel compensation renewal amount G is obtained by experiments or the like in advance and is stored in the ROM 33.

Subsequently, in step 370, the temporary fuel vapor amount compensation amount tFPG calculated in the above-described step 360 is set as the final fuel vapor amount compensation amount FPG to finish the control routine.

Also, if, in step 350, the torque variation value DLNISMX is less than the target torque variation value LVLDLN, in step 380, it is judged whether or not the torque variation value DLNISMX is equal to or greater than one obtained by adding a predetermined value β to the target torque variation value LVLDLN. If the torque variation value DLNISMX is equal to or greater than one obtained by adding the predetermined value β to the target torque variation value LVLDLN, in step 390, the fuel compensation renewal amount H is subtracted from the previous value of the final fuel vapor amount compensation amount $FPG_{i-1}$. The fuel compensation renewal amount H is obtained by experiments or the like in advance and is stored in the ROM 33.

Subsequently, in step 370, the temporary fuel vapor amount compensation amount tFPG calculated in the above-described step 390 is set as the final fuel vapor amount compensation amount FPG to finish the control unit.

Also, in step 280, in the case where the torque variation value DLNISMX is less than a value obtained by adding the predetermined value β to the target torque variation value LVLDLN, the process shifts to step 400. In the case where the process shifts from step 330 or step 380 to step 400, the temporary vapor amount compensation amount tFPG is the previous value of the final fuel vapor amount compensation amount $FPG_{i-1}$. Subsequently, the process shifts to step 370, and the temporary fuel vapor amount compensation amount tFPG obtained in the step 400 is set as the final fuel vapor amount compensation amount FPG to stop the control routine.

The above-described routine corresponds to the steps 10 to 61 and 63 of FIG. 6. The ECU 30 calculates the final fuel injection amount QALLINJ in accordance with the above-described formula (1) in the same manner as in step 64 of FIG. 6.

Then, the ECU 30 executes the injection control of the fuel injection valve 11 in accordance with the final injection amount QALLINJ in which the compensation amount is reflected on the basic fuel injection amount.

In the "the fuel injection amount compensation calculating routine" of FIG. 10, in step 380, if the torque variation value DLNISMX is equal to or more than the value obtained by adding the predetermined value β to the target torque variation value LVLDLN, in step 390, the value obtained by subtracting the fuel compensation renewal amount H from the previous value of the final fuel vapor amount compensation amount $FPG_{i-1}$ is the temporary fuel vapor amount compensation amount tFPG. Then, the temporary fuel vapor amount compensation amount tFPG is used as the final fuel vapor amount compensation amount FPG, and it is subtracted as the parameter for the idle Revolution speed control from the basic fuel injection amount when the calculation of the final fuel injection amount QALLINJ is executed to another routine.

The FPG is smaller than the previous one, and hence the final fuel injection amount QALLINJ is large so that the air/fuel ratio is enriched to suppress the torque variation.

Also, in the step 350 of the "the fuel injection amount compensation calculating routine" of FIG. 10, if the torque variation value DLNISMX is less than the target torque variation value LVLDLN, in step 360, the value obtained by adding the fuel compensation renewal amount G to the previous value of the final fuel vapor amount compensation amount $FPG_{i-1}$ is the temporary fuel vapor amount compensation amount tFPG. Then, the temporary fuel vapor amount compensation amount tFPG is used as the final fuel vapor amount compensation amount FPG, and it is subtracted as the parameter for the idle Revolution speed control when the calculation of the final fuel injection amount QALLINJ is executed in accordance with the formula (1). In this case, the FPG is larger than the previous one. As a result, the combustion is leans. In this case, the since the vapor concentration is high, the purge amount is decreased but the torque variation is not increased.

Furthermore, in the "the fuel injection amount compensation calculating routine" of FIG. 10, if the torque variation value DLNISMX is equal to or more than the target torque variation value LVLDLN and less than the value obtained by subtracting the predetermined value D from the target torque variation value LVLDLN, in step 400, the temporary fuel vapor amount compensation amount tFPG is the previous value of the final fuel vapor amount compensation amount FPG. As a result, in the case where the torque variation value DLNISMX falls within the above-described range, the fuel vapor injection amount compensation amount FPG is deemed to be kept constant.

As described above, in the forms of FIGS. 9 and 10, since the feed-back control is applied to the target torque variation LVLDLN, even if the misfire or surge caused by the purge is generated, it is possible to effectively reduce the amount of fuel, and in addition, since the control is effected so that the torque variation is converged to the target torque variation value, the drivability is well kept to enhance the fuel consumption rate.

Figure 11:
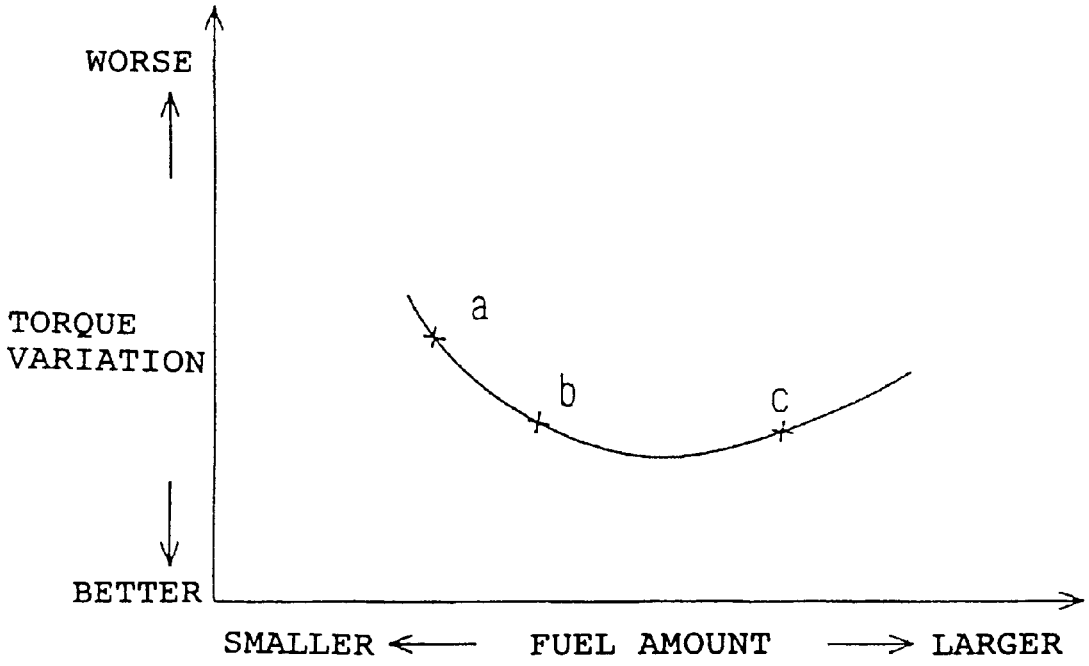
FIG. 11 is a graph showing the characteristics between the torque variation and the fuel amount.

Incidentally, FIG. 11 is a graph showing the characteristics of the torque variation and the fuel amount. In FIG. 11, if the fuel amount is slightly increased, the torque variation is enhanced, and the fuel amount is further increased, the torque variation is worse. Accordingly, in the form of this embodiment, if the target torque variation value LVDLN is set at the optimum condition of the torque variation of FIG. 11, the curve a to b may be obtained. As a result, the fuel compensation is carried out and the control is effected so that the torque variation at c due to the fuel excess may be avoided. It is thus possible to converge the torque variation in a predetermined range about a center of the target torque variation LVLDLN.

<Example where the fuel vapor amount is compensated for the second compensation means in response to the engine revolution speed of the internal combustion engine irrespective of the operational condition>

Figure 12:
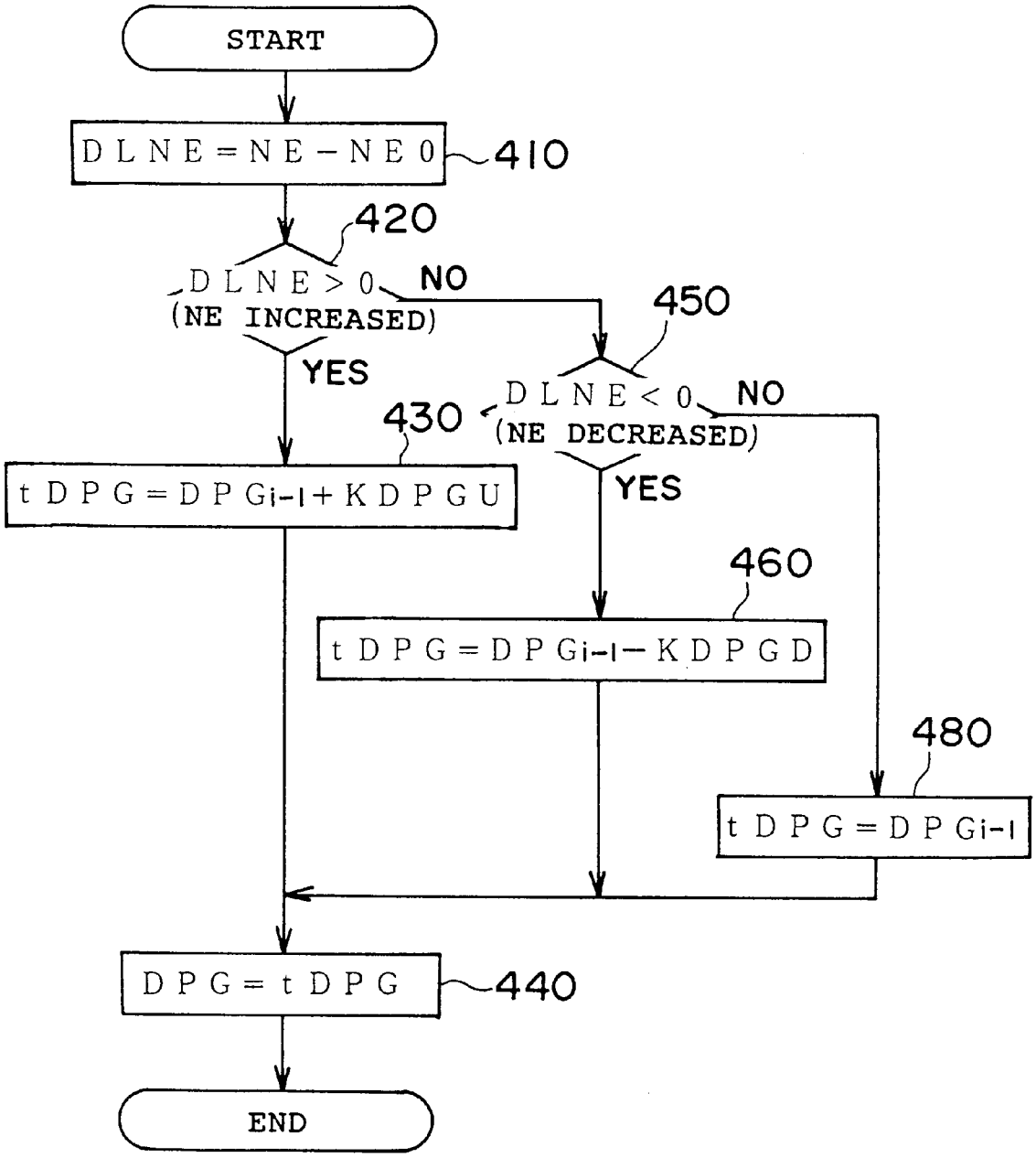
FIG. 12 is a flowchart (1) showing a "DPG and FPG compensation calculating routine" in a combustion mode switch.

FIG. 12 shows a "purge control routine" for controlling the purge with the second compensation means only with reference to the engine revolution speed while using the feature of (2). Also, this routine is executed at every predetermined time interval by-the EUC 30.

When the process shifts to this routine, first of all, in step 410, the deviation DLNE between the engine revolution speed a NEO in the execution of the previous routine and the current engine revolution speed NE. Subsequently, in step 420, it is judged whether or not the deviation DLNE is greater than zero. In step 420, when it is judged that the deviation DLNE is greater than zero, the engine revolution speed is liable to be increased. The process shifts to step 430. The temporarily demanded purge duty value tDPG is obtained by adding the purge duty renewal amount KDPGU to the previous value (the finally demanded value obtained by the previous control routine) $DPG_{i-1}$. This purge duty renewal amount KDPGU is obtained by experiments or the like in advance and is stored in the ROM 33. Next, in step 440, the temporarily purge duty value tDPG calculated by the above-described step 430 is set as the finally demanded duty value DPG to stop the control routine.

Also, unless the deviation DLNE is greater than zero in the above-described step 420, the process shifts to step 450 and it is judged whether or not the deviation DLNE is smaller than zero. If, in step 450, the deviation DLNE is smaller than zero, the process shifts to step 460. The temporarily demanded purge duty value tDPG is obtained by subtracting the purge duty renewal amount KDPGD from the previous value (the finally demanded value obtained by the previous control routine) $DPG_{i-1}$. This purge duty renewal amount KDPGD is obtained by experiments in advance and is stored in the ROM 33.

Subsequently, in step 440, the temporarily demanded purge duty value tDPG calculated in the above-described step 460 is set as the finally demanded duty value DPG to stop the control routine.

In step 450, in the case where it is not judged that the deviation DLNE is smaller than zero, the deviation DLNE is zero. It is judged that no variation occurs in the engine revolution speed. In this case, the process shifts to step 480, and the temporarily demanded purge duty value tDPG takes the same value as the previous value (the final duty value obtained by the previous control routine) $DPG_{i-1}$.

In step 440, the temporarily demanded purge duty value tDPG calculated in the above-described step 480 is set as the finally demanded duty value DPG to complete the control routine.

Accordingly, ECU 30 duty controls the solenoid valve 81 on the basis of the finally demanded duty value DPG.

The above-described routine corresponds to the steps 10 to 61 and 63 of FIG. 6. The ECU 30 converts the DPG to the FPG in step 61 and calculates the final fuel injection amount QALLINJ in accordance with the above-described formula (1) in the same manner as in step 64 of FIG. 6.

In the sleeve interior injection type internal combustion engine which is operated under the condition of the substantially fully opened throttle valve in many cases, since the intake air amount, i.e., the vacuum pressure is kept constant, if the purge amount is to be controlled in response to at least one value of the intake pipe vacuum pressure, the load (air amount/engine revolution speed) the air intake amount, in the case where the same purge amount is executed for the low Revolution speed stratified combustion and the high Revolution speed homogeneous combustion, the combustion would be unstable on the low Revolution speed side or the misfire would occur. In this example, without depending the intake vacuum pressure, only the engine revolution speed is utilized as the control parameter, and the purge amount is controlled in response to the engine revolution speed. It is therefore possible to obtain the stable combustion.

<Control upon a combustion mode switching operation by the fourth compensation means>

Next, FIGS. 13 to 18 are flowcharts showing a "DPG and FPG compensation calculating routine" upon a combustion mode switching operation in the form of the embodiment, and the ECU 30 executes interrupts at every predetermined interval.

<Control upon a mode switching operation from the previous homogeneous lean combustion>

Figure 13:
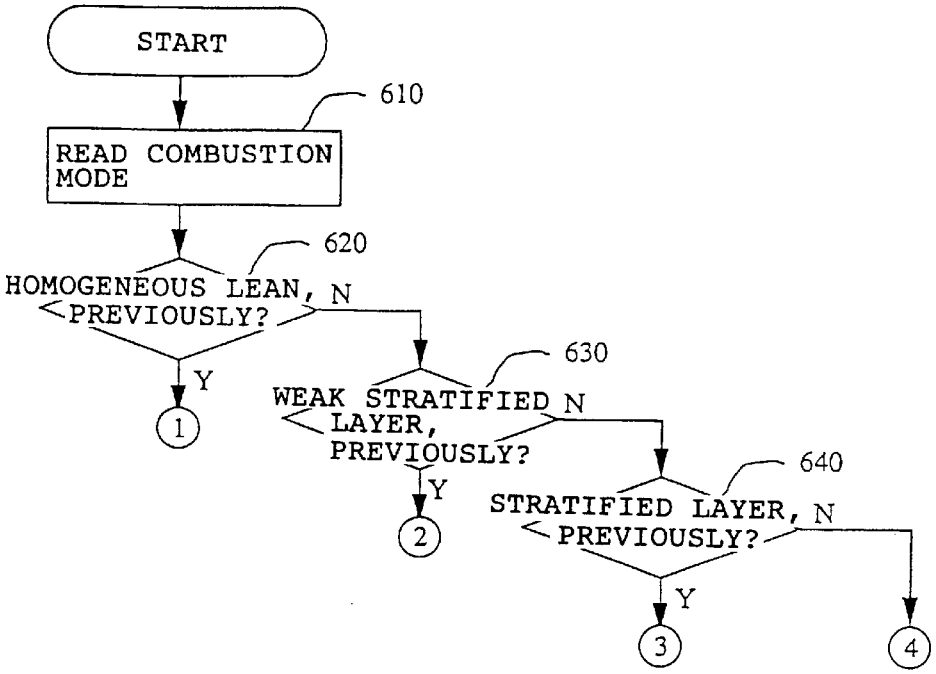
FIG. 13 is a flowchart (2) showing a "DPG an d FPG compensation calculating routine" in the combustion mode switch.
Figure 14:
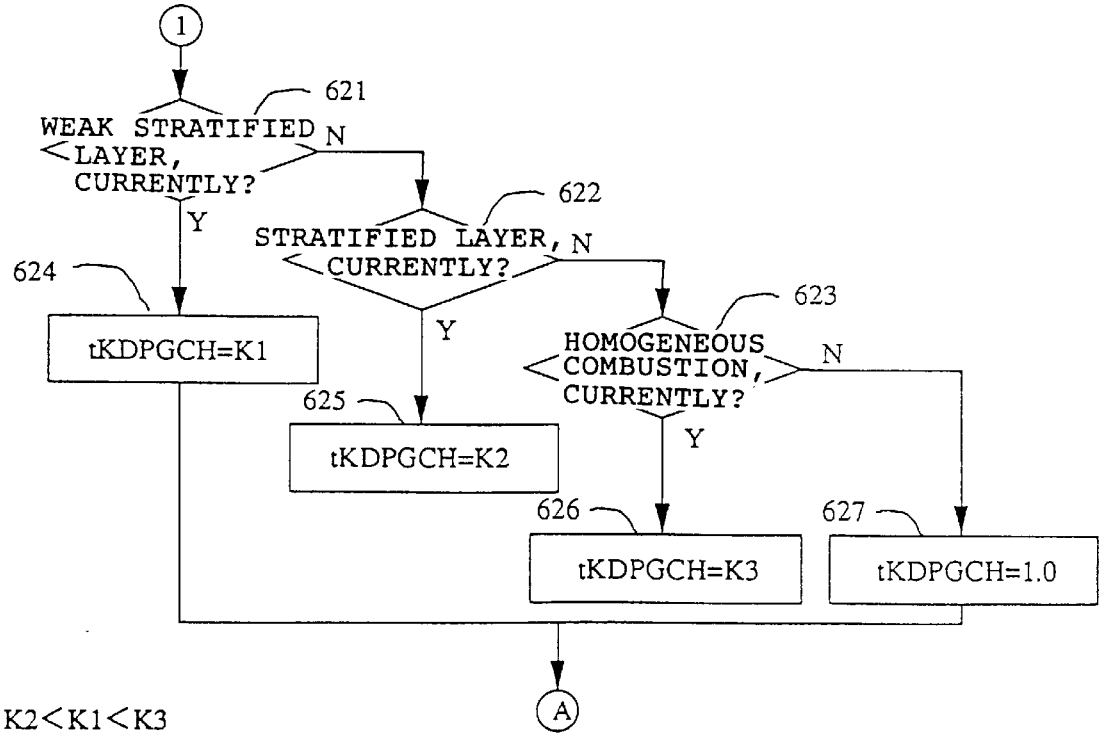
FIG. 14 is a flowchart (3) showing a "DPG and FPG compensation calculating routine" in the combustion mode switch.
Figure 15:
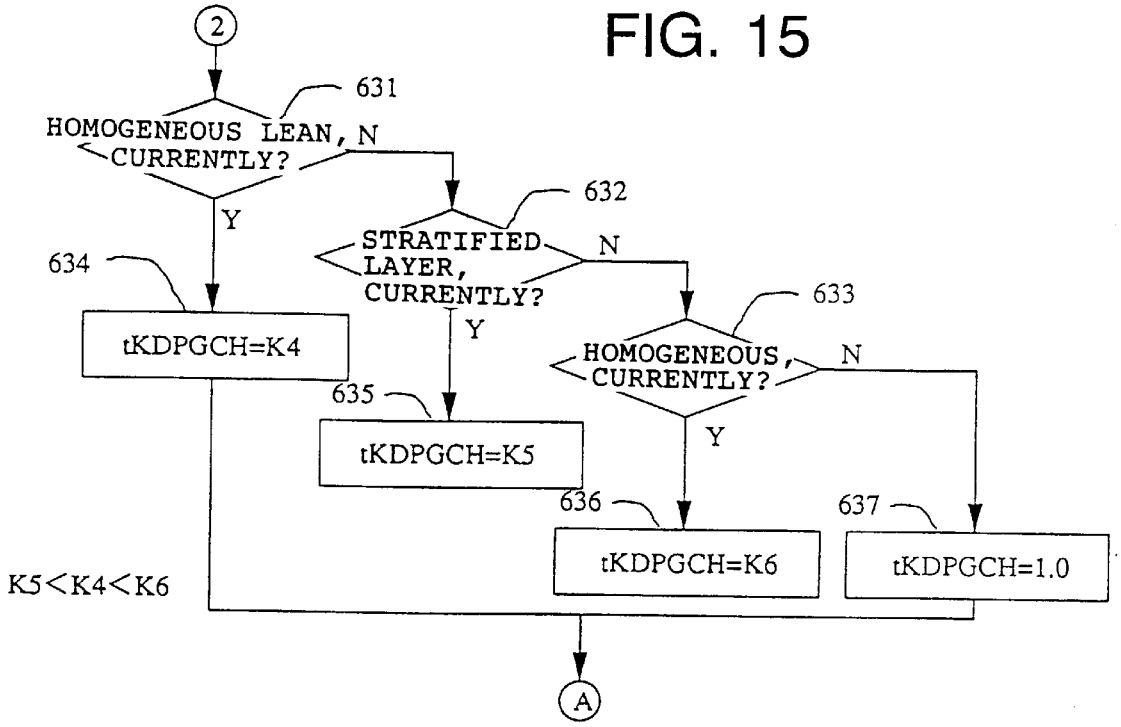
FIG. 15 is a flowchart (4) showing a "DPG and FPG compensation calculating routine" in the combustion mode switch.
Figure 16:
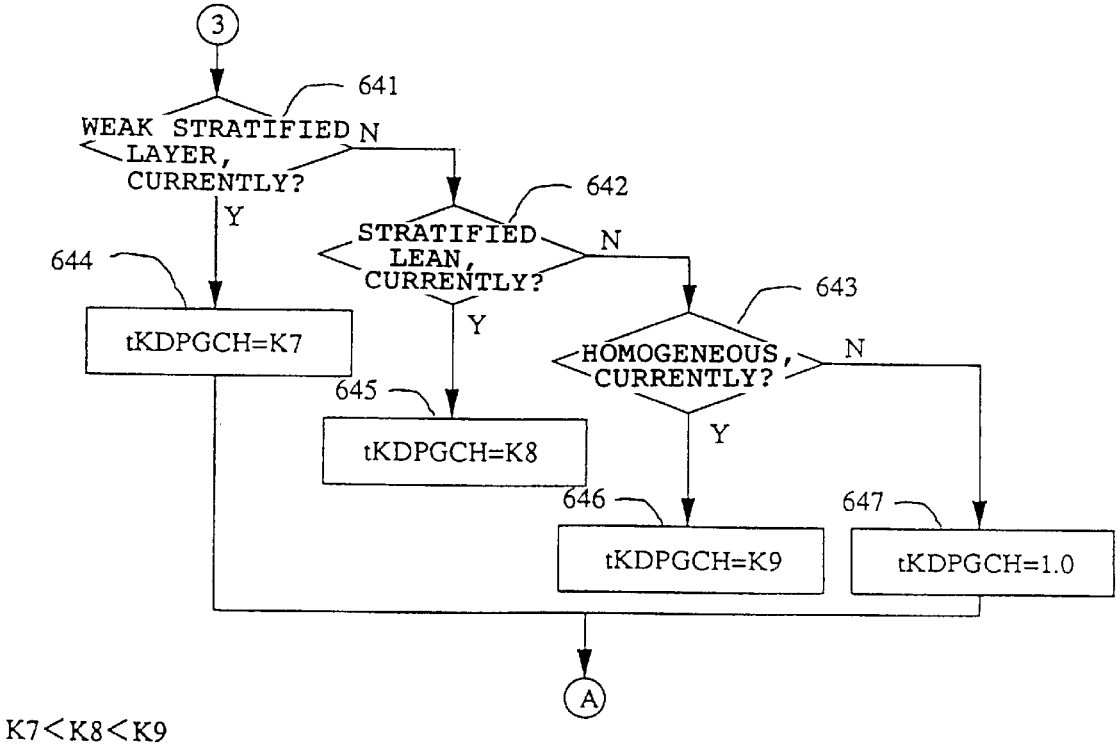
FIG. 16 is a flowchart (5) showing a "DPG and FPG compensation calculating routine" in the combustion mode switch.

When the process shifts to this routine, in step 610 shown in FIG. 13, the current operational mode (combustion mode) and the operational mode (combustion mode) upon the previous control are read in, and in step 620, it is judged whether or not the previous combustion mode FMODE is "2" (homogenous lean combustion). In this step 620, in the case where the combustion mode FMODE is "2", the process shifts to step 621 shown in FIG. 14.

In the case where, in step 621, the current combustion mode FMODE is "1" (weak stratified combustion), the process shifts to step 624, and K1 is set to a compensation coefficient tKDPGCH. This coefficient K1 (<1.0) is a non-dimensional number. The coefficient K1 is determined in advance through experiments or the like so that when the combustion is changed from the previous combustion mode FMODE (homogeneous lean combustion) to the current combustion mode FMODE (weak stratified combustion), the purge amount of the fuel vapor and the fuel injection amount are at optimum, i.e., at values at which the combustion is not worse upon the mode switching operation. The coefficient K1 is stored in the ROM 33. After that, the process shifts to step 660 of FIG. 18.

In the case where, in the above-described step 621, the current combustion mode FMODE is not "1" (weak stratified combustion), the process shifts to step 622. In step 622, it is judged whether or not the current combustion mode FMODE is "0" (stratified combustion). In the same step 622, the current combustion mode FMODE is not "0" (stratified combustion), the process shifts to step 623. In step 623, it is judged whether or not the current combustion mode FMODE is "3" (homogeneous combustion). If the current mode is not "3", it is judged that the combustion mode FMODE is not changed. The process shifts to 627. 1.0 is set as the compensation coefficient tKDPGCH. The coefficient of 1.0 is stored in advance. After that, the process shifts to step 660 of FIG. 18.

Also, in the case where, in the above-described step 622, the current combustion mode FMODE is "0" (stratified combustion), the process shifts to step 625. K2 (1.0) is set as the compensation coefficient tKDPGCH. The coefficient K2 (K2<K1) is a non-dimensional value and determined in advance through experiments or the like so that when the combustion is changed from the previous combustion mode FMODE (homogeneous lean combustion) to the current combustion mode FMODE (stratified combustion), the purge amount of the fuel vapor and the fuel injection amount are at optimum, i.e., at values at which the combustion is not worse upon the mode switching operation. The coefficient K2 is stored in the ROM 33. After that, the process shifts to step 660 of FIG. 18.

In the case where, in the above-described step 623, it is judged that the current combustion mode FMODE is "3" (homogeneous combustion). K3 (<1.0) is set as the compensation coefficient tKDPGCH. The coefficient K3 (K2<K1<K3) is a non-dimensional value and determined in advance through experiments or the like so that when the combustion is changed from the previous combustion mode FMODE (homogeneous lean combustion) to the current combustion mode FMODE (homogenous combustion), the purge amount of the fuel vapor and the fuel injection amount are at optimum, i.e., at values at which the combustion is not worse upon the mode switching operation. The coefficient K3 is stored in the ROM 33. After that, the process shifts to step 660 of FIG. 18.

<Control upon a mode switching operation from the previous weak stratified combustion>

In step 620 shown in FIG. 13, in the case where the previous combustion FMODE is not "2" (homogeneous lean combustion), the process shifts to step 630 and it is judged whether or not the previous combustion mode FMODE is "1" (weak stratified combustion). In the case where the previous combustion FMODE is "1", the process shifts to step 631 and it is judged whether or not the current combustion mode FMODE is "2" (homogeneous lean combustion).

In the case where the previous combustion FMODE is "2" (homogeneous lean combustion), the process shifts to step 634.

In step 634, K4 is set to the compensation coefficient tKDPGCH. This coefficient K4 (<1.0) is a non-dimensional number. The coefficient K4 is determined in advance through experiments or the like so that when the combustion is changed from the previous combustion mode FMODE (weak stratified combustion) to the current combustion mode FMODE (homogeneous lean combustion), the purge amount of the fuel vapor and the fuel injection amount are at optimum, i.e., at values at which the combustion is not worse upon the mode switching operation. The coefficient K4 is stored in the ROM 33. After that, the process shifts to step 660 of FIG. 18.

In the case where, in the above-described step 631, the current combustion mode FMODE is not "2" (homogenous lean combustion), the process shifts to step 632. In step 632, it is judged whether or not the current combustion mode FMODE is "0" (stratified combustion). In the same step 632, the current combustion mode FMODE is not "0" (stratified combustion), the process shifts to step 633. In step 633, it is judged whether or not the current combustion mode FMODE is "3" (homogeneous combustion). If the current mode is not "3", it is judged that the combustion mode FMODE is not changed. The process shifts to 637. 1.0 is set as the compensation coefficient tKDPGCH. The coefficient of 1.0 is stored in the ROM 33 in advance. After that, the process shifts to step 660 of FIG. 18.

Also, in the case where, in the above-described step 632, the current combustion mode FMODE is "0" (stratified combustion), the process shifts to step 635. K5 (<1.0) is set as the compensation coefficient tKDPGCH. The coefficient K5 (<1.0, K4>K5) is a non-dimensional value and determined in advance through experiments or the like so that when the combustion is changed from the previous combustion mode FMODE (homogeneous lean combustion) to the current combustion mode FMODE (stratified combustion), the purge amount of the fuel vapor and the fuel injection amount are at optimum, i.e., at values at which the combustion is not worse upon the mode switching operation. The coefficient K5 is stored in the ROM 33. After that, the process shifts to step 660 of FIG. 18.

In the case where, in the above-described step 633, it is judged that the current combustion mode FMODE is "3" (homogeneous combustion), K6 (<1.0) is set as the compensation coefficient tKDPGCH. The coefficient K6 (<1.0, K5<K4<K6) is a non-dimensional value and determined in advance through experiments or the like so that when the combustion is changed from the previous combustion mode FMODE (homogeneous lean combustion) to the current combustion mode FMODE (homogenous combustion), the purge amount of the fuel vapor and the fuel injection amount are at optimum, i.e., at values at which the combustion is not worse upon the mode switching operation. The coefficient K6 is stored in the ROM 33. After that, the process shifts to step 660 of FIG. 18.

<Control upon a mode switching operation from the previous stratified combustion>

In step 630 shown in FIG. 13, in the case where the previous combustion FMODE is not "1" (weak stratified combustion), the process shifts to step 640 and it is judged whether or not the previous combustion mode FMODE is "0" (stratified combustion). In the case where the previous combustion FMODE is "0", the process shifts to step 641 and it is judged whether or not the current combustion mode FMODE is "1" (stratified combustion).

In the case where the previous combustion FMODE is "1" (stratified combustion), the process shifts to step 644.

In step 644, K7 is set to the compensation coefficient tKDPGCH. This coefficient K7 (<1.0) is a non-dimensional number. The coefficient K7 is determined in advance through experiments or the like so that when the combustion is changed from the previous combustion mode FMODE (stratified combustion) to the current combustion mode FMODE (weak stratified combustion), the purge amount of the fuel vapor and the fuel injection amount are at optimum, i.e., at values at which the combustion is not worse upon the mode switching operation. The coefficient K7 is stored in the ROM 33. After that, the process shifts to step 660 of FIG. 18.

In the case where, in the above-described step 641, the current combustion mode FMODE is not "1" (weak stratified combustion), the process shifts to step 642. In step 642, it is judged whether or not the current combustion mode FMODE is "2" (weak homogeneous combustion). In the same step 642, the current combustion mode FMODE is not "2" (homogeneous lean combustion), the process shifts to step 643. In step 643, it is judged whether or not the current combustion mode FMODE is "3" (homogeneous combustion). If the current mode is not "3", it is judged that the combustion mode FMODE is not changed. The process shifts to step 647. 1.0 is set as the compensation coefficient tKDPGCH. The coefficient of 1.0 is stored in the ROM 33 in advance. After that, the process shifts to step 660 of FIG. 18.

Also, in the case where, in the above-described step 642, the current combustion mode FMODE is "2" (homogeneous lean combustion), the process shifts to step 645. K8 (<1.0) is set as the compensation coefficient tKDPGCH. The coefficient K8 (K7<K8) is a non-dimensional value and determined in advance through experiments or the like so that when the combustion is changed from the previous combustion mode FMODE (stratified combustion) to the current combustion mode FMODE (homogenous lean combustion), the purge amount of the fuel vapor and the fuel injection amount are at optimum, i.e., at values at which the combustion is not worse upon the mode switching operation. The coefficient K8 is stored in the ROM 33. After that, the process shifts to step 660 of FIG. 18.

In the case where, in the above-described step 643, it is judged that the current combustion mode FMODE is "3" (homogeneous combustion). K9 (<1.0) is set as the compensation coefficient tKDPGCH. The coefficient K9 (K7<K8<K9) is a non-dimensional value and determined in advance through experiments or the like so that when the combustion is changed from the previous combustion mode FMODE (stratified combustion) to the current combustion mode FMODE (homogeneous combustion), the purge amount of the fuel vapor and the fuel injection amount are at optimum, i.e., at values at which the combustion is not worse upon the mode switching operation. The coefficient K9 is stored in the ROM 33. After that, the process shifts to step 660 of FIG. 18.

<Control upon a mode switching operation from the previous homogeneous combustion>

Figure 17:
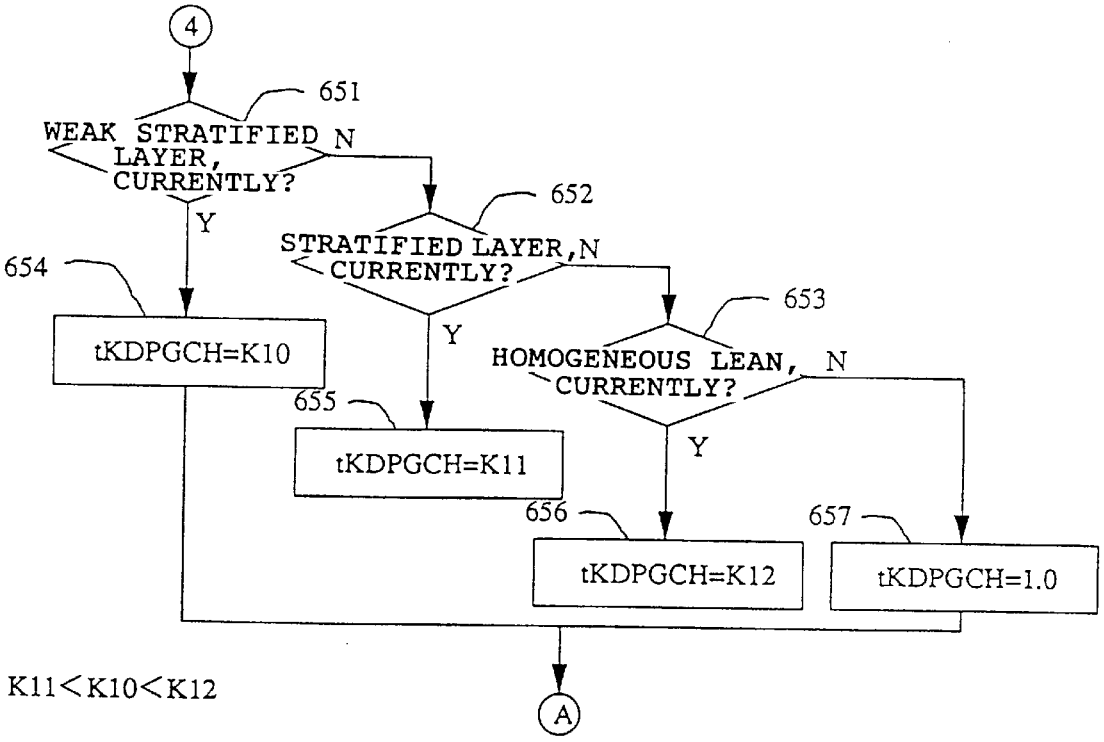
FIG. 17 is a flowchart (6) showing a "DPG and FPG compensation calculating routine" in the combustion mode switch.
Figure 18:
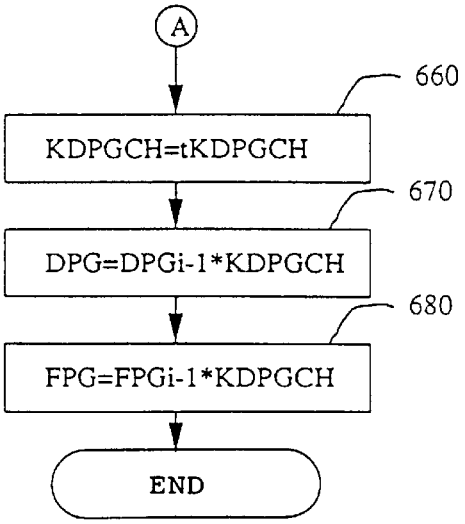
FIG. 18 is a flowchart (7) showing a "DPG and FPG compensation calculating routine" in the combustion mode switch.

In step 640 shown in FIG. 13, in the case where the previous combustion FMODE is not "3" (stratified combustion), the process shifts to step 651 of FIG. 17 and it is judged whether or not the previous combustion mode FMODE is "1" (weak stratified combustion). In the case where the previous combustion FMODE is "1" (weak stratified combustion), the process shifts to step 654.

In step 654, K10 is set to the compensation coefficient tKDPGCH. This coefficient K10 (<1.0) is a non-dimensional number. The coefficient K10 is determined in advance through experiments or the like so that when the combustion is changed from the previous combustion mode FMODE (homogeneous combustion) to the current combustion mode FMODE (weak stratified combustion), the purge amount of the fuel vapor and the fuel injection amount are at optimum, i.e., at values at which the combustion is not worse upon the mode switching operation. The coefficient K10 is stored in the ROM 33. After that, the process shifts to step 660 of FIG. 18.

In the case where, in the above-described step 651, the current combustion mode FMODE is not "1" (weak stratified combustion), the process shifts to step 652. In step 652, it is judged whether or not the current combustion mode FMODE is "0" (stratified combustion). In the same step 652, the current combustion mode FMODE is not "0" (stratified combustion), the process shifts to step 653. In step 653, it is judged whether or not the current combustion mode FMODE is "2" (homogeneous lean combustion). If the current mode is not "2", it is judged that the combustion mode FMODE is not changed. The process shifts to 657. 1.0 is set as the compensation coefficient tKDPGCH. The coefficient of 1.0 is stored in the ROM 33 in advance. After that, the process shifts to step 660 of FIG. 18.

Also, in the case where, in the above-described step 652, the current combustion mode FMODE is "0" (stratified combustion), the process shifts to step 655. K11 (<1.0) is set as the compensation coefficient tKDPGCH. The coefficient K11 (K11<K10) is a non-dimensional value and determined in advance through experiments or the like so that when the combustion is changed from the previous combustion mode FMODE (homogeneous combustion) to the current combustion mode FMODE (stratified combustion), the purge amount of the fuel vapor and the fuel injection amount are at optimum, i.e., at values at which the combustion is not worse upon the mode switching operation. The coefficient K10 is stored in the ROM 33. After that, the process shifts to step 660 of FIG. 18.

In the case where, in the above-described step 653, it is judged that the current combustion mode FMODE is "2" (homogeneous lean combustion). K12 (<1.0) is set as the compensation coefficient tKDPGCH. The coefficient K12 (K11<K10<K12) is a non-dimensional value and determined in advance through experiments or the like so that when the combustion is changed from the previous combustion mode FMODE (homogeneous combustion) to the current combustion mode FMODE (homogeneous lean combustion), the purge amount of the fuel vapor and the fuel injection amount are at optimum, i.e., at values at which the combustion is not worse upon the mode switching operation. The coefficient K12 is stored in the ROM 33. After that, the process shifts to step 660 of FIG. 18.

When the process shifts from the above-described respective steps to the step 660, in step 660, the compensation coefficient tKDPGCH set in each step is set as the final compensation coefficient DDPGCH. In the next step 670, the values obtained by multiplying the finally demanded duty value $DPG_{i-1}$, calculated at the previous control cycle, by the final compensation coefficient KDPGCH is used as the finally demanded duty value DPG. In the next step 680, the value obtained by multiplying the final fuel vapor amount compensation amount FPGI1, calculated at the previous control cycle, by the final compensation coefficient KDPGCH is used as the final fuel vapor amount compensation amount FPG to thereby complete the calculation routine.

Accordingly, the ECU 30 performs the injection control of the fuel injection valve 11 as well as controls the solenoid valve 81 on the basis of the final fuel vapor amount compensation amount FPG and the finally demanded duty value DPG calculated by the "DPG and FPG compensation calculation routine" upon the combustion mode switching mode.

Thus, in accordance with the switching operation of combustion conditions, the □apor fuel amount is compensated for, the purge control □al□e is controlled and the fuel injection amount is controlled so that it is possible to maintain the optimum combustion in response to the combustion condition. It can be said that as described in (4-4), the system is pro□ided with the fuel feed amount controlling means for adjusting the fuel feed amount in response to the switching mode upon the combustion condition switching operation of the internal combustion engine.

<Control in response to the concentration of the fuel vapor>

A relationship between the above-described respective compensation coefficients and the vapor concentration will now be described. This is an example of the control such as purge control valve or the like by the fifth compensation means while utilizing the feature of (5-1).

FIG. 19 shows the relationship between the above-described respective compensation coefficients (K1 to K12) and the vapor concentration. In FIG. 19, the relationships, C1 (lower concentration)<C2<C3 . . . (high concentration), and K', K", $K^{(3)}$, $K^{(4)}$, . . . , are established.

The relationship shown in FIG. 19 is stored in advance in the form of a map in the ROM. The fifth compensation means calculates the compensation coefficient, corresponding to the vapor concentration detected by the concentration detecting means, from the correspondence relationship of the ROM to thereby obtain the optimum compensation coefficient. Incidentally, for example, an HC sensor (hydrocarbon sensor) provided in the intake pipe or in the purge passage may be used as the concentration detecting means but it is possible to reversely calculate the fuel concentration from the oxygen concentration by detecting the concentration of the oxygen contained in the purge gas with a oxygen sensor.

In FIGS. 13 to 18, the compensation coefficients are delicately changed from K1 to K12 in association with the mode switching operations, whereby the optimum fuel vapor amount feed may be effected to prevent the degradation of the combustion in addition to the maintenance of the sufficient amount of the purge.

Namely, in the "DPG and FPG compensation calculation routine" of the combustion mode switching operation of FIGS. 13 to 18, when the combustion mode is changed, the compensation coefficient is selected in accordance with the condition in which the combustion modes FMODE are switched. Since the selected compensation coefficient is at the optimum so that the combustion is not unstable upon the mode switching operation, the solenoid valve 81 and the fuel injection valve 11 are controlled so that both the purge amount and the fuel injection amount are at optimum values. As a result, upon the combustion mode switching operation, it is possible to avoid the worse combustion. Incidentally, the present invention is not limited to the above-described embodiment but may be applied as follows.

(A) In the "DPG and FPG compensation calculation routine" of the combustion mode switching operation of FIG. 13 in the form of the foregoing embodiment, the compensation coefficients K1 and K2 are the values obtained by the experiments in advance but may be calculated by the ratio of the fuel injection amount in the previous combustion mode to the fuel injection amount in the current combustion mode.

(B) The present invention is embodied to the sleeve interior injection type engine 1 in the foregoing embodiment but may be embodied to a type in which a general stratified combustion or weak stratified combustion is performed. For example, the present invention may be applied to a type in which the fuel is injected to a bottom side of each of the intake valves 6*a* and 6*b* of the intake ports 7*a* and 7*b*. Although the fuel injection valve is provided on the side of the intake valves 6*a* and 6*b* it is possible to apply the invention to the arrangement in which the fuel is injected directly to the interior of the cylinder bore (combustion chamber 5). Furthermore, the invention may be applied to an engine that may effect the lean combustion with the SCV 17.

Accordingly, in this specification, the lean combustion means to include these variations. (C) In the foregoing embodiment, the invention is embodied to the gasoline engine 1 as the internal combustion engine, it is possible to apply the invention to a diesel engine or the like.

In the foregoing embodiment, when the fuel vapor amount is compensated for by the fourth compensation means, a judgement means for judging the switching timing of the combustion conditions of the internal combustion engine, the fuel vapor amount is compensated for by the fourth compensation means on the basis of the same judgement means. In this case, the ECU 30 constitutes the judgement means, and the steps 420, 430, 480, 510 and 520 correspond to the judgement means. The combustion condition switching timing is judged by the judgement means.

<Control by Control Delay Means (4-1)>

Figure 20:
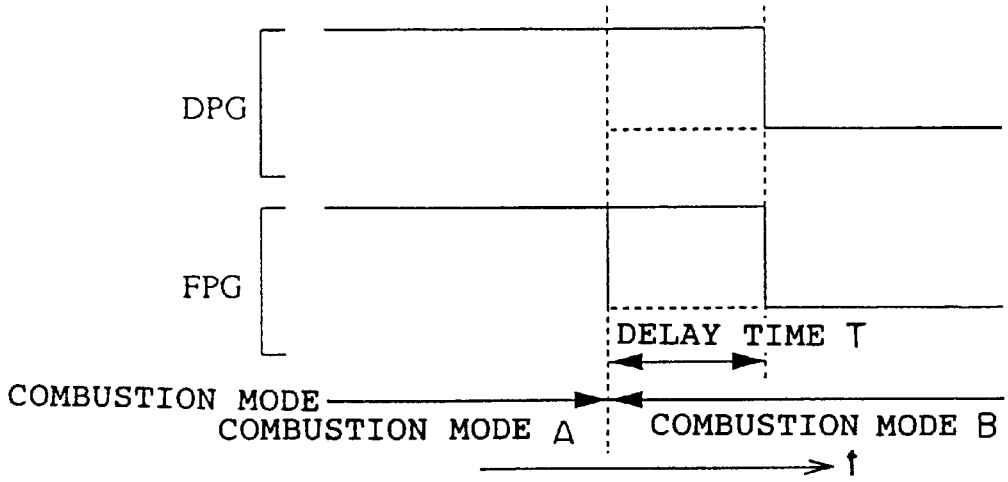
FIG. 20 is a timing chart showing a delay control by a control delay means upon switching the mode.

By the way, when the combustion modes are switched, it is possible to delay, by the control delay means, the time until the opening degree change of the purge control valve or the fuel injection condition change is started in the switching operation of the combustion conditions. More specifically, as shown in FIG. 20, when the combustion is changed from the combustion mode A to the combustion mode B, it is preferable to change the modes, i.e., DPGs and FPGs after the predetermined delay period has lapsed. This is because to prevent a so-called hunching moving from the mode A to B and B to A in a short period of time. This control delay means is realized by the program on the CPU.

Incidentally, the predetermined delay time may be varied by the flow rate of the intake air, the Revolution speed or the like.

<Control by Control Delay Means (4-2) and (4-3)>

Figure 21:
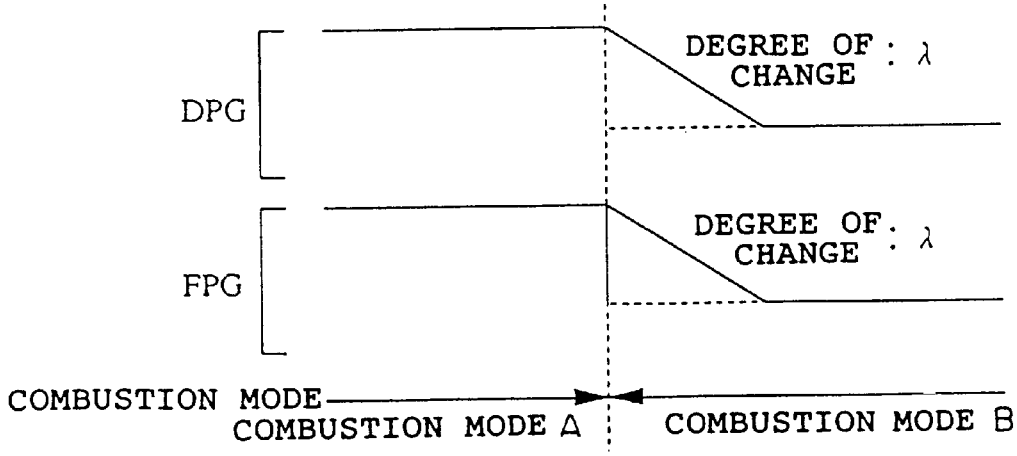
FIG. 21 is a timing chart showing a condition in which the change caused by the delay control shown in FIG. 20 is made gentle.

When the opening degree changing rate of the purge control valve or the fuel injection condition changing rate is gradually changed with the change rates λ from the previous DPG to the current DPG in response to the combustion condition upon the combustion mode switching operation by a changing rate controlling means as shown in FIG. 21, it is possible to obtain the stable combustion during the shift.

Furthermore, the changing rates shown in FIG. 21 are made different from the mode of the combustion switching according to the feature of (4-3). The changing rates λ are shown in FIG. 22 between the combustion modes.

Figure 22:
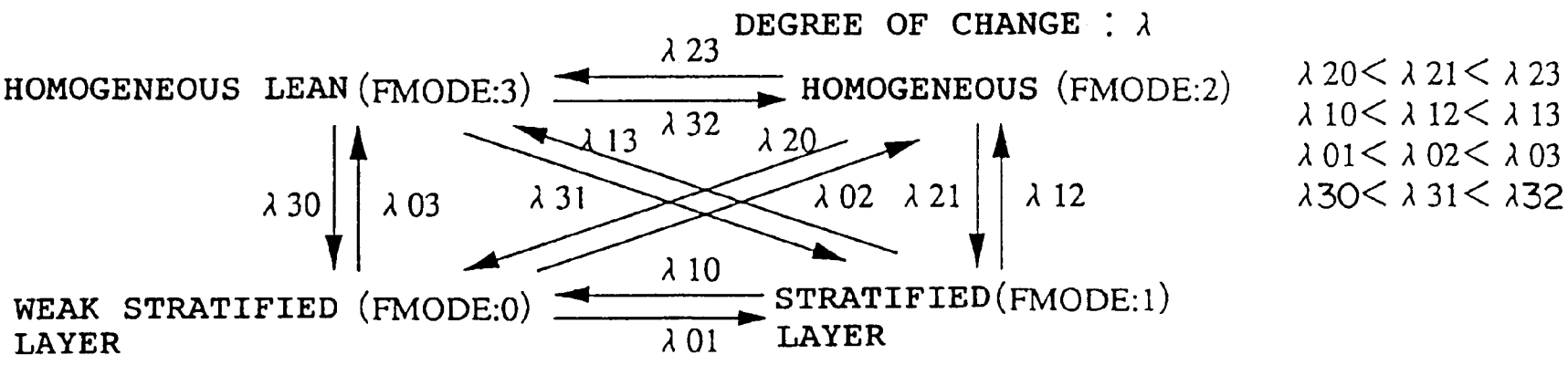
FIG. 22 is a concept view showing the change of the degree of change of the delay control caused by the switch pattern.

From FIG. 22, it is understood that the change is gradual toward the lean combustion, and the change is remarkable when the change is close to the homogeneous state. Since the homogeneous combustion is stable, there is no problem even if the change is remarkable toward the homogenous combustion. In case of the lean combustion, the combustion is likely to be unstable. Accordingly, the change is gradual so that the unstable combustion in concomitant with the remarkable change may be avoided.

<Example for the fuel vapor amount in response to the engine revolution speed>

The form of the embodiment as to the feature (2) for compensating the fuel vapor amount in response to the engine revolution speed will now be described with reference to FIG. 23.

First of all, the engine revolution speed NE and the accelerator opening degree ACA are inputted (step 681). Subsequently, the basic fuel injection amount QALL is calculated in accordance with the inputted engine revolution speed and accelerator opening degree (step 682).

Namely, first of all, the basic fuel injection amount corresponding to the engine revolution speed and the accelerator opening degree is complementarily calculated from a map (not shown) for determining the mutual relationship between the engine revolution speed and the accelerator opening degree.

In step 683, it is judged whether or not the purge is effected. If it is in the purge, the throttle valve opening degree TA and the engine revolution speed NE are read in (step 684).

Next, the fuel vapor amount compensation amount (FPG) is calculated (step 685). This calculation is effected from the mutual relationship between the fuel vapor amount compensation amount (FPG) and the throttle valve opening degree TA and the engine revolution speed NE stored in the ROM in a form of map in advance. Incidentally, in FIG. 24, HIGH, INTERMEDIATE and LOW are drawn to the engine revolution speeds. The smaller the engine revolution speed, the more the fuel vapor amount compensation amount will become.

In the case where, in step 683, the operation is out of the purge, in step 687, the fuel vapor amount compensation amount is zero.

After the fuel vapor amount compensation amount FPG is determined in steps 685 and 687, the process shifts to step 686 to determine the final fuel injection amount QALLINJ. In this case, the final fuel injection amount QALLINJ is determined by subtracting the fuel vapor amount compensation amount FPG from the basic fuel injection amount QALL calculated in advance in step 682.

Thereafter the fuel injection is effected in accordance with the fuel injection program determined separately.

Figure 25:
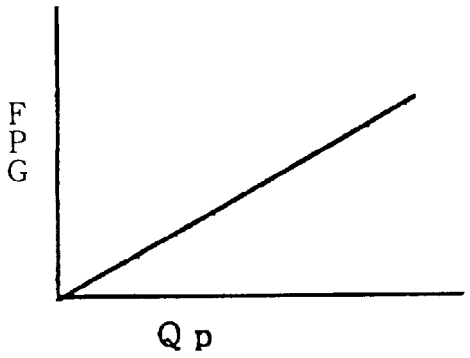
FIG. 25 is a map for determining a relationship between the fuel vapor amount compensation amount FPG and the purge gas amount Qp.
Figure 26:
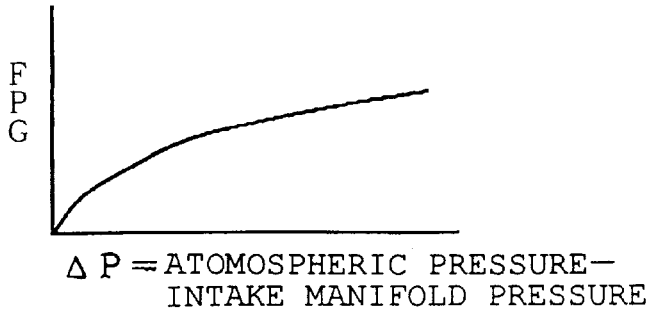
FIG. 26 is a map for determining a relationship between the fuel vapor amount compensation amount FPG and the difference between the atmospheric pressure and the intake manifold pressure.

Incidentally, other calculation methods of the fuel vapor amount compensation amount (FPG) are typically exemplified as a method for obtaining it from the purge gas amount Qp as shown in FIG. 25 and a method for obtaining it from the intake manifold pressure as shown in FIG. 26.

Figure 23:
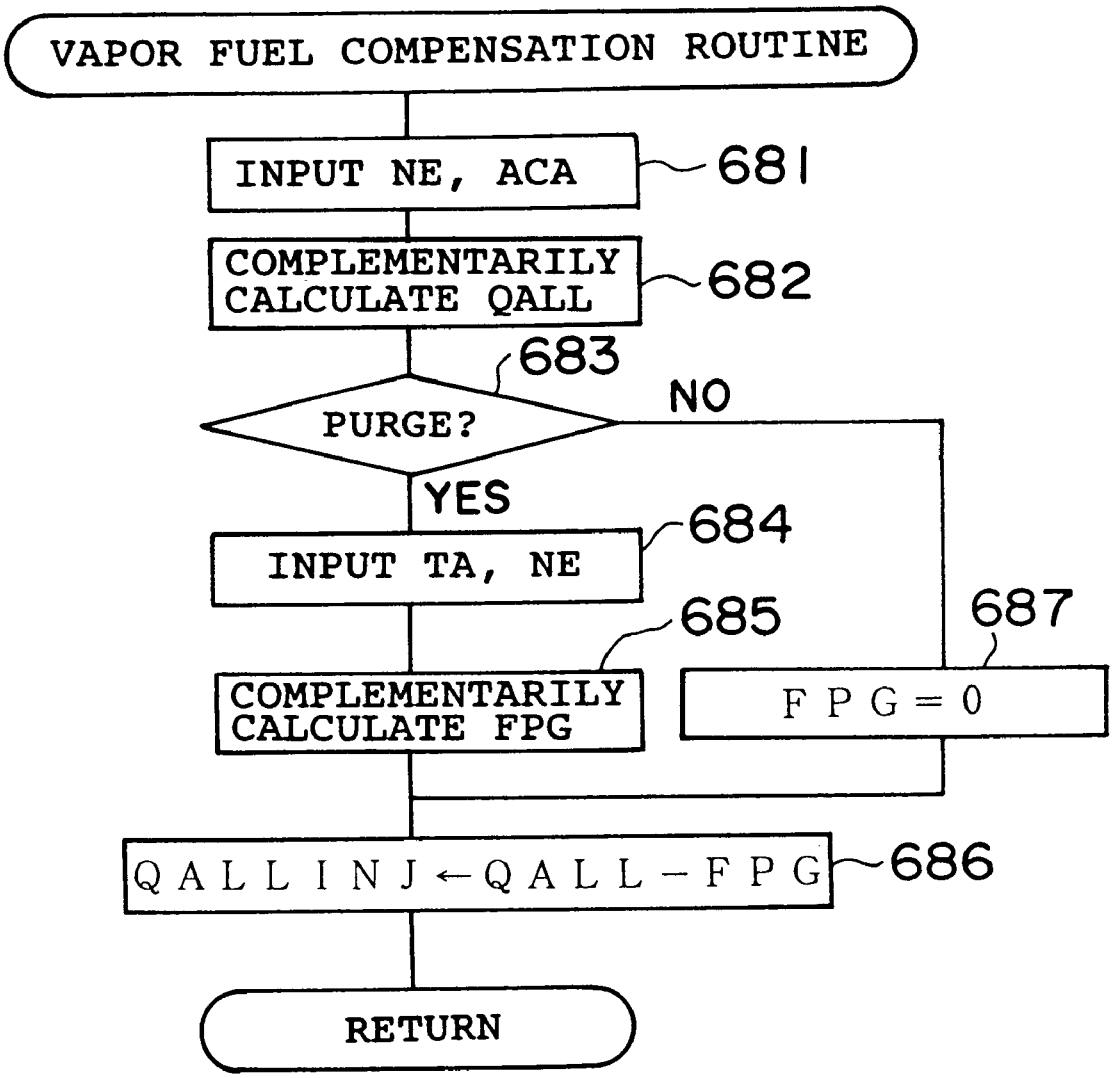
FIG. 23 is a flowchart showing a compensation control example of a fuel vapor amount.
Figure 24:
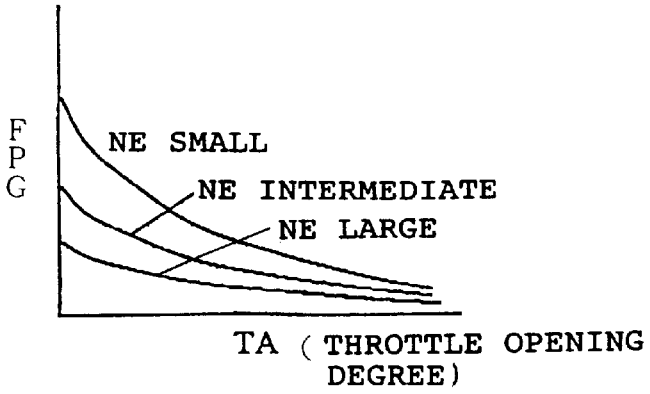
FIG. 24 is a map for determining a relative relation among a throttle valve opening degree TA, a fuel vapor amount compensation amount FPG and an engine revolution speed NE.

Incidentally, the routine shown in FIG. 23 is repeatedly executed at a predetermined time interval.

Since the fuel vapor compensation amount is detected by such a routine, particularly, steps 684 and 685, a large amount of fuel vapor may be processed without any adverse affect to the drivability or the emission.

<Change of the fuel injection condition in accordance with the compensation of the fuel vapor amount>

The examples for compensating the fuel vapor amount in accordance with a variety of parameters have been introduced. Examples for changing the fuel injection condition in accordance with the compensation of the fuel vapor amount. These examples are based upon the features based upon item (5) and (5-1).

An example for compensating for the fuel injection timing in response to FPG (fuel vapor amount compensation amount) will be described with reference to FIG. 27.

First of all, the engine revolution speed NE and the accelerator opening degree ACA are inputted (step 701). Subsequently, the basic fuel injection amount QALL is calculated in accordance with the inputted engine and the inputted accelerator opening degree (step 702).

Figure 28:
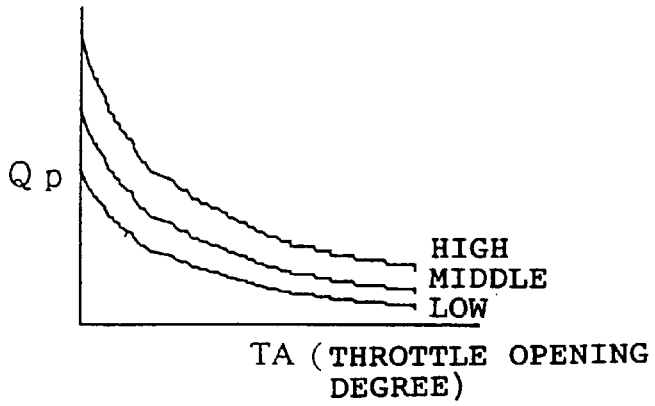
FIG. 28 is a map showing a relationship among the purge gas amount Qp, the throttle valve opening degree TA and the engine revolution speed.

In step 703, it is judged whether or not the purge is effected. If so, the purge gas amount Qp composed of air and fuel vapor is calculated (step 704). This calculation is performed in accordance with the mutual relation (see FIG. 28) between the throttle opening degree TA stored in advance in the ROM in the form of a map and the purge gas amount. In FIG. 28, "HIGH", "INTERMEDIATE" and "LOW" are engine revolution speeds. The higher the engine revolution speed, the more the purge gas amount will become.

Subsequently, the fuel vapor concentration FGprg detected by the hydrocarbon sensor (HC sensor) provided in the purge gas passage or the like is inputted (step 705).

Thereafter, in step 706, the fuel vapor amount compensation amount FPG is calculated. Namely, the fuel vapor concentration FGprg is multiplied by the purge gas amount QP, and the quotient obtained by dividing the product by the engine revolution speed NE×(n/2) is the fuel vapor amount. In this formula, n is the number of the cylinders. The reason why the value is divided by 2 is that two intake strokes take place in four cycles in a four cycle engine.

In the case where, in step 703, it is judged that the purge is not effected, in step 707, the fuel vapor amount compensation amount is zero.

Figure 29:
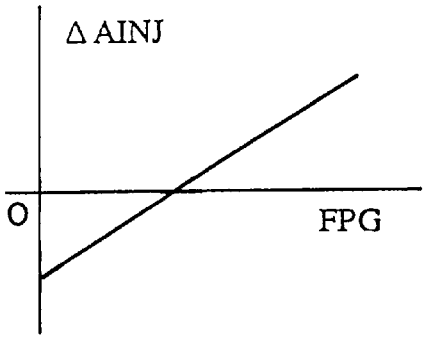
FIG. 29 is a map showing a relationship between the change amount ΔAINJ of the fuel injection timing and the fuel vapor amount.

After the fuel vapor amount compensation amount FPG is determined in steps 706 and 707, the process shifts to step 708 in which the final fuel injection amount QALLINJ is determined. In this case, the final fuel injection amount QALLINJ calculated in step 702 is the previous injection amount QALLO, and the fuel vapor amount compensation amount FPG is subtracted from the previous injection amount to thereby determine the final fuel injection amount QALLINJ. Furthermore, in step 709, the fuel injection timing is determined. When the fuel injection timing AINJ is determined, the map shown in FIG. 29 is referred to. This map determines the mutual relationship between the fuel vapor amount compensation amount FPG and the change amount ΔAINJ of the fuel injection timing and is stored in the ROM. In FIG. 29, an intersecting section between the line and the abscissa axis represents a stoichiometric air/fuel ration. The left portion of the intersecting section means the phenomenon that only the air is purged. The change amount ΔAINJ of the fuel injection timing corresponding to the fuel vapor amount compensation amount FPG is subtracted from the previous fuel injection timing AINJO to thereby calculate the current fuel injection amount. The fuel injection is effected in accordance with the fuel injection program determined separately with the fuel injection timing thus obtained.

Figure 27:
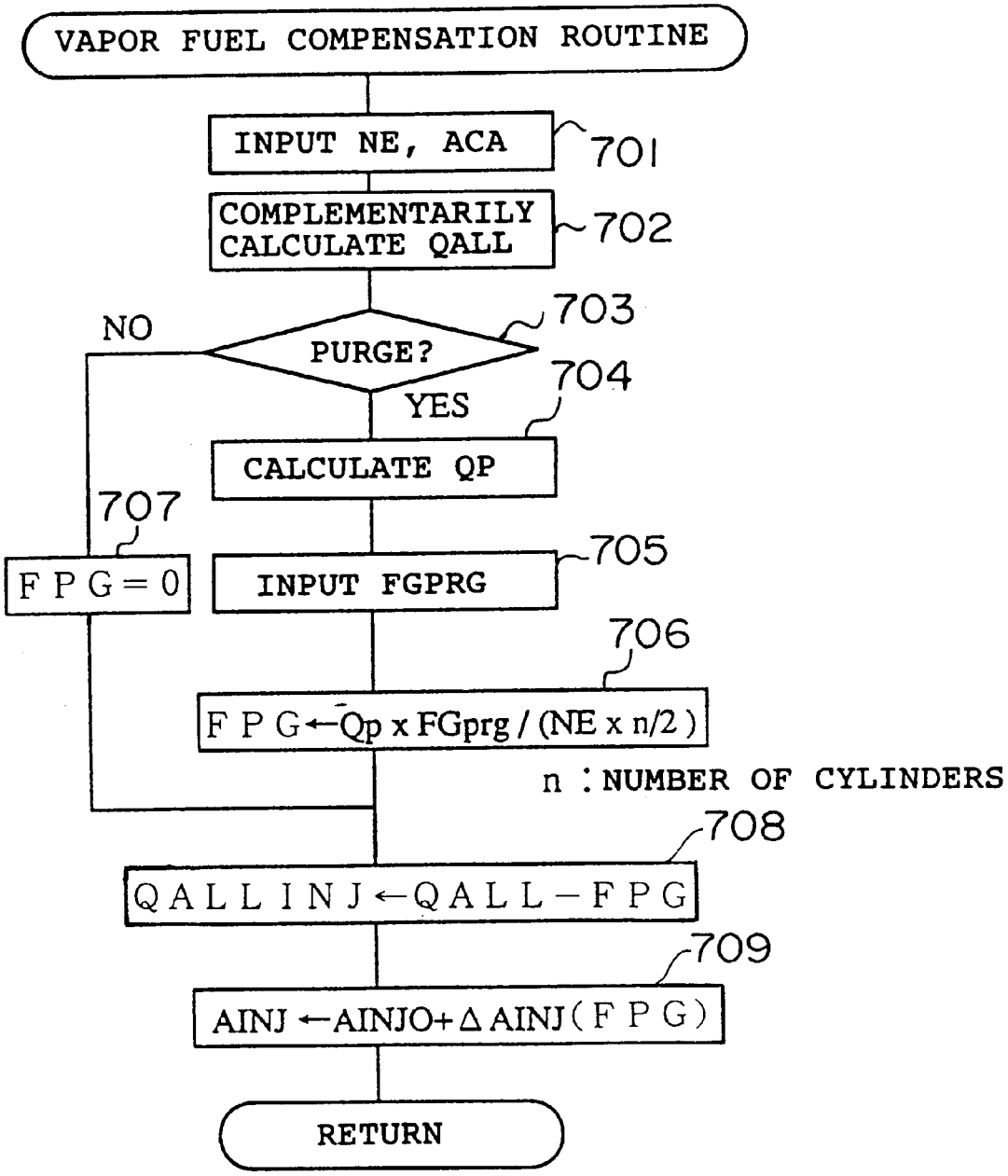
FIG. 27 is a flowchart showing an example for controlling the fuel injection timing in response to the fuel vapor amount compensation amount FPG.

Incidentally, the routine shown in FIG. 27 is repeatedly executed at a predetermined time interval.

The detection precision of the fuel vapor amount is enhanced by such a compensation routine, particularly, the steps 704, 705 and 706 so that a large amount of fuel vapor may be processed without any adverse affect to the drivability or the emission.

Figure 30:
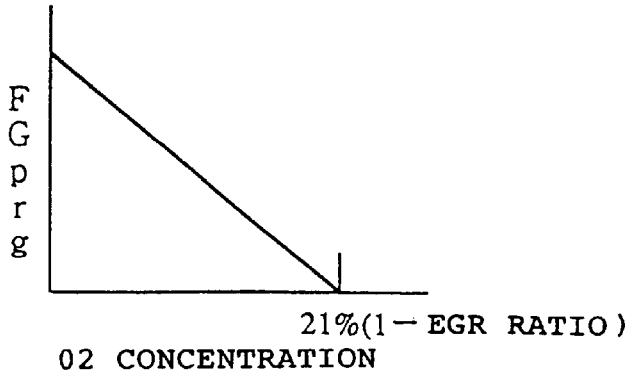
FIG. 30 is a map for detecting a concentration of the fuel vapor.

Also, a method for detecting the fuel vapor concentration from a map shown in FIG. 30 may be used. Namely, the mutual relationship between the oxygen concentration in the intake pipe and the fuel vapor concentration FGprg is stored in advance in the ROM in the form of a map, and the oxygen concentration in the intake pipe is detected by the oxygen sensor to introduce the fuel vapor concentration corresponding to the map.

<Compensation of the fuel vapor and the degree of the stratified combustion (injection timing and injection amount)>

Figure 31:
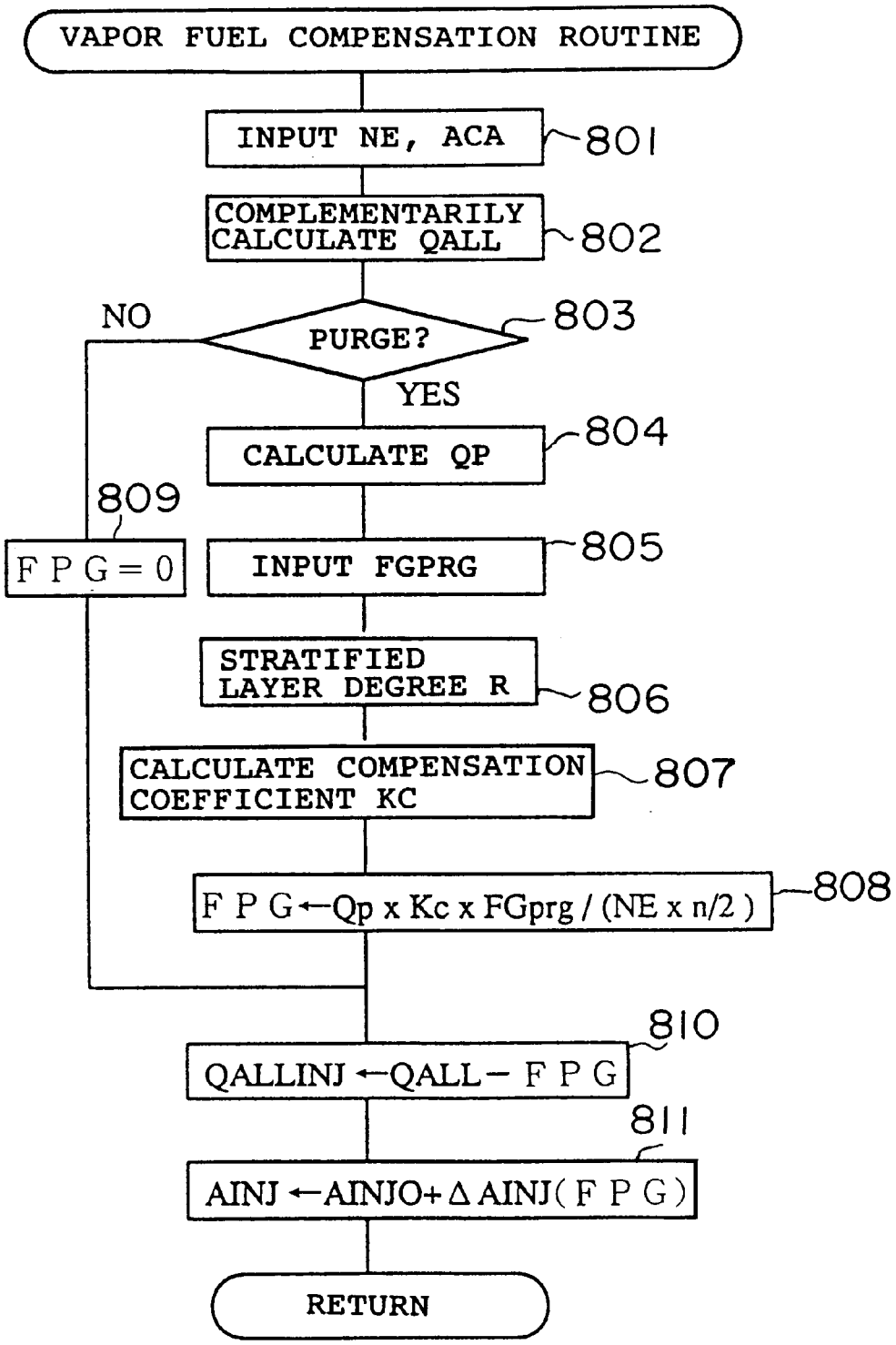
FIG. 31 is a flowchart showing an example for compensating for the fuel vapor amount in response to the combustion condition (degree of stratified combustion)

FIG. 31 shows an example for compensating the fuel injection amount with reference to the degree of the stratified combustion, i.e., the fuel injection timing and the injection amount in the stratified combustion for calculating the fuel vapor amount compensation amount FPG by the purge gas amount Qp and the fuel vapor concentration FGprg of the purge gas. Namely, this is the example of the control of the fourth compensation means of the above-described item (4).

First of all, the engine revolution speed NE and the accelerator opening degree ACA are inputted (step 801). Subsequently, the basic fuel injection amount QALL is calculated in accordance with the inputted engine revolution speed and the inputted accelerator opening degree (step 802). In step 803, it is judged whether or not the purge is effected. If so, the purge gas amount Qp composed of air and fuel vapor is calculated (step 804). This calculation is performed in accordance with the mutual relation (see FIG. 28) between the throttle opening degree TA stored in advance in the ROM in the form of a map and the purge gas amount.

Figure 32:
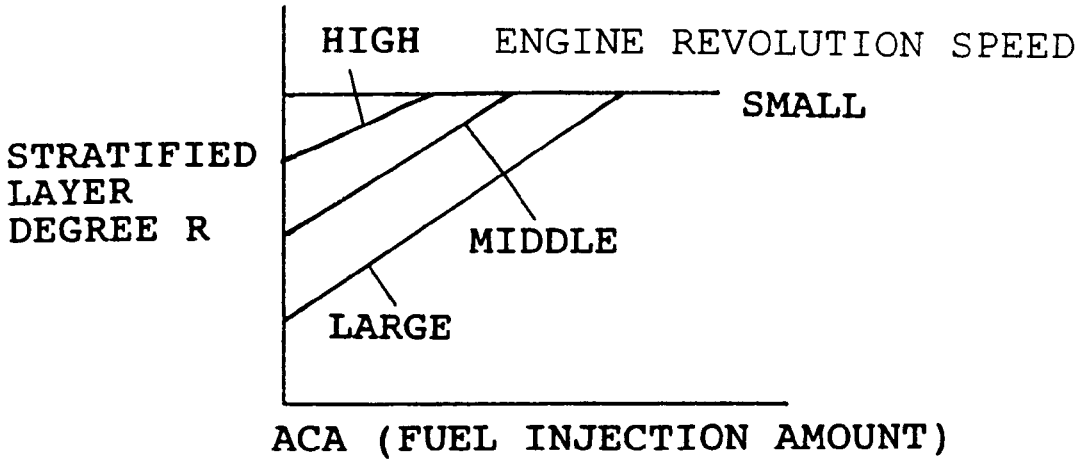
FIG. 32 is a map showing a relationship among a degree of stratification, an accelerator opening degree (or fuel injection amount) and an engine revolution speed.

Subsequently, the fuel vapor concentration FGprg detected by the hydrocarbon sensor (HC sensor) provided in the purge gas passage or the like is inputted (step 805). In step 806, the degree R of the stratification which is the combustion condition is detected. Although the stratification degree R to be inputted is determined by the relationship with the accelerator opening degree and the fuel injection amount as shown in FIG. 32, it further depends upon the magnitude of the engine revolution speed. As is apparent from FIG. 32, the larger the accelerator opening degree, the closer the stratification degree will become to the value of 1.0. Also, the more the engine revolution speed, the more the stratification degree will become.

Figure 33:
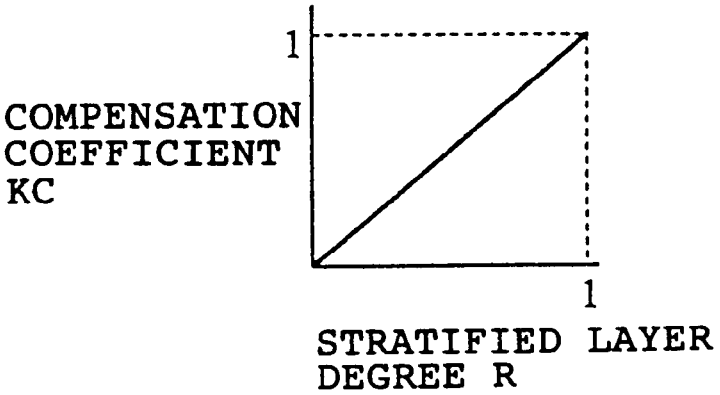
FIG. 33 is a map showing a relationship between the stratified combustion degree and the compensation coefficient.

Thereafter, in step 807, a compensation coefficient Kc is calculated. The compensation coefficient Kc is calculated from a map shown in FIG. 33. FIG. 33 shows the relationship the stratification degree R and the compensation coefficient Kc, which is stored in advance the ROM. The stratification degree R is determined by the product of the injection timing and the injection amount.

In step 808, the fuel vapor concentration FGprg is multiplied by the purge gas amount QP, and the quotient obtained by dividing the product by the engine revolution speed NE×(n/2) is the fuel vapor amount. In this formula, n is the number of the cylinders. The reason why the value is divided by 2 is that two intake strokes take place in four cycles in a four cycle engine.

In the case where, in step 803, it is judged that the purge is not effected, in step 809, the fuel vapor amount compensation amount is zero.

After the fuel vapor amount compensation amount FPG is determined in steps 808 and 809, the process shifts to step 810 in which the final fuel injection amount QALLINJ is determined. In this case, the fuel vapor amount compensation amount FPG is subtracted from the basic fuel injection amount QALL calculated in step 802 to thereby determine the final fuel injection amount QALLINJ. Furthermore, in step 811, the fuel injection timing is determined. When the fuel injection timing AINJO is determined, the map shown in FIG. 29 is referred to. Namely, the change amount ΔAINJ of the fuel injection timing corresponding to the fuel vapor amount compensation amount FPG is subtracted from the previous fuel injection timing AINJO to thereby calculate the current fuel injection amount. The fuel injection is effected in accordance with the fuel injection program determined separately with the fuel injection timing thus obtained.

Incidentally, the routine shown in FIG. 31 is repeatedly executed at a predetermined time interval.

The detection precision of the fuel vapor amount is enhanced by such a compensation routine, particularly, the steps 804 and 808 so that it is possible to suitably reduce the fuel injection amount of the portion contributing to the combustion out of the fuel vapor injection to thereby prevent the generation of misfire.

<Compensation of the purge gas amount and the fuel vapor amount, and the torque variation>

Figure 34:
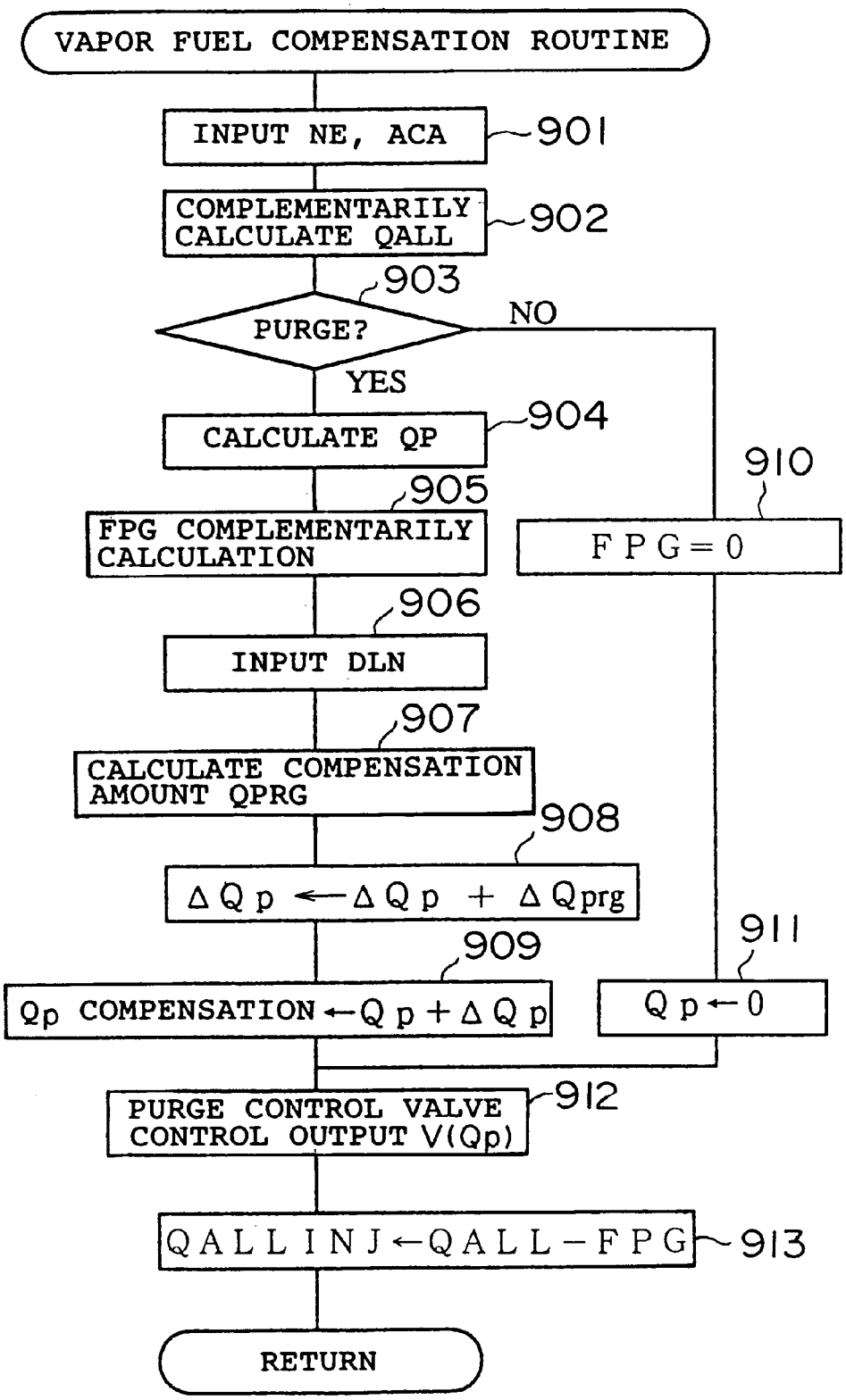
FIG. 34 is a flowchart showing an example for controlling the purge gas amount Qp in response to the output variation.

An example for compensating the purge gas amount Qp in response to the torque variation and further compensating the fuel vapor compensation amount FPG determined with the relation to Qp will be explained with FIG. 34. This is an example to which the third compensation means (3) is applied.

First of all, the engine revolution speed NE and the accelerator opening degree ACA are inputted (step 901). Subsequently, the basic fuel injection amount QALL is calculated in accordance with the inputted engine revolution speed and the inputted accelerator opening degree (step 902). In step 903, it is judged whether or not the purge is effected. If so, the purge gas amount Qp composed of air and fuel vapor is calculated (step 904). This calculation is performed in accordance with the mutual relation (see FIG. 28) between the throttle opening degree TA stored in advance in the ROM in the form of a map and the purge gas amount.

Subsequently, the fuel vapor amount is complementarily calculated in step 905. Although not shown, the fuel vapor amount is calculated from the engine revolution speed and the mutual relationship between the throttle opening degree TA and the fuel vapor amount, stored in the form of a map in the ROM.

Figure 35:
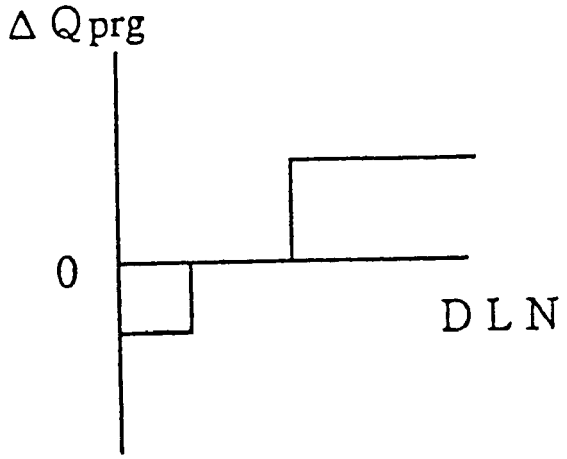
FIG. 35 is a map showing a relationship between the output variation and the purge gas compensation amount ΔQprg.

In step 906, the torque variation DLN is inputted. The torque variation is numerically expressed by the difference between the old torque a predetermined time from now and the current torque. Subsequently, in step 907, the purge gas compensation amount ΔQprg corresponding to the torque variation is calculated in step 907. The map shown in FIG. 35 is referred to in calculating the purge gas compensation amount ΔQprg. FIG. 35 determines the relationship between the abscissa axis representing the magnitude of the torque variation and the ordinate axis representing the purge gas compensation amount ΔQprg corresponding to the magnitude of the torque variation. As is apparent from the map, when the torque variation is remarkable, the compensation amount is positive, whereas the torque variation is small, the compensation amount is negative.

After the purge gas compensation amount is obtained, in step 908, the purge gas compensation amount ΔQprg is added to the previous purge gas compensation amount to obtain the new purge gas compensation amount ΔQp. Then, the purge gas compensation amount ΔQp obtained in step 908 is added to the purge gas amount Qp obtained in step 904 to obtained the compensated purge gas amount Qp (step 909).

In the case where, in step 903, the purge is not effected, the fuel vapor amount compensation amount FPG is zero (step 910). Furthermore, the purge gas amount Qp is zero (step 911).

Figure 36:
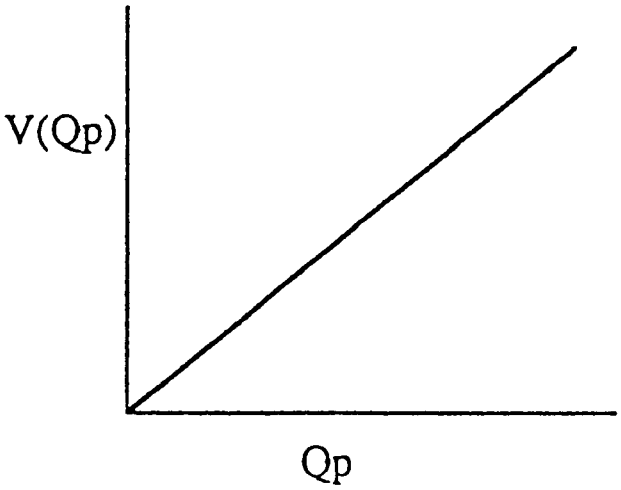
FIG. 36 is a map showing a relationship between the purge gas amount Qp and the purge control valve controlling output V (Qp)
Figure 37:
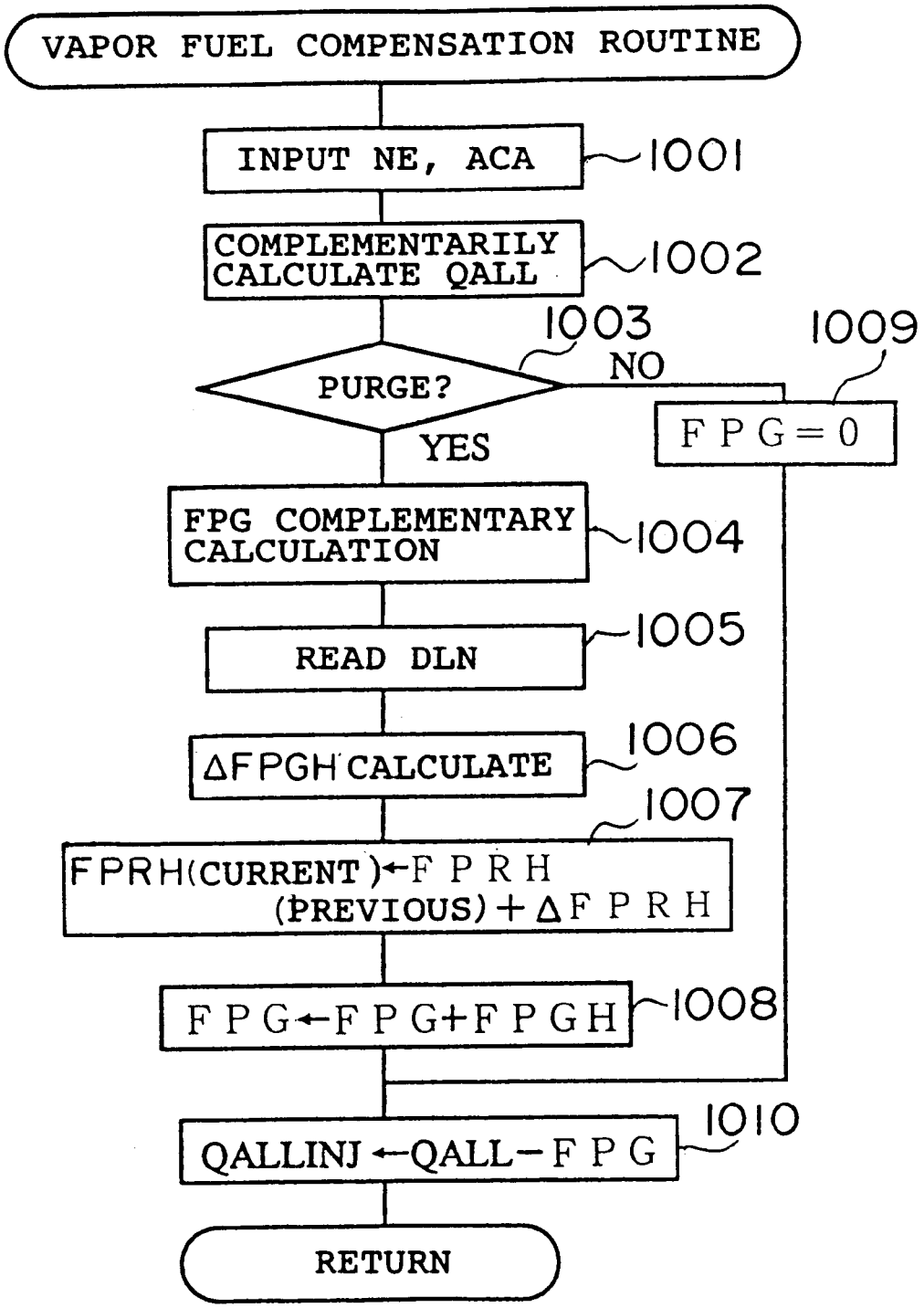
FIG. 37 is a flowchart showing an example for compensating the fuel vapor amount in response to the output variation.

In step 912, the opening degree of the purge control valve is controlled from the value of the purge gas amount Qp obtained in steps 909 and 911. This control is performed with reference to the mutual relationship between the purge gas amount Qp and the opening degree V (Qp) of the purge control valve, shown in FIG. 36. The map shown in FIG. 36 is stored in advance in the ROM.

Subsequently, in step 913, the fuel vapor amount compensation amount FPG is subtracted from the basic fuel injection amount QALL calculated in step 902 to thereby determine the final fuel injection amount QALLINJ.

Since the purge gas amount is compensated for in response to the torque variation in such a compensation routine, particularly, from step 904 to 909, in the case where the torque variation is remarkable and the purge gas concentration is lean, the purge gas amount is increased so that an optimum fuel vapor amount compensation amount FPG is increased. It is therefore possible to increase the purge amount.

<Example for compensating the fuel vapor amount in response to the torque variation>

In the previous example, the purge gas amount Qp is changed in response to the torque variation to compensate for the fuel vapor amount compensation amount FPG. However, in FIGS. 37 to 40, there is shown an example, the fuel vapor amount is directly compensated for in response to the torque variation. Also, in this example, the third compensation means of item (3) is applied.

First of all, the engine revolution speed NE and the accelerator opening degree ACA are inputted (step 1001).

Subsequently, the basic fuel injection amount QALL is calculated in accordance with the inputted engine revolution speed and the inputted accelerator opening degree (step 1002). In step 1003, it is judged whether or not the purge is effected. If so, the engine revolution speed NE and the throttle valve opening degree are read in to calculate the fuel vapor amount compensation amount FPg (step 1004). This calculation is performed in accordance with the relationship between the engine revolution speed NE and the throttle opening degree TA and fuel vapor amount compensation amount FPG.

Figure 38:
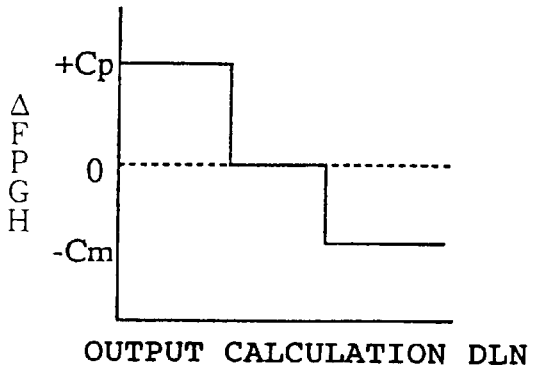
FIG. 38 is a map showing a relationship between the output variation and a fuel vapor amount compensation amount ΔFPGH.

Subsequently, in step 1005, the torque variation DLN is read in. Thereafter, in step 1006, the compensation amount ΔFPGH of the fuel vapor amount compensation amount FPG in response to the torque variation is calculated. The map shown in FIG. 38 is referred to in calculating the compensation amount ΔFPGH of the fuel vapor amount compensation amount FPG. FIG. 38 determines the mutual relationship between the abscissa axis representing the magnitude of the torque variation and the ordinate axis representing the compensation amount ΔFPGH of the fuel vapor amount compensation amount FPG corresponding to the magnitude of the torque variation. As is apparent from the map, when the torque variation is remarkable, the compensation amount is negative, whereas the torque variation is small, the compensation amount is positive.

After the compensation amount ΔFPGH of the fuel vapor amount compensation amount FPG is obtained, in step 1007, the compensation amount ΔFPGH of the fuel vapor amount compensation amount FPG obtained in step 1006 is added to the previous compensation amount FPGH of the fuel vapor compensation amount FPG to obtain the new compensation amount FPGH of the fuel vapor compensation amount FPG. Subsequently, the compensation amount FPGH of the fuel vapor compensation amount FPG obtained in step 1007 is added to the fuel vapor amount compensation amount FPG obtained in step 1004 to obtain the compensated fuel vapor amount compensation amount FPG (sep 1008).

In the case where, in step 1003, the purge is not effected, the fuel vapor amount compensation amount FPG is zero (step 1009).

Subsequently, in step 1010, the final fuel injection amount QALLINJ is determined. In this case, the fuel vapor amount compensation amount FPG is subtracted from the basic fuel injection amount QALL calculated in step 1002 to thereby determine the final fuel injection amount QALLINJ.

Since the fuel vapor amount is compensated for in response to the torque variation in such a compensation routine, particularly, from step 1004 to 1008, it is possible to obtain the exact fuel vapor amount compensation amount FPG in response to the torque variation to make it possible to perform a large amount of purge.

Incidentally, when the fuel vapor amount compensation amount ΔFPGH is calculated, the following factors are taken into consideration.

Figure 39:
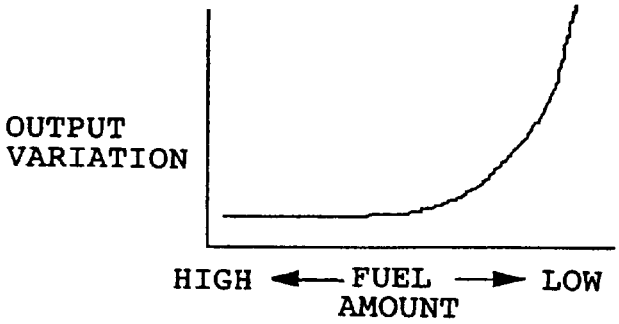
FIG. 39 is a map showing a relationship between the output variation and the fuel amount.
Figure 40:
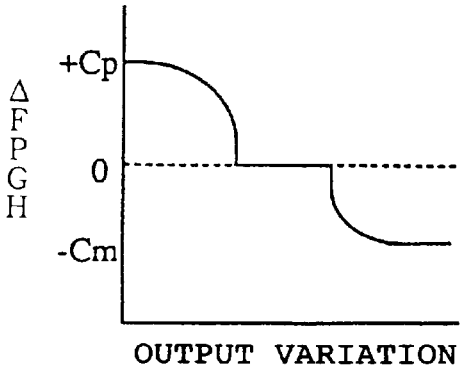
FIG. 40 is an example of a map showing a relationship between the output variation and the fuel vapor amount compensation amount ΔFPGH.

As shown in FIG. 39, the fact that the output variation is small means that the fuel amount is too large. This is because the fuel vapor amount is estimated to be small. Thus, the fuel vapor amount is compensated for on the increment side. In the case where the output variation is large, the sleeve interior fuel is insufficient. Accordingly, the fuel vapor amount compensation amount FPG is compensated for on the decrement side.

Incidentally, as shown in FIG. 38, it is possible to gradually change the compensation amount ΔFPGH of the fuel vapor amount in response to the output variation.

<Example in the case where the guard is applied to the fuel vapor amount compensation amount>

Figure 41:
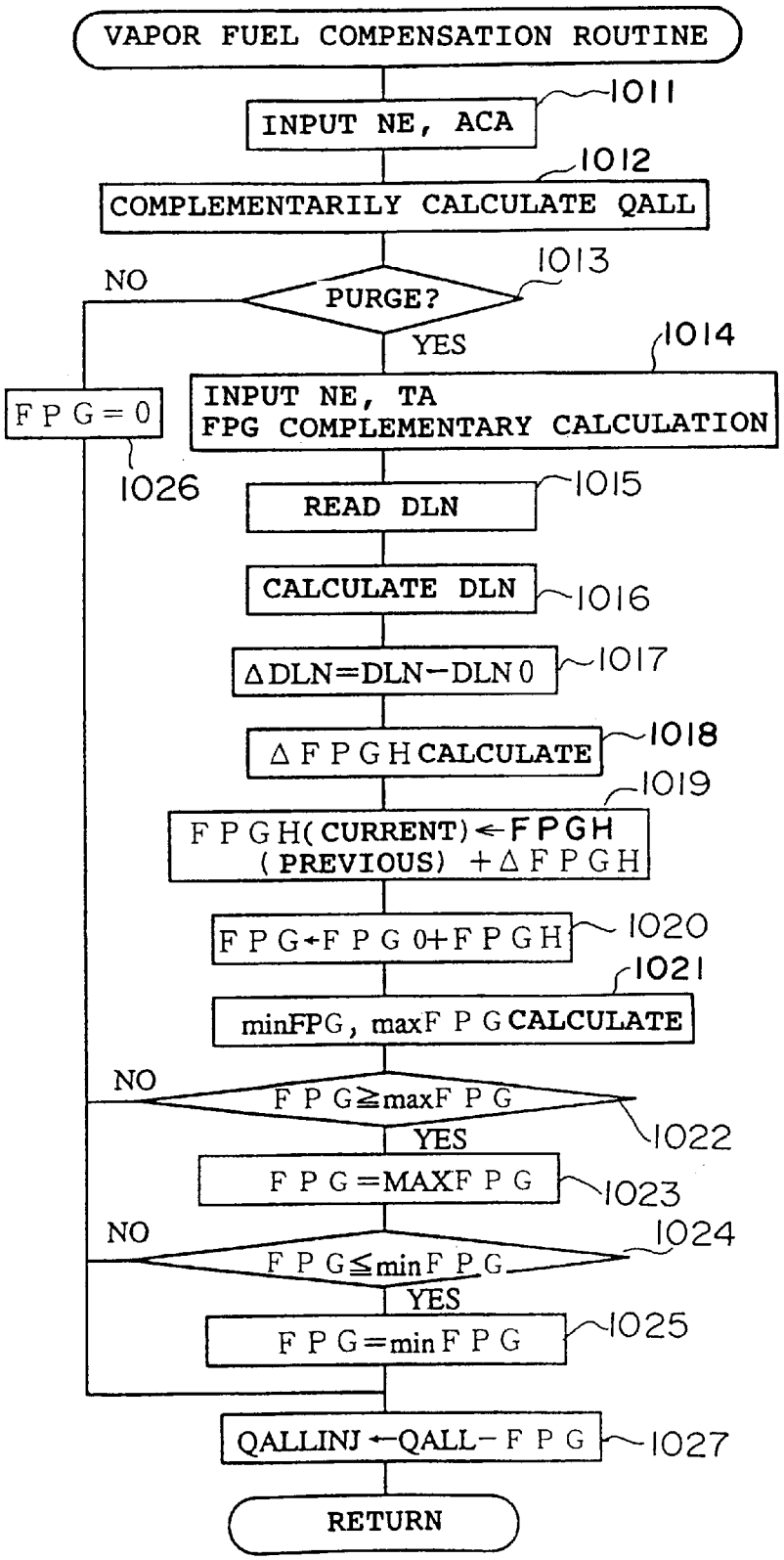
FIG. 41 is a flowchart showing an example in which the fuel vapor amount is compensated for in response to the output variation and a guard process is effected.
Figure 42:
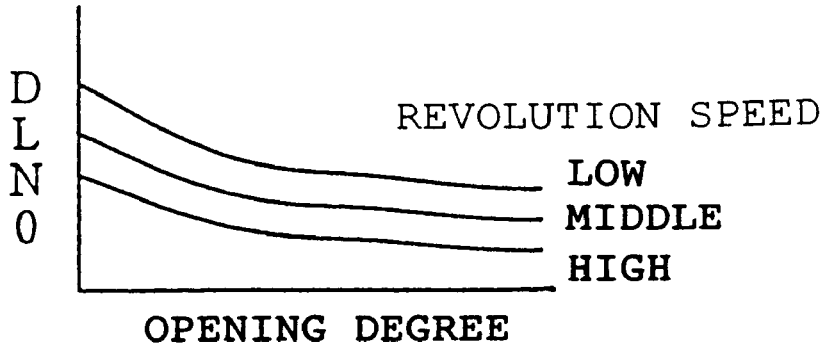
FIG. 42 is a map showing a relationship among the reference output variation DLN0, the accelerator opening degree and the engine revolution speed.
Figure 43:
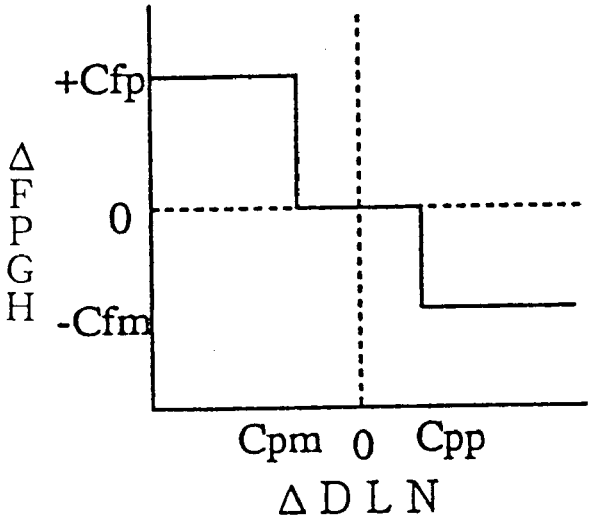
FIG. 43 is a map showing a relationship between the change amount ΔDLN of the output variation and the fuel vapor amount compensation amount ΔFPGH.

An example in which the fuel vapor amount is compensated for in response to a deviation ΔDLN from the reference output variation, and the guard is applied to the fuel vapor amount compensation amount ΔFPGH to thereby avoid the abnormal compensation will now be described with reference to FIGS. 41 to 43. Incidentally, this example realizes the feature of item (5-2).

First of all, the engine revolution speed NE and the accelerator opening degree ACA are inputted (step 1011) Subsequently, the basic fuel injection amount QALL is calculated in accordance with the inputted engine revolution speed and the inputted accelerator opening degree (step 1012). In step 1013, it is judged whether or not the purge is effected. If so, the engine revolution speed NE and the throttle valve opening degree are read in and to calculate the reference fuel vapor amount compensation amount FPGO (step 1014). This calculation is performed in accordance with the relationship between the engine revolution speed NE and the throttle opening degree TA and the reference fuel vapor amount compensation amount FPGO.

Subsequently, in step 1015, the torque variation DLN is read in. Thereafter, in step 1016, the reference torque variation LDNO is calculated. The map shown in FIG. 42 is referred to in calculating the reference torque variation DLNO. FIG. 42 determines the mutual relationship between the abscissa axis representing the accelerator opening degree (throttle valve opening degree) and the ordinate axis representing the reference torque variation DLNO corresponding to the accelerator opening degree at every engine revolution speed. As is apparent from the map, the larger the accelerator opening degree, and the more the engine revolution speed, the smaller the reference torque variation will become.

After the reference variation DLNO is calculated, in step 1017, the reference torque variation is subtracted from the torque variation DLN obtained in step 1015 to obtain the variation amount ΔDLN of the torque variation. Subsequently, with reference to this variation amount ΔDLN, the fuel vapor amount compensation amount ΔFPGH is calculated from the map shown in FIG. 43 (step 1018). The ΔFPGH is calculated from the mutual relationship map between the fuel vapor amount compensation amount ΔFPGH and ΔDLN shown in FIG. 43. Incidentally, in FIG. 43, Cpp is the amount for increasing the purge, Cpm is the amount for decreasing the purge, Cfp is the amount for increasing the estimation value of the concentration in the purge gas, and Cfm is the amount for decreasing the estimation value of the concentration in the purge gas.

When ΔDLN is greater than reference 0, the fuel vapor amount compensation amount ΔFPGH is negative, whereas when ΔDLN is smaller than reference 0, the fuel vapor amount compensation amount ΔFPGH is positive.

Subsequently, the compensation amount ΔFPGH of the fuel vapor amount compensation amount FPG obtained in step 1018 is added to the previous compensation amount FPGH of the fuel vapor compensation amount FPG to obtain the new compensation amount FPGH of the fuel vapor compensation amount FPG. Furthermore, the compensation amount FPGH of the fuel vapor compensation amount FPG obtained in step 1019 is added to the fuel vapor amount compensation amount FPGO obtained in step 1014 to obtain the compensated fuel vapor amount compensation amount FPG (sep 1020).

Thereafter, in step 1021, the maximum value maxFPG and the minimum value minFPG of the fuel vapor amount compensation amount FPG are calculated in step 1021. Incidentally, the following relationships are given:

maximum value maxFPG=reference fuel vapor amount compensation amount FPGO−predetermined value; and minimum value minFPG=reference fuel vapor amount compensation amount FPGO+predetermined value, where the predetermined value is determined by experiences.

Thereafter, in step 1022, it is judged whether the fuel vapor amount compensation amount FPG is equal to or greater than the maximum value maxFPG. If so, in step 1023, the fuel vapor amount compensation amount FPG is the maximum value maxFPG. Namely, the guard is effected at the maximum value.

Thereafter, in step 1021, it is judged whether the fuel vapor amount compensation amount FPG is less than the minimum value maxFPG. If so, in step 1025, the fuel vapor amount compensation amount FPG is the minimum value minFPG. Namely, the guard is effected at the minimum value.

In the case where the purge is not effected in step 1013, the fuel vapor amount compensation amount FPG is zero, and also in the case where the judgement is "NO" in step 1022 or step 1025, the fuel vapor amount compensation amount FPG is kept intact.

After the fuel vapor amount compensation amount FPG is determined, in step 1027, the final fuel injection amount QALLINJ is determined. In this case, the fuel vapor amount compensation amount FPG is subtracted from the basic fuel injection amount QALL calculated in step 1012 to thereby determine the final fuel injection amount QALLINJ.

Since the compensation of fuel vapor amount compensation amount ΔFPGH is effected to the variation width ΔDLN of the torque variation by the steps 1016 to 1018 in such a compensation routine, it is possible to obtain the exact fuel vapor amount compensation amount FPG in response to the torque variation.

Furthermore, since the guard is effected to the obtained fuel vapor amount compensation amount FPG in steps 1022 to 1025, the abnormal compensation is avoided to ensure the stable combustion.

In particular, at the high engine revolution speed, the torque variation is small. In such a case, a malfunction for increasing the fuel vapor amount compensation amount FPG would occur. On the other hand, at the low engine revolution speed, the torque variation is large. In such a case, a malfunction for decreasing the fuel vapor amount compensation amount FPG would occur. However, according to this example, it is possible to avoid such malfunctions by the guard process.

Incidentally, the variety of forms of the embodiments of the invention may be used in combination as desired.

As described above in detail, according to the present invention, when the fuel vapor is fed into the lean burn internal combustion engine, even if the air/fuel ratio is not detected or the precision of the detected air/fuel ratio is not good, the calculation of the feed amount of the fuel vapor is now worse and it is possible to suppress the rich misfire or surge.

Also, in the fuel vapor feed controlling apparatus for the lean burn internal combustion engine, the present invention is applied to an idle operational mode, thereby reducing the base fuel effectively, also, making it possible to keep the stability of the idle Revolution speed irrespective of the concentration of the vapor.

Furthermore, the fuel vapor amount is compensated for in response to the output variation. Accordingly, even if the surge or misfire caused by the purge would occur, it is possible to effectively reduce the fuel to keep good drivability and to enhance the fuel consumption rate.

Furthermore, the fuel vapor amount is compensated for in response to the combustion condition. Accordingly, in the case or the like where the combustion modes are switched, it is possible to avoid the degradation of the combustion.

The fifth feature of the present invention will now be described with reference to FIGS. 44 and 63.

<first form according to the fifth feature>

A first form embodying the fuel vapor feed controlling apparatus for the lean burn combustion engine according to the present invention will now be described in detail with reference to the drawings.

Figure 44:
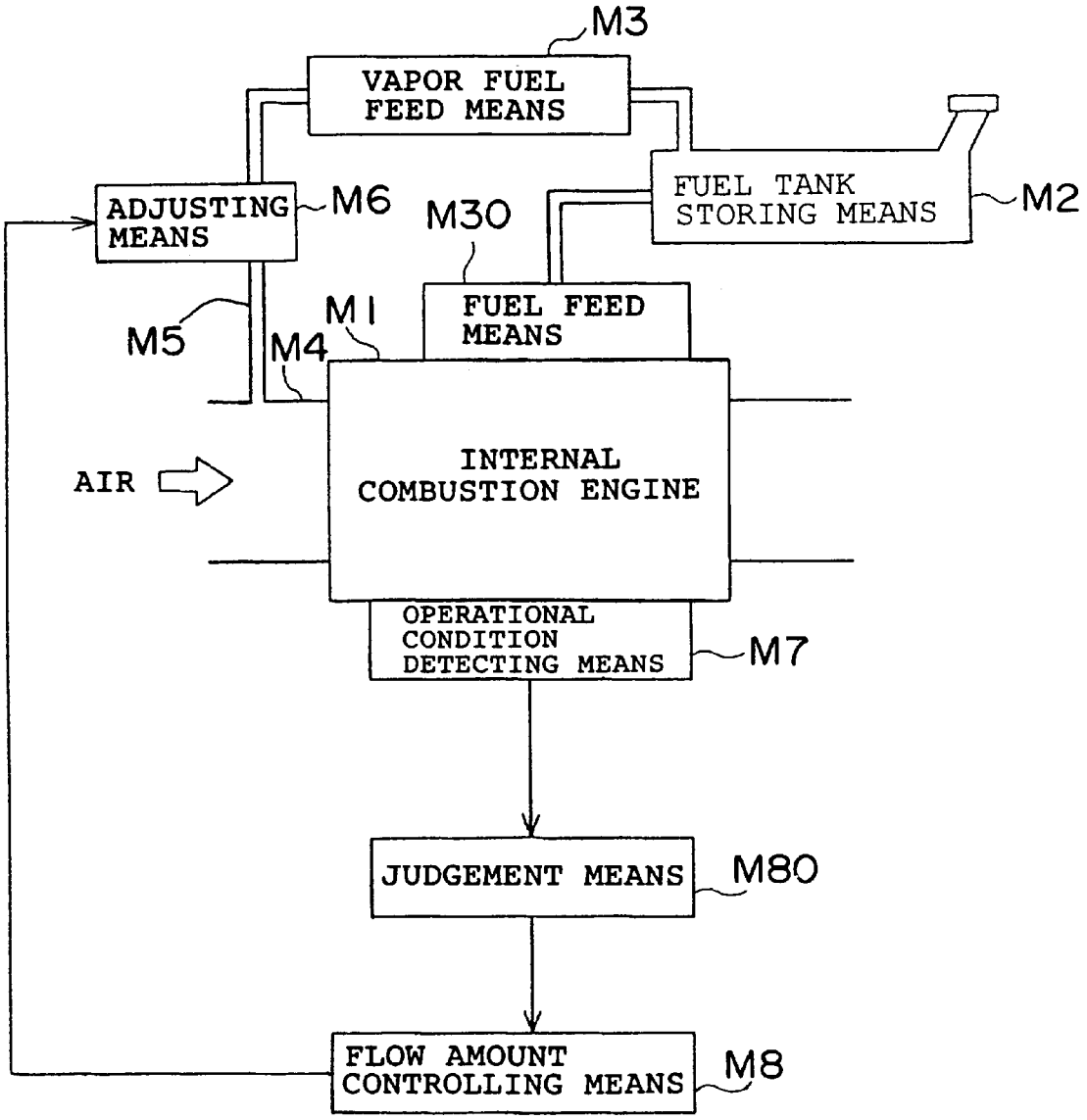
FIG. 44 is a conceptional structural view showing a fifth feature of the invention.

FIG. 44 shows a basic structure of this embodiment.

As shown in FIG. 44, an intake passage M4 is provided for guiding at least air in an internal combustion engine M1. A purge passage M5 is provided in the intake passage for purging fuel vapor generated from an fuel reservoir M2 as a fuel storing means.

Furthermore, a fuel feeding means M30 (fuel injection valve) is provided for feeding the fuel to the internal combustion engine Ml in order to attain at least lean combustion. A fuel vapor feeding means M3 is provided feeding the fuel vapor generated in the fuel reservoir M2 from the purge passage M5 to the intake passage M4. The fuel vapor feeding means M3 includes a canister.

Also, there are provided an adjusting means M6 (purge control valve) for adjusting the flow rate of the fuel vapor to be fed to the internal combustion engine Ml through the above-described fuel vapor feeding means M3 and an operational condition detecting means M7 for detecting the operational condition of the internal combustion engine Ml.

Then, at least in the case where the lean combustion operation is effected, a judgement means M80 is provided for judging, on the basis of the detection result of the operational condition detecting means M7, that the combustible mixture air/fuel ratio fed in the internal combustion engine Ml is more enriched than the air/fuel ratio of the normal lean combustion condition.

Furthermore, a flow rate controlling means M8 is provided for controlling the above-described adjusting means M6 to apply a restriction to the flow rate of the fuel vapor to be fed at least into the internal combustion engine M1 when the judging means M80 judges that the air/fuel ratio of the combustible mixture is more enriched than the air/fuel ratio of the normal lean combustion condition.

Incidentally, the "purge controlling means" according to the present invention means a concept including the adjusting means M6 (purge control valve) and the operational condition detecting means M7. The flow rate controlling means M8 is intrinsically or extrinsically provided in the purge controlling means.

Also, it is possible to provide intrinsically the adjusting means M6 in the fuel vapor feeding means M3.

Incidentally, a "stratified combustion" will be used as an example of the lean combustion in some cases in the following description.

The fuel vapor feed controlling apparatus for the sleeve interior injection type engine mounted on a vehicle as a lean burn internal combustion engine is basically the same as that shown in FIG. 3 but there are some distinctions which will be explained with reference to FIG. 45. Also, the structure of the cylinder head is the same as that shown in FIG. 4.

Figure 45:
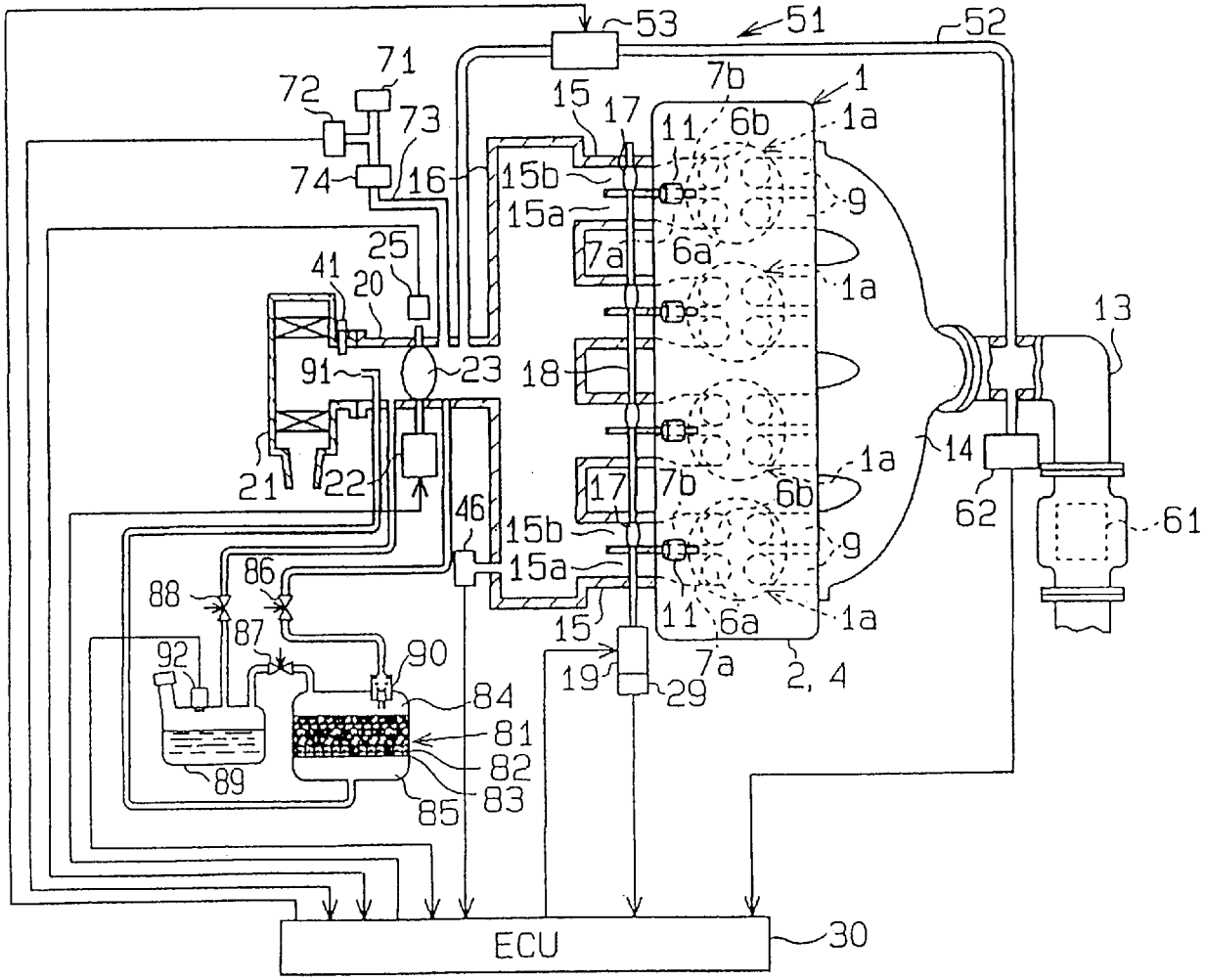
FIG. 45 is a schematic structural view showing a fuel vapor feed controlling apparatus for a sleeve interior injection engine in an embodiment of the invention.

As shown in FIG. 45, the first intake port 7*a* and the second intake port 7*b* of each cylinder 1*a* are connected to a surge tank 16 through a first intake passage 15*a* and a second intake passage 15*b* formed in each intake manifold 15. A swirl control valve 17 is disposed in each second intake passage 15*b*. These swirl control valves 17 are connected to a stepping motor 19 through a common shaft 18. This stepping motor 19 is controlled on the basis of the output signal from an electronic controlling unit (hereinafter simply referred to as "ECU") 30 to be described later.

The surge tank 16 is connected to an air cleaner 21 through an intake duct 20. A throttle valve 23 which is opened and closed by another stepping motor 22 is disposed in the intake duct 20. Namely, the throttle valve 23 according to this embodiment is of so-called electronic controlling type and the stepping motor 22 is basically driven on the basis of the output signal from the ECU 30 to thereby open and close control the throttle valve 23. Then, the amount of the intake air to be introduced into the combustion chamber 5 through the intake duct 20 is adjusted by the opening and closing of the throttle valve 23. In this embodiment, the intake passage is constituted by the intake duct 20, the surge tank 16, the first intake passages 15*a*, the second intake passages 15*b* and the like. Also, a throttle sensor 25 is provided in the vicinity of the throttle valve 23 for detecting the opening degree (throttle opening degree TA).

Furthermore, a homogeneous fuel injection valve 41 is provided within the intake duct 20 upstream of the above-described throttle valve 23. Namely, in the embodiment, the fuel from the homogeneous injection valve 41 is injected under the condition that the fuel is diffused into the intake duct 20 and is introduced into the cylinders la through the intake passage.

Incidentally, an exhaust manifold 14 is connected to the exhaust ports 9 of each cylinder. Then, the burnt exhaust gas is discharged to the exhaust duct 13 through the exhaust manifold 14. In this embodiment, the exhaust passage is constituted by the exhaust manifold 14 and the exhaust duct 13.

Furthermore, in the embodiment, a well know exhaust gas recirculation (EGR) system 51 is provided. The EGR system 51 includes an EGR passage 52 as an exhaust gas recirculation passage and an EGR valve 53 as an exhaust gas recirculation valve disposed in the midway of the EGR passage 52. The EGR passage 52 is provided for communicating the intake duct 20 downstream of the throttle valve 23 and the exhaust duct 13. Also, the EGR valve 53 is internally provided a valve seat, a valve body and a stepping motor (any of which is not shown). The opening degree of the EGR valve 53 is varied by intermittently changing the valve body to the valve seat by the stepping motor. Then, the EGR valve 53 is opened so that the part of the exhaust gas discharged to the exhaust duct is caused to flow to the EGR passage 52. The exhaust gas is caused to flow to the intake duct 20 through the EGR valve 53. Namely, the part of the exhaust gas is recirculated into the sucked mixture by the EGR system 51. At this time, the opening degree of the EGR valve 53 is adjusted to adjust the recirculation amount of the exhaust gas.

Also, as shown in FIG. 45, in this embodiment, a brake booster 71 is provided as a device for biasing and assisting the brake operation of the vehicle. The stepping force for the brake pedal (not shown) is amplified by the brake booster 71 and is converted into a hydraulic pressure to drive the brake actuator (not shown) for each wheel. This brake booster 71 is connected through a connection pipe 73 to the intake duct 20 downstream of the throttle valve 23 to utilize the vacuum pressure generated within the intake duct 20 as a drive force. Furthermore, a check valve 74 is provided in the connection pipe 73 and opened by the vacuum pressure within the intake duct 20. Namely, the brake booster 71 is provided with a diaphragm as a working portion in its interior. One side portion of the diaphragm is opened to the atmosphere, and the vacuum pressure generated in the intake duct 20 is applied to the other side portion through the connection pipe 73. The connection pipe 73 is provided with a pressure sensor 72 as a vacuum pressure detecting means for detecting a brake booster internal pressure (absolute pressure).

Furthermore, in this embodiment, a nitrogen oxide absorbing reducing catalyst 61 is provided as a nitrogen oxide reducing catalyst within the exhaust duct 13. This catalyst 61 is used to purifying NOx which is liable to be generated in the lean air/fuel ratio region and basically absorbs the NOx contained in the exhaust gas when the operation is effected at the lean air/fuel ratio. Also, if the air/fuel ratio is controlled to be enriched, the amounts of the reducing agents such as HC and CO in the exhaust gas are increased so that the NOx absorbed therein is released from the catalyst and at the same time, the NOx is reduced to the nitrogen gas on the catalyst to be discharged into the atmosphere.

The above-described NOx absorbing reducing catalyst 61 is, for example, an aluminum carrier for carrying thereon a noble metal such as platinum Pt and at least one selected from the groups of alkaline metal such as kalium K, sodium Na, lithium Li, and cesium Cs, alkaline earth metal such as barium Ba and calcium Ca, rare earth metal such as lanthanum and yttrium.

The NOx absorbing reducing catalyst has the characteristics that, when an air excessive rate $\lambda$ of the exhaust gas is larger than 1 (lean), it may adsorb NOx ($NO_2$ and NO) contained in the exhaust gas is absorbed in the form of nitrate ion $NO_3^-$.

More specifically, the explanation will be given as to an example in which platinum Pt and barium Ba are carried on a carrier. If the oxygen concentration in the flowing exhaust gas is high to the catalyst (that is; the air excessive rate $\lambda$ of the exhaust gas is larger than 1 (lean)), the oxygen is adhered to the surface of the platinum Pt in the form of $O_2^-$ or $O_2^-$ on the platinum Pt, and NO in the exhaust gas reacts with $O_2^-$ or $O_2^-$ on the platinum Pt surface to become $NO_2$ ($2NO+O_2=2NOM_2$). Also, $NO_2$ contained in the exhaust gas and $NO_2$ produced as described above are further oxidized on the platinum Pt and absorbed into the absorbent to be bonded with BaO and to be diffused into the NOx absorption agent in the form of nitrate ion $NO_3^-$. For this reason, under the condition of $\lambda>1.0$, NOx contained in the exhaust gas is absorbed into the Nox absorbing reducing catalyst.

Also, when the oxygen concentration in the flowing exhaust gas is largely reduced (that is; the air excessive rate $\lambda$ of the exhaust gas is equal to or less than 1 (rich)), the amount of the production of the $NO_2$ on the platinum Pt is decreased, so that the reaction is developed in the reverse direction. The nitrate ion $NO_3^-$ in the absorbent is released from the NOx absorbent in the form of $NO_2$ and NO. In this case, if the reduced components such as HC and CO are present in the exhaust gas, $NO_2$ is reduced by these components on the platinum Pt.

In this embodiment, such an NOx absorbing reducing catalyst 61 is utilized to effect a well known "rich spike control". Namely, if the operation is continued at the lean air/fuel ratio, NOx absorbed to the above-described catalyst 61 is saturated as described above, and there is a fear that the excess of NOx would be discharged while contained in the exhaust gas.

Accordingly, in this control, the closing control of the throttle valve 23 by the ECU 30 is performed, and the air/fuel ratio is temporarily forcibly controlled to be enriched in view of a predetermined timing judged by a count value of the rich spike condition establishing counter. With such a control, the amount of HC contained in the exhaust gas is increased, and the NOx is reduced to the nitrogen gas to be discharged into the atmosphere.

Incidentally, the above-described count is incremented by one in response to the load and the engine revolution speed. When the count value reaches the predetermined value, the rich spike control is executed. Also, after the completion of the rich spike control, the above-described count value is cleared to zero. Then, the same process is repeated.

Figure 47:
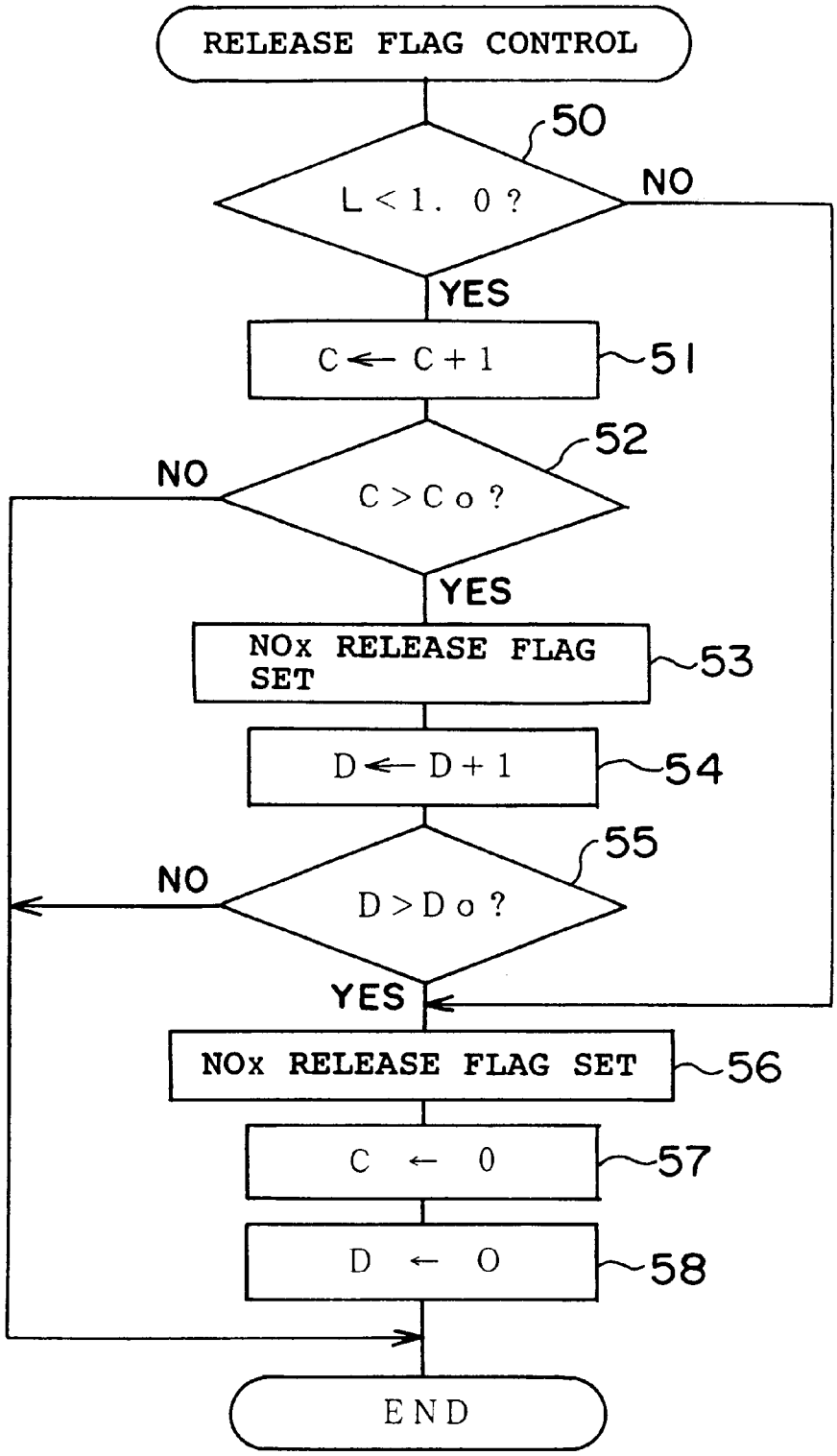
FIG. 47 is a flowchart showing an example of a control routine of an NOx release flag.

An example of the control routine of an NOx discharged flag is shown in FIG. 47. This routine is executed by an interrupt at a constant time interval.

First of all, in step 50, it is judged whether or not the compensation coefficient L is less than 1.0, that is; the lean mixture is burnt. When $L\geqq1.0$, that is; the mixture fed into the combustion chamber is in the stoichiometric ratio or on the rich side, the process shifts to step 56. The NOx release flag is reset. Subsequently, in step 57, the count value C is zero, and in the same manner, in step 58, the count value D is zero.

In contrast, if, in step 50, it is judged that $L<1.0$, that is; the lean combustion is effected, the process shifts to step 51 in which the count value C is incremented by one. Subsequently, in step 52, it is judged whether or not the count value C exceeds a constant value $C_0$. If $C>C_0$, the process shifts to step 53 in which the NOx discharge flag is reset. Subsequently, in step 54, the count value D is incremented by one. Subsequently, in step 55, it is judged whether or not the count value D exceeds a constant value $D_0$. If $D>D_0$, the process shifts to step 56 in which the NOx discharge flag is set. Namely, if a constant time, for example, 5 minutes, lapses until the lean mixture combustion is expressed by $C>C_0$, the NOx release flag is set. Thereafter a constant time, for example, 5 minutes, lapses until the relationship $D>D_0$ is established, the NOx release flag is continuously set. When the NOx discharge flag is set, the mixture fed to the combustion chamber of each engine cylinder is enriched.

Subsequently, the purge controlling unit 81 as the fuel vapor feeding means mounted for feeding the fuel vapor into the intake duct will be described.

As shown in FIG. 45, the purge control unit 81 is provided with the canister 83 having an activated charcoal layer 82. A fuel vapor chamber 84 and an air chamber 85 are formed on both sides of the activated charcoal layer 82 within the canister 83.

A part of the fuel vapor chamber 84 is formed in an upper space of the fuel tank 89 through a solenoid opening/closing valve 87, and the other part is connected to the intake duct 20 downstream of the throttle valve 23 through the purge controlling valve 86 composed of a solenoid valve as the adjusting means and a throttle valve 90 for allowing the flow only in the direction toward the intake duct 20 to the fuel vapor chamber 84.

Also, the air chamber 85 is in communication with an air intake inlet 91 in the intake duct 20 upstream of the throttle valve 23. The upper space of the fuel reservoir 89 is connected the interior of the intake duct downstream of the air intake inlet 91 and upstream of the throttle valve 23. A pressure sensor 92 is mounted on the upper space of the fuel reservoir 89.

As described above, the air intake inlet 91 is opened to the upstream side of the intake air flow. Accordingly, a dynamic pressure is applied to the air intake inlet 91. Accordingly, the pressure within the canister 83 is somewhat higher than the atmospheric pressure. On the other hand, the solenoid valve 87 is opened. At this time, if the pressure of the upper space of the fuel reservoir 89 is higher than the pressure within the canister 83, the fuel vapor generated in the fuel reservoir 89 is caused to flow into the fuel vapor chamber 84 through the solenoid opening/closing valve 87. Subsequently, the fuel vapor is absorbed into the activated charcoal within the activated charcoal layer 82. When the solenoid valve 86 is opened, the air that has introduced into the air intake inlet 91 is fed into the air chamber 85 and subsequently, the air is fed to the activated charcoal layer 82.

The fuel that has been absorbed in the activated charcoal is released, and the air containing the fuel component is caused to flow into the fuel vapor chamber 84. Subsequently, the air including the fuel component is fed into the intake duct 20 through the check valve 90 and the solenoid opening/closing valve 86. In the embodiment, the throttle valve 23 is maintained in the fully opened condition except for the extremely low load mode in the stratified combustion. Even if the throttle valve 23 is thus substantially in the fully opened condition, the dynamic pressure is applied to the air intake inlet 91 so that the fuel vapor may be fed into the intake duct 20.

On the other hand, if the solenoid opening/closing valve 88 is opened and the pressure of the upper space of the fuel reservoir 89 at this time is higher than the atmospheric pressure, the fuel vapor generated in the fuel reservoir 89 is fed to the intake duct 20 through the solenoid opening/closing valve 88. Incidentally, in this embodiment, the solenoid opening/closing valve 88 is opened when the pressure in the upper space of the fuel tank 89 is not at the atmospheric pressure but somewhat higher than the atmospheric pressure.

Also, in the above-described embodiment, if the solenoid opening/closing valve 86 is opened, the fuel vapor absorbed in the activated charcoal layer 82 of the canister 83 is fed into the intake duct 20, and if the solenoid opening/closing valve 88 is opened, the fuel vapor generated in the fuel tank 89 is fed into the intake duct 20. Thus, in this embodiment, the fuel vapor may be fed not only from the canister 83 but also from the fuel reservoir 89 into the intake duct 20.

Figure 46:
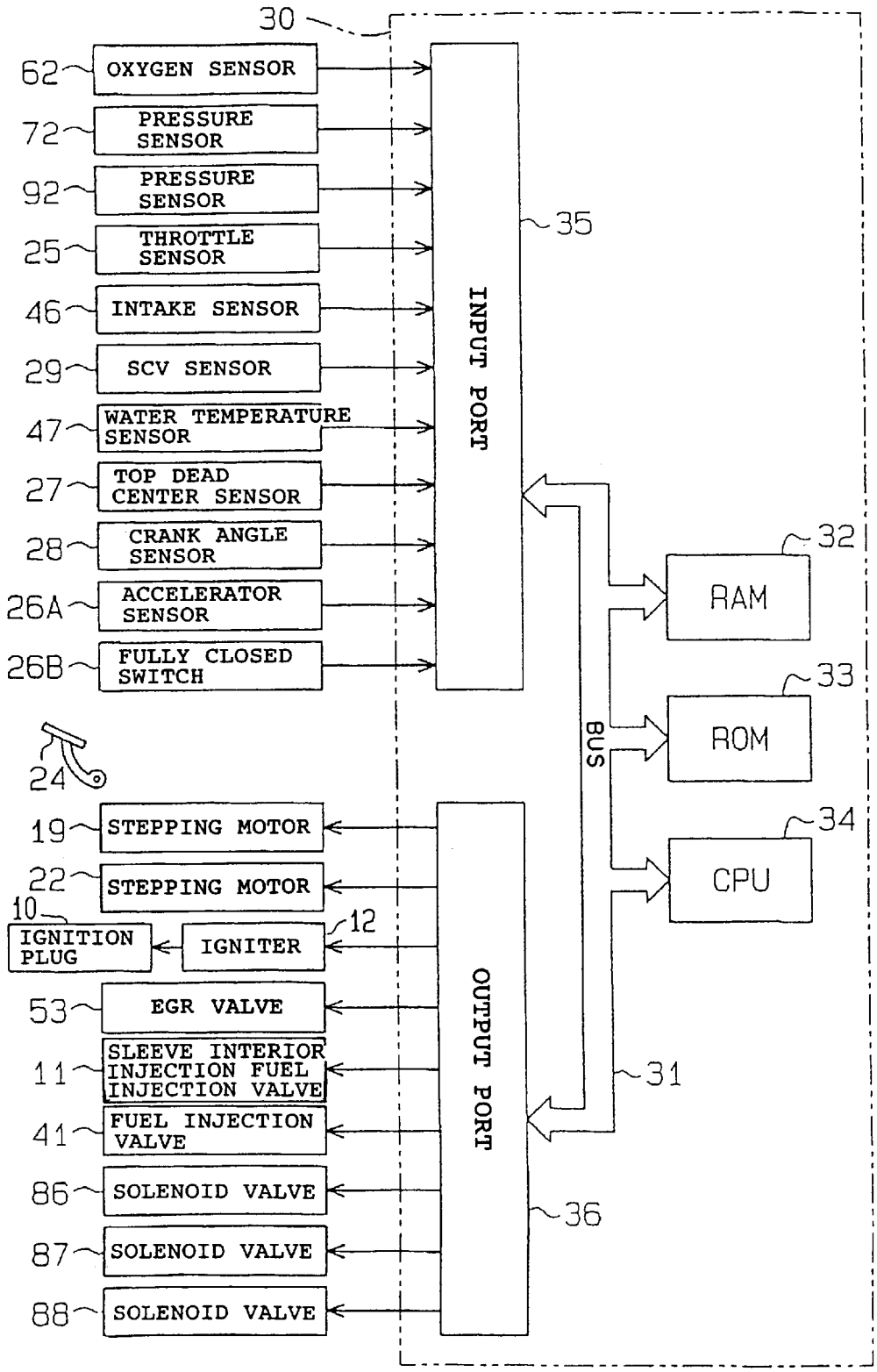
FIG. 46 is a block diagram showing an electric structure of an ECU.

By the way, as shown in FIGS. 45 and 46, the above-described ECU 30 is composed of a digital computer provided with a RAM (random access memory) 32, a ROM (read only memory) 33, a CPU (central processing unit) 34 composed of a microprocessor, an input port 35 and an output port 36 connected to each other through a two-way bus 31. In this embodiment, the judgement means and fuel controlling means are constituted by the ECU 30.

An accelerator sensor 26A is connected to an accelerator pedal 24 of the vehicle for generating an output voltage in proportion to a step amount of the accelerator pedal 24. An accelerator opening degree ACCP is detected by the accelerator sensor 26. The output voltage of the accelerator sensor 26A is inputted into the input port 35 through an AD convertor. A fully closed switch 26B is provided to the accelerator pedal 24 for detecting the condition that the step amount of the accelerator pedal 24 is zero. Namely, the fully closed switch 26B generate a "1" signal as a fully closed signal. in the case where the step amount of the accelerator pedal 24 is zero and generates a zero signal in other cases. Then, the output voltage of the fully closed switch 26B is inputted into the input port 35.

Also, for example, a top dead center sensor 27 generates an output pulse when the piston of the first cylinder la reaches the intake top dead center. This output pulse is inputted into the input port 35. A crank angle sensor 28 generates an output pulse through every 30° CA rotation of the crankshaft. This output pulse is inputted into the input port. The CPU 34 calculates the engine revolution speed NE (or read in) from the output pulse of the top dead center sensor 27 and the output pulse of the crank angle sensor 28.

Furthermore, the rotational angle of the above-described shaft 18 is detected by a swirl control valve sensor 29 by which the opening degree of the swirl control valve 17 may be detected. Then, the output of the swirl control valve sensor 29 is inputted into the input port 35 through the A/D convertor 37.

In addition, the throttle opening degree TA is detected by the throttle sensor 25. The output of the throttle sensor 25 is inputted into the input port 35 through the A/D convertor 37.

In addition, in this embodiment, an intake pressure sensor 46 is provided for detecting a pressure (intake pressure) within the surge tank 16. Furthermore, a water temperature sensor 47 is provided for detecting a temperature of cooling water for the engine 1 (cooling water temperature). Also, the oxygen sensor 62 is provided in the exhaust duct 13. Also, the outputs of these sensors 46, 47 and 62 are inputted into the input port 35 through the A/D convertor 37.

In this embodiment, the operational condition detecting means is constituted by the throttle sensor 25, the accelerator sensor 26A, the fully closed switch 26B, the top dead center sensor 27, the crank angle sensor 28, the swirl control valve sensor 29, the intake pressure sensor 46, the water temperature sensor 47, the oxygen sensor 62, pressure sensors 72 and 92 and the like.

On the other hand, connected through the associated driver circuit to the output port 36 are the respective fuel injection valves 11 and 41, the respective stepping motors 19 and 22, the ignitor 12, the EGR valve 53 (stepping motor), the respective solenoid opening/closing valves 86 to 88 and so on. The fuel injection valves 11 and 41, the stepping motors 19 and 22, the ignitor 12, the EGR valve 53 (stepping motor), the respective solenoid valves 86 to 88 and the like are suitable controlled in accordance with the control program stored in the ROM 33 on the basis of the signals of respective sensors and the like 25 to 29, 46, 47, 62, 72 and 92 by the ECU 30.

The programs for the various controls in the fuel vapor feed controlling apparatus for the engine provided with the above-described structure in accordance with the first embodiment will now be described with reference to the flowchart shown in FIG. 48.

Figure 48:
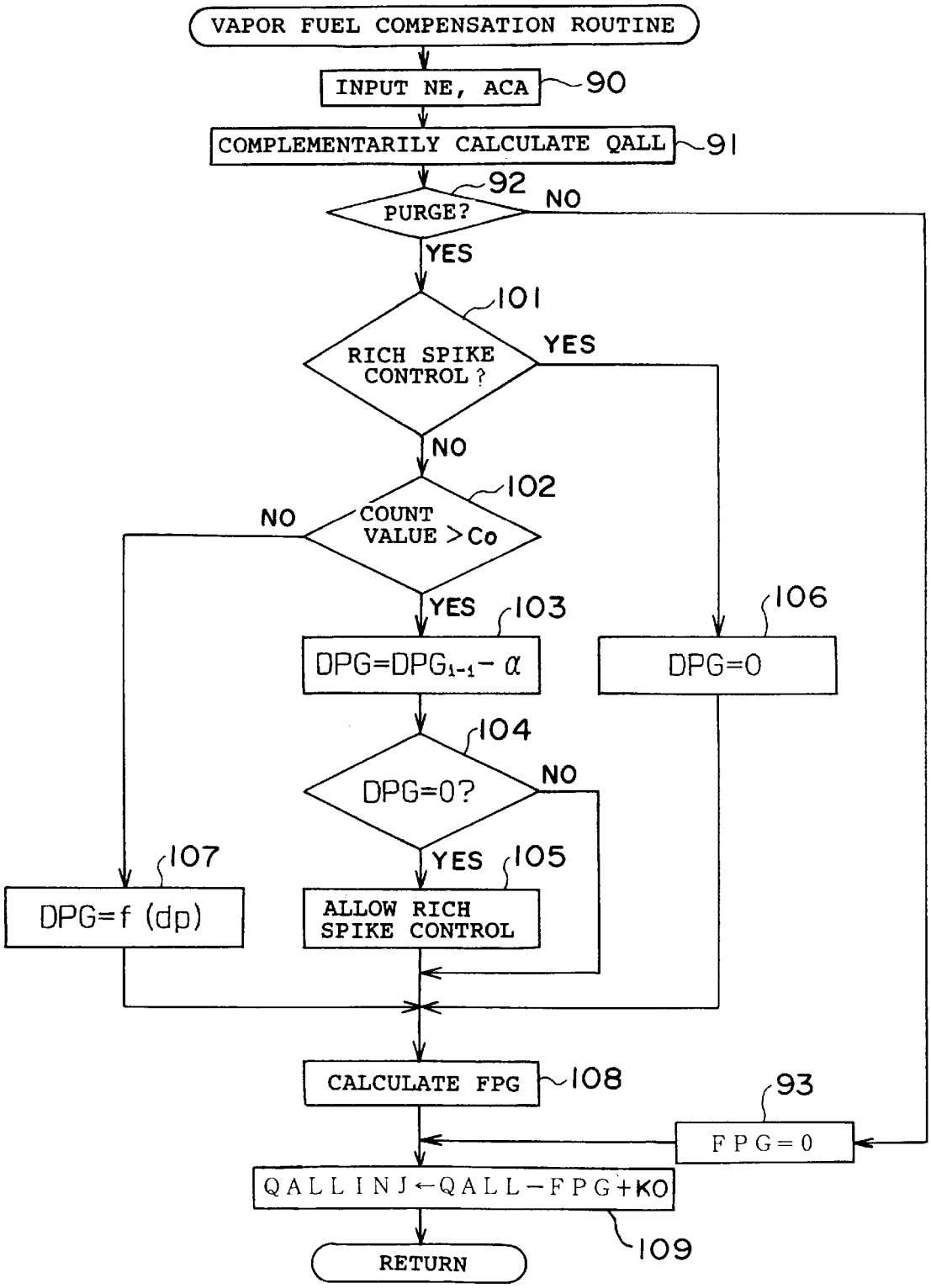
FIG. 48 is a flowchart showing a "fuel vapor feed controlling routine" executed by the ECU.

Namely, FIG. 48 is a flowchart showing a "fuel vapor feed controlling routine" for controlling the purge and executing the control of the fuel vapor fed to the intake duct by controlling t h e solenoid opening/closing valve 86 according to this embodiment. This control is executed by the above-described ECU 30. This example executes the feature of item (6-1).

Incidentally, if the purge execution conditions: for example, i) the warming-up completion; ii) the state where a predetermined time has lapsed after the start; and iii) the state where the fuel injection amount is equal to or more than the minimum fuel injection amount for establishing the combustion are all met, the purge execution flag is turned on to start the purge.

Then, in case of the duty control system, the opening degree of the solenoid opening/closing valve 86 for controlling the purge amount is gradually increased from the duty ratio of 0% (fully closed) to the duty ratio corresponding to the engine operational condition (fuel injection amount). Then, if the purge prohibition condition, for example, fuel interrupt execution or the like is met, the purge is interrupted.

Also, since the fuel vapor is fed to the internal combustion engine by the purge, the fuel injection amount to be fed to the internal combustion engine is compensated for by the fuel vapor compensation amount FPG corresponding to the fuel vapor to be fed.

Namely, final fuel injection amount QALLINJ=basic fuel injection amount QALL−fuel vapor amount compensation amount FPG+K formula (1).

where K is the variety of compensation coefficients such as the warming-up increment coefficient, the acceleration increment coefficient, the deceleration compensation coefficient and the reducing agent amount coefficient to be described later.

With such prerequisites, the process shown in FIG. 48 will now be described.

In the purge control, in the process shown in FIG. 48, first of all, the engine revolution speed NE and the accelerator opening degree ACA are inputted in to ECU 30 (step 90). Subsequently, the basic fuel injection amount QALL is calculated in accordance with the inputted engine revolution speed and accelerator opening degree (step 91).

Namely, first of all, the basic fuel injection amount corresponding to the engine revolution speed and the accelerator opening degree is complementarlly calculated from a map for determining the mutual relationship between the engine revolution speed and the accelerator opening degree. Incidentally, a plurality of maps are prepared in correspondence with the operational condition or combustion condition. One is selectively used from the maps.

In step 92, it is judged whether the purge is effected. If so, in step 101, it is judged whether or not the rich spike control is currently effected. Then, in the case where it is judged that the rich spike control is executed, it is judged that the feed of the fuel vapor is not suitable. In step 106, the duty ratio DPG corresponding to the opening degree of the solenoid opening/closing valve 86 is made zero to once complete the process thereafter. Namely, in the case where it is judged that the rich spike control is executed, the fuel vapor supply is interrupted.

On the other hand, in step 101, in the case where it is judged that the rich spike control is not currently effected, the process shifts to step 102. It is judged whether or not the count value of the rich spike condition establishment counter exceeds a predetermined value $C_0$ set in advance. The rich spike condition establishment counter value is counted by the ECU 30 on the basis of the predetermined conditions in accordance with the flowchart shown in FIG. 47 as mentioned above. It is reset after the completion of the rich spike control and is recounted. It is judged that the count value of the rich spike condition establishment counter is equal to or less than the predetermined value $C_0$, the duty ratio DPG is calculated in step 107 on the basis of the differential pressure dp between the atmospheric pressure and the pressure within the intake duct 20.

Incidentally, the function f used in this calculation is conventionally adopted corresponding to the differential pressure dp. The flow rate of the fuel vapor is controlled by the opening degree of the solenoid opening/closing valve 86 in accordance with the calculation result. Also, the intake pressure obtained by the intake pressure sensor 46 in, for example, the engine start is recorded and utilized as the atmospheric pressure for calculating the differential pressure dp. On the other hand, the intake pressure obtained by the intake sensor 46 is utilized as the pressure of the intake duct 20 every time.

Also, in step 102, it is judged that the count value of the rich spike condition establishment counter exceeds the predetermined value $C_0$, for a while, it is inferred that the rich spike control is effected. The process shifts to step 103. In step 103, a predetermined value $\alpha$ is subtracted from the previous duty ratio $DPG_{i-1}$. Namely, the solenoid opening/closing valve 86 is gradually decreased to reduce the flow rate of the fuel vapor. Thereafter, the process shifts to step 104.

In step 104, it is judged whether or not the above-described duty ratio DPG is zero. In the case where it is judged that the above-described duty ratio DPG is not zero, the process thereafter is once stopped. Namely, so far as the feed of the fuel vapor is not stopped by the step 103 process, the opening degree of the solenoid opening/closing valve 86 is controlled on the basis of the duty ratio DPG obtained in step 103 to control the feed of the fuel vapor.

On the other hand, in step 104, it is judged that the above-described duty ratio DPG is zero, the process shifts to step 105. In step 105, the execution of the rich spike control is allowed. Namely, after it is confirmed that the feed of the fuel vapor is stopped, the rich spike control is executed.

Thereafter, in step 108, the fuel vapor amount compensation amount is converted from the duty ratio. Namely, []since the purge amount is determined by the intake pipe vacuum ab -pressure and the opening degree of the purge control valve determined by the duty ratio, if the fuel vapor concentration in the purge gas is known, the fuel vapor amount is known. Since this fuel vapor amount is fed to the internal combustion engine, in step 109, the fuel vapor amount is subtracted from the predetermined basic fuel injection amount as the compensation amount in accordance with the following formula (1):

final fuel injection amount QALLINJ=basic fuel injection amount QALL−fuel vapor amount compensation amount FPG+K0 . . . (1) where K0 the reducer amount coefficient determingin the amount of the reducer (HC) needed for purifying NOx. Thus, the fuel injection amount to be finally fed to the internal combustion engine is compensated for.

Incidentally, in the case whe re, in step 92, it is judged that the purge is not effected, in step 93, the fuel vapor amount compensation amount is zero and the final fuel injection amount QALLINJ is the basic fuel injection amount QALL+K0. Thereafter, the fuel injection is performed in accordance with the fuel injection program determined separately.

Subsequently, the effect and operation of the embodiment will be described.

(a) In this embodiment, when NOx to be trapped by the catalyst 61 is saturated in the stratified combustion, in order to forcibly release and purify the NOx, the rich spike control is executed. At this time, the throttle valve 23 is temporarily closed, the air/fuel ratio is close to the stoichiometric a/f ratio or more enriched. For this, ECU 30 reduces the duty ratio DPG, and made it zero thereafter by controlling the opening degree of the solenoid opening/closing valve 86 so that the fuel vapor to be fed from the purge controlling unit 81 to the intake duct 20 is reduced or interrupted. For this reason, in the rich spike control, it is possible to moderate the adverse affect given to the air/fuel ratio by the fuel vapor. Accordingly, the air/fuel ratio is well controlled and would not be disturbed. As a result, it is possible to prevent the generation of the rich misfire or the like, which leads to the maintenance of the good drivability.

(b) Also, ECU 30 measures the start timing of the rich spike control from the count value of the rich spike control establishment counter, and gradually decreases the duty ratio DPG before the execution of the rich spike control. For this reason, it is possible to prevent the abrupt variation of the air/fuel ratio before and after the start of the rich spike control. Accordingly, it is possible to further ensure the effect (a) above.

Incidentally, in the first embodiment, the predetermined value $\alpha$ for the duty ratio DPG in step 103 is constant. However, it is possible to use the variable in response to the operational condition.

Also, in the first embodiment, the reduction of the predetermined value α for the duty ratio DPG in step 103 is repeated to gradually reduce the duty ratio DPG down to zero. It is possible to make the duty ratio DPG zero at once.

<second form according to the fifth feature>

A second form embodying the present invention will now be described. However, the structure or the like is substantially the same as that of the first form of the invention. Its explanation will be omitted. The difference therebetween will be described. This example executes the features of (6-2) and (6-3).

In the first form, the execution condition of the rich spike control is judged, and the solenoid opening/closing valve 86 is controlled on the basis of the judgement result to thereby control the fuel vapor to be fed to the intake duct 20. In contrast, in this embodiment, when the vacuum pressure of the intake duct 20 is increased and the intake amount is throttled so that the vacuum pressure within the brake booster 71 may be produced and maintained. In this condition, it is characterized in that the above-described fuel vapor amount is controlled.

Figure 49:
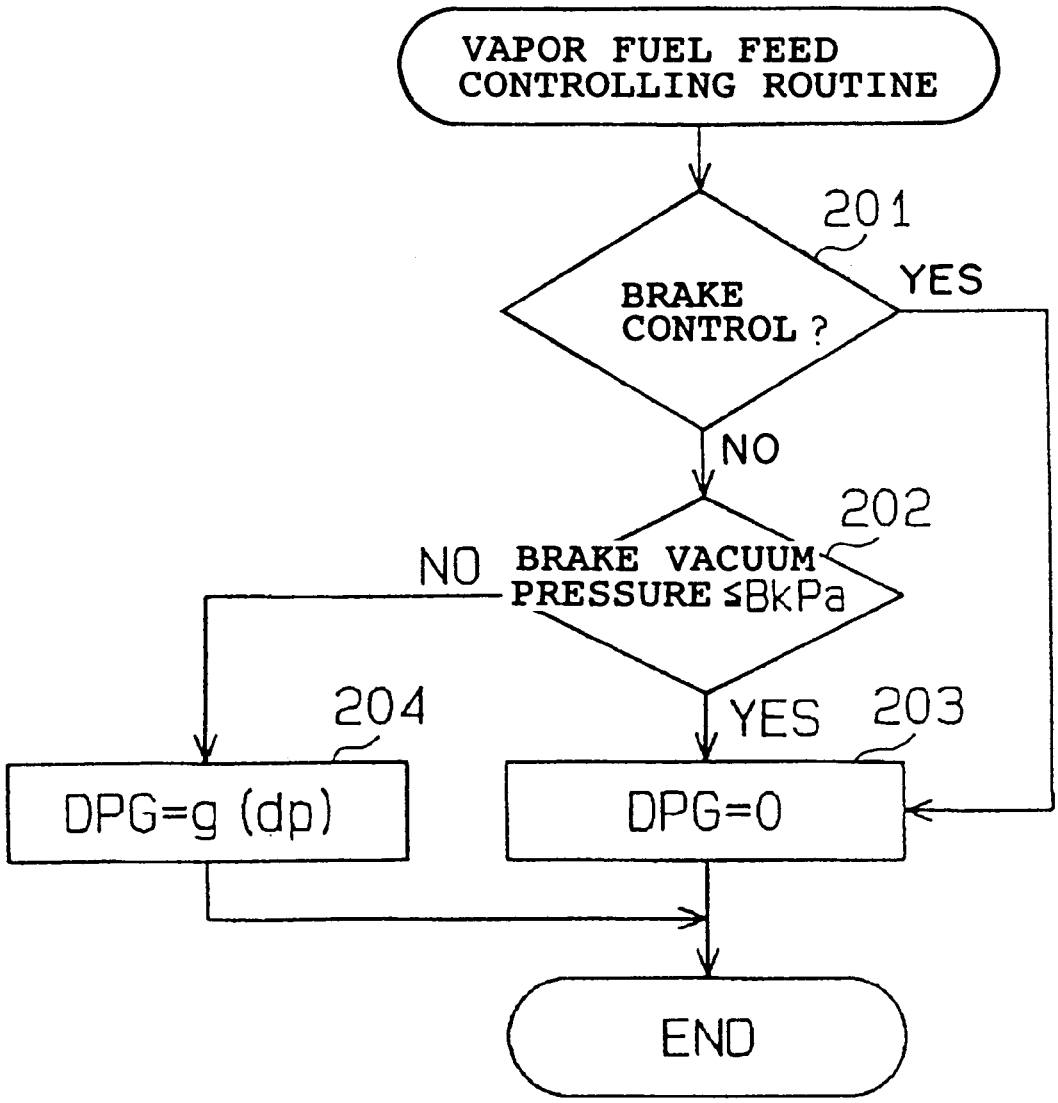
FIG. 49 is another flowchart showing a "fuel vapor feed controlling routine"

FIG. 49 is a flowchart showing a "fuel vapor control routine" for executing the control of the fuel vapor in this embodiment, and to be executed by ECU 30 instead of the steps 101 to step 107 shown in FIG. 48 as a main routine.

When the process shifts to this routine, first of all, ECU 30 judges in step 201 whether or not the brake control is currently effected. Then, in the case where it is judged that the brake control is effected, it is judged that the feed of the fuel vapor is not suitable. In step 203, the duty ratio DPG is made zero to once complete the process thereafter. Namely, in the case where it is judged that the brake control is executed, the fuel vapor supply is interrupted.

On the other hand, in step 201, in the case where it is judged that the brake control is not currently effected, the process shifts to step 202. In step 202, it is judged whether or not the brake vacuum pressure exceeds a predetermined value BkPa (absolute value) set in advance. In this case, the predetermined BkPa means the value at which the brake vacuum maintenance process is executed in the case where the brake vacuum pressure becomes the above-described value +a constant value. If it is judged that the brake vacuum pressure exceeds the predetermined value BkPa, in step 204, the duty ratio DPG is calculated on the basis of the above-described differential pressure dp to once finish the process thereafter. Namely, the duty ratio DPG is calculated as a function g of the differential pressure dp. The flow rate of the fuel vapor is controlled by the opening degree of the solenoid opening/closing valve 86 in accordance with the calculation result.

Also, in step 202, in the case where it is judged that the brake vacuum pressure is equal to or less than the above-described predetermined value BkPa, it is inferred that, for a while, a process for maintaining the brake vacuum pressure (process for temporarily closing the throttle valve 23 and enriching the air/fuel ratio close to the stoichiometric air/fuel ratio) is executed. In step 203, the duty ratio DPG is made zero and the process thereafter is once stopped. Namely, in the case where it is judged that the brake vacuum pressure maintenance process will be executed soon, the fuel vapor feed is interrupted.

The effect and operation of this embodiment will now be described.

(a) In this embodiment, when the vacuum pressure within the brake booster 71 for assisting the brake operation by the vacuum pressure is insufficient, the brake vacuum pressure is maintained. At this time, the throttle valve 23 is temporarily closed, the air/fuel ratio is close to the stoichiometric a/f ratio or more enriched. For this, ECU 30 reduces the duty ratio DPG, and made it zero thereafter by controlling the opening degree of the solenoid opening/closing valve 86 so that the fuel vapor to be fed from the purge controlling unit 81 to the intake duct 20 is reduced or interrupted. For this reason, in the rich spike control, it is possible to moderate the adverse affect given to the air/fuel ratio by the fuel vapor. Accordingly, the air/fuel ratio is well controlled and would not be disturbed. As a result, it is possible to prevent the generation of the rich misfire or the like, which leads to the maintenance of the good drivability.

In particular, in the sleeve interior injection type internal combustion engine, since the throttle valve is normally operated at a full throttle in many cases, when the brake is effected, the brake booster vacuum pressure has to be generated every time. The production of the vacuum pressure is attained by temporarily closing the throttle valve. However, in this case, the air/fuel ratio is temporarily enriched to bring about a fear of misfire. Accordingly, in such a case, as described above, the feed of the fuel vapor is restricted to thereby prevent the misfire. Thus, this example is very effective for the sleeve interior injection type internal combustion engine.

In the second embodiment, the duty ratio DPG is made zero at once in step 203. However, it may gradually reduce the duty ratio DPG. If it is reduced gradually, it is possible to suppress the abrupt combustion change upon switching.

The vacuum pressure production means is made by an electronic type throttle mechanism composed of the throttle valve 23 provided in the intake duct 20 and the stepping motor 22 as an actuator for opening/closing the throttle valve 23. However, as another modification, this may be made by an ISC mechanism composed of an idle speed control valve provided in a bypass passage around the throttle valve 23 and an actuator for opening/closing the ISC valve.

Also, the EGR device 51 provided with the above-described EGR valve 53 or the like may be used.

Furthermore, a vacuum pressure producing mechanism (not shown) may be discretely provided. In these cases, a mechanical type throttle valve linked to the accelerator pedal 24 may be used instead of the so-called electronic control type throttle valve 23.

Furthermore, these mechanisms may be combined together to form the vacuum production means.

<third form according to the fifth feature>

A third form embodying the present invention will now be described. However, the structure or the like is substantially the same as that of the first form of the invention. Its explanation will be omitted. The difference therebetween will mainly be described.

In the first form, the execution condition of the rich spike control is judged, and the solenoid opening/closing valve 86 is controlled on the basis of the judgement result to thereby control the fuel vapor to be fed to the intake duct 20. In contrast, in this embodiment, the reduction of the intake density in, for example, a high land is detected by the output of the intake pressure sensor 46 to thereby control the fuel vapor. This example executes the feature of (6-4).

Figure 50:
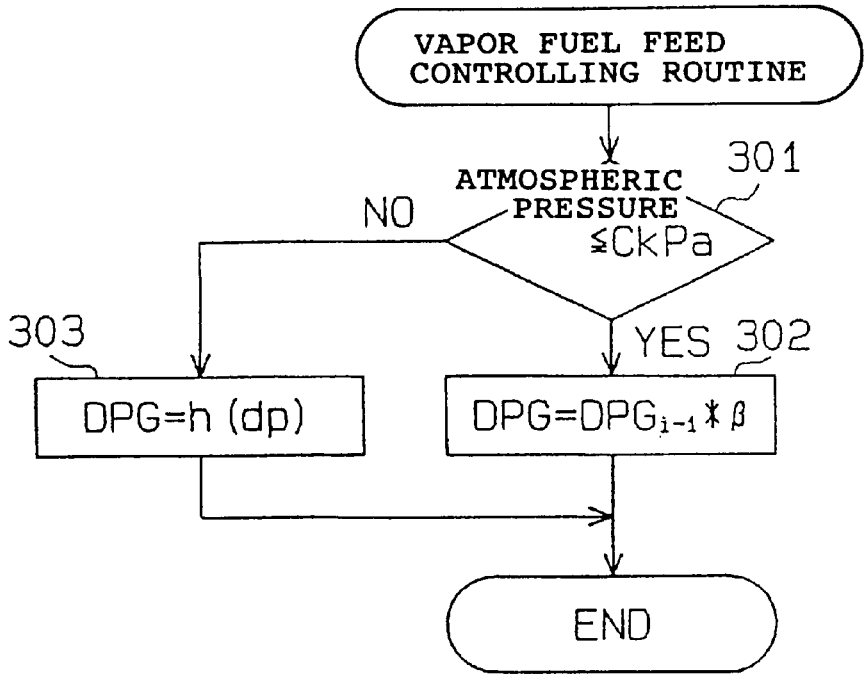
FIG. 50 is still another flowchart showing a "fuel vapor feed controlling routine"

FIG. 50 is a flowchart showing a "fuel vapor control routine" for executing the control of the fuel vapor in this embodiment, and to be executed by ECU 30 instead of the steps 101 to step 107 shown in FIG. 48 as a main routine.

When the process shifts to this routine, first of all, ECU 30 judges in step 301 whether or not the atmospheric pressure is higher than a predetermined value CkPa set in advance. Then, in the case where it is judged that the atmospheric pressure exceeds the above-described predetermined value CkPa, in step 303, the duty ratio DPG is calculated on the basis of the differential pressure dp to once stop the process thereafter. Namely, it is judged that the reduction of the intake density is not effected, and the as usual, the duty ratio DPG is calculated as a function h of the differential pressure dp. The opening degree of the solenoid opening/closing valve 86 is controlled on the basis of the result, so that the flow rate of the fuel vapor is controlled.

Figure 51:
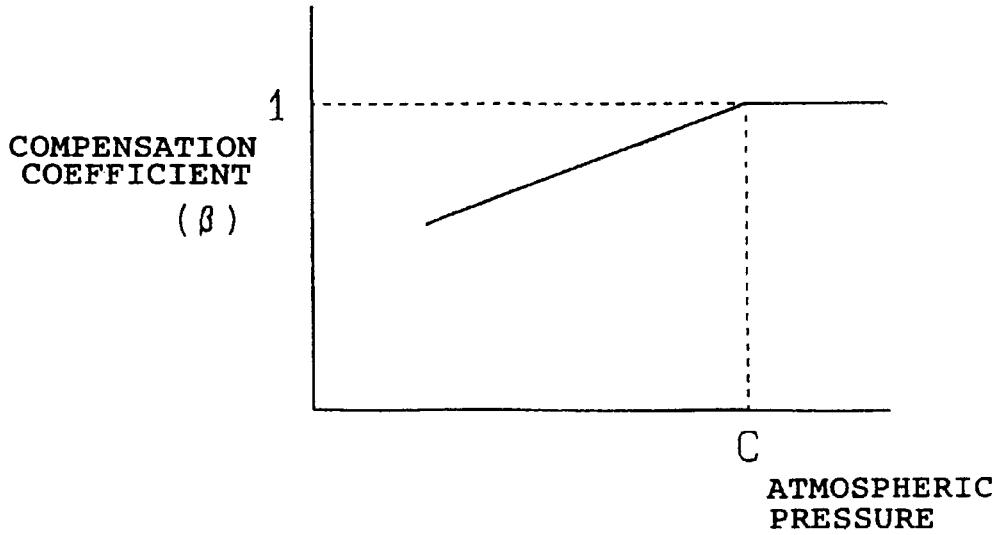
FIG. 51 is a map showing a relationship between the atmospheric pressure and the compensation coefficient.

Also, in step 301, it is judged that the atmospheric pressure is equal to or less than the above-described predetermined value CkPa, the value obtained by multiplying the previous duty ratio $DPG_{i-1}$ by a compensation coefficient β ($0 \leqq \beta \leqq 1$) obtained from the correspondence with the atmospheric pressure shown in FIG. 51 is set as a new duty ratio DPG. The process thereafter is once stopped. Namely, through this step 302, the duty ratio DPG is gradually reduced.

The effect and operation of this embodiment will now be described.

(a) In this embodiment, in the stratified combustion condition, since the air density (intake density) is low in a high land, the air/fuel ratio is likely to be enriched in comparison with the low land. For this, when the atmospheric pressure is low (air density is low), ECU 30 reduces the duty ratio DPG, and made it zero thereafter by controlling the opening degree of the solenoid opening/closing valve 86 so that the fuel vapor to be fed from the purge controlling unit 81 to the intake duct 20 is reduced or interrupted. For this reason, in the high land, it is possible to moderate the adverse affect given to the air/fuel ratio by the fuel vapor. Accordingly, the air/fuel ratio is well controlled and would not be disturbed. As a result, it is possible to prevent the generation of the rich misfire or the like, which leads to the maintenance of the good drivability.

In the third embodiment, as shown in FIG. 51, the value of the compensation coefficient X is changed in a linear manner corresponding to the atmospheric pressure. However, any other desired curve may be used if it has characteristics gradually increasing up to the predetermined value CkPa corresponding to the atmospheric pressure.

<forth form of the fifth feature>

In the fourth form, the control by the fuel vapor compensation amount FPG is added in accordance with the above-described formula (1) to the control of DPG in the first embodiment in order to compensate for the basic fuel injection amount.

When the purge control valve is controlled by controlling DPG and the purge amount is controlled in the increment direction, the fuel vapor amount to be added to the basic fuel injection amount is increased. Accordingly, if no countermeasure is effected, in some cases, the air/fuel ratio is too excessive. Accordingly, the fuel vapor amount compensation amount FPG is obtained corresponding to the increment of the DPG so that the fuel vapor amount compensation amount FPG is reduced from the basic fuel injection amount to be injected from the fuel injection valve to avoid the abrupt enriched condition.

Subsequently, an example of the fuel injection control including a purge control of this embodiment will be described with reference to a flowchart shown in FIG. 52. This is an example to compensate for the fuel vapor amount in correspondence with the engine revolution speed.

First of all, the engine revolution speed NE and the accelerator opening degree ACA are inputted (step 681). Subsequently, the basic fuel injection amount QALL is complementarlly calculated in accordance with the inputted engine revolution speed and accelerator opening degree (step 682).

Namely, the basic fuel injection amount corresponding to the engine revolution speed and the accelerator opening degree is complementarlly calculated from a map (not shown) for determining the mutual relationship between the engine revolution speed and the accelerator opening degree.

In step 683, it is judged whether or not the purge is effected. If it is in the purge, the throttle valve opening degree TA and the engine revolution speed NE are read in (step 684).

Figure 53:
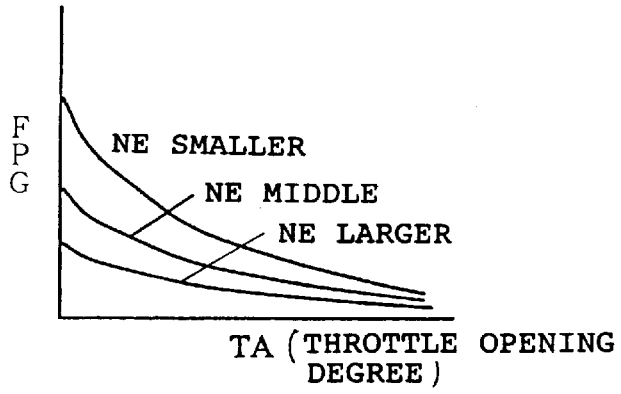
FIG. 53 is a map for determining a relative relation among a throttle valve opening degree TA, a fuel vapor amount compensation amount FPG and an engine revolution speed NE.

Next, the fuel vapor amount compensation amount (FPG) is calculated (step 685). This calculation is effected from the mutual relationship (see FIG. 53) between the fuel vapor amount compensation amount (FPG) and the throttle valve opening degree TA and the engine revolution speed NE stored in the ROM in the form of a map in advance. Incidentally, in FIG. 53, HIGH, INTERMEDIATE and LOW are drawn to the engine revolution speeds. The smaller the engine revolution speed, the more the fuel vapor amount compensation amount will become.

In the case where, in step 683, the operation is out of the purge, in step 687, the fuel vapor amount compensation amount is zero.

After the fuel vapor amount compensation amount FPG is determined in steps 685 and 687, the process shifts to step 686 to determine the final fuel injection amount QALLINJ. In this case, the final fuel injection amount QALLINJ is determined by subtracting the fuel vapor amount compensation amount FPG from the basic fuel injection amount QALL calculated in advance in step 682 and adding the compensation coefficient K.

Thereafter, the fuel injection is effected in accordance with the fuel injection program determined separately.

Figure 54:
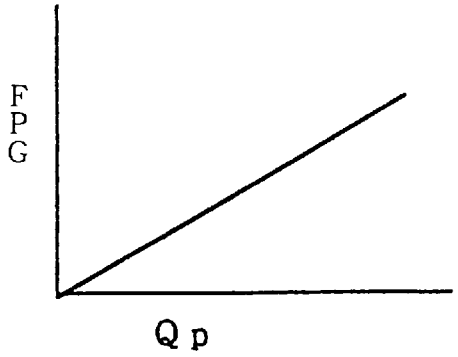
FIG. 54 is a map for determining a relationship between the fuel vapor amount compensation amount FPG and the purge gas amount Qp.
Figure 55:
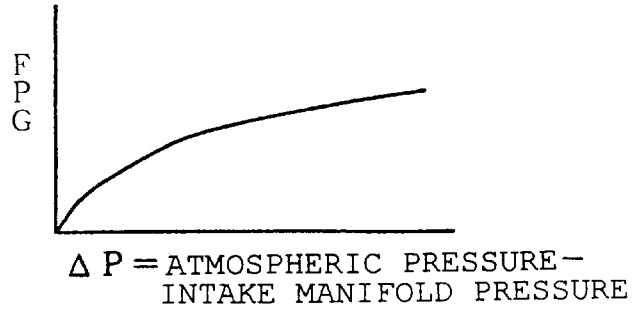
FIG. 55 is a map for determining a relationship between the fuel vapor amount compensation amount FPG and the difference between the atmospheric pressure and the intake manifold pressure.

Incidentally, other calculation methods of the fuel vapor amount compensation amount (FPG) are typically exemplified as a method for obtaining it from the purge gas amount Qp as shown in FIG. 54 and a method for obtaining it from the intake manifold pressure as shown in FIG. 55.

Figure 52:
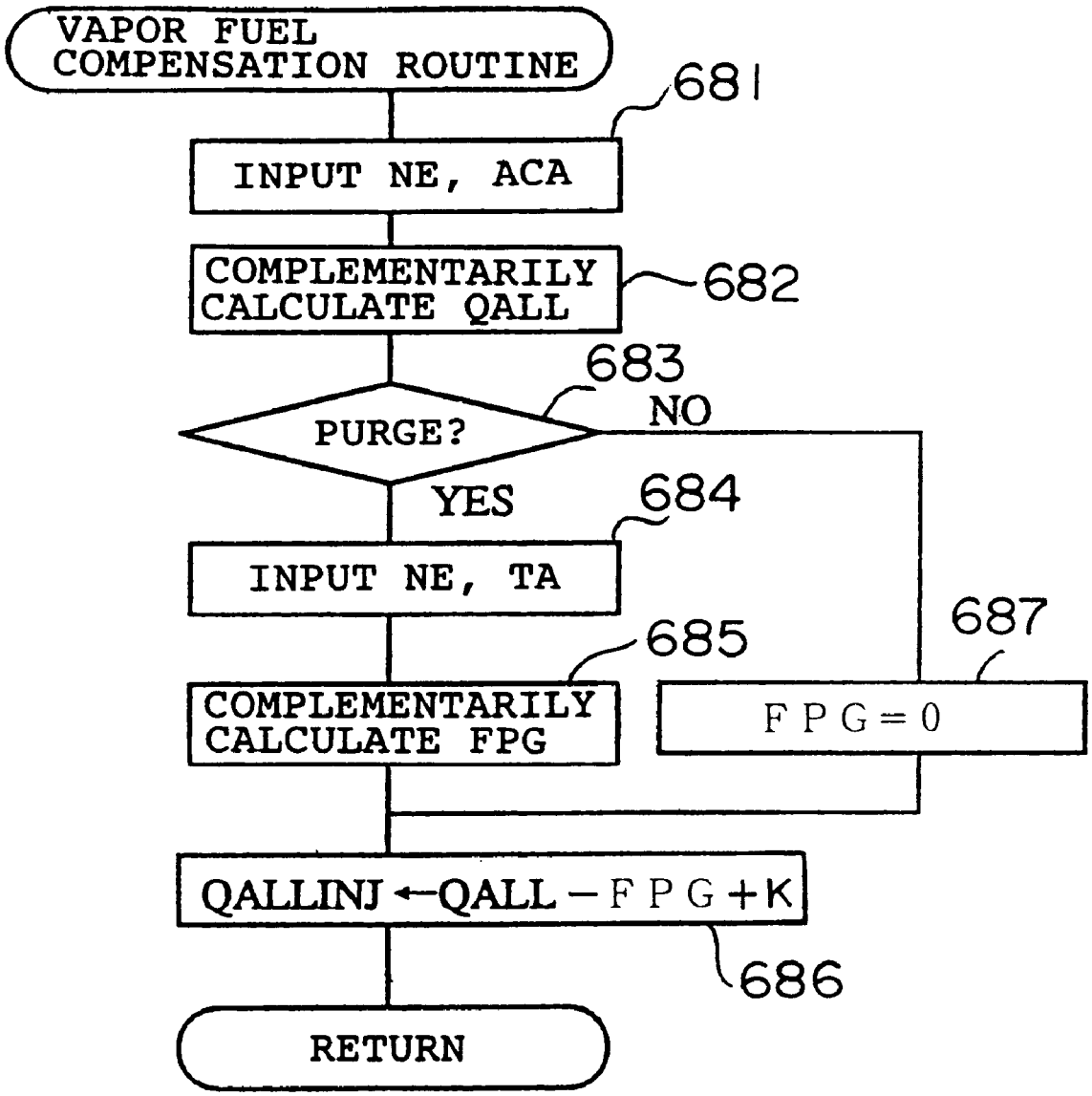
FIG. 52 is a flowchart showing a compensation control example of the fuel vapor amount.

Incidentally, the routine shown in FIG. 52 is repeatedly executed at a predetermined time interval.

Since the fuel vapor compensation amount is detected by such a routine, particularly, steps 684 and 685, a large amount of fuel vapor may be processed without any adverse affect to the drivability or the emission.

By the way, there are cases where the air/fuel ratio is enriched in an abrupt manner according to an operational condition during the purge control shown in FIG. 52. If the fuel vapor is continued to be supplied in such a case, an enriched air/fuel ratio is temporarily established exceeding the necessary level. Therefore, there is a fear of misfire or the like.

Therefore, as described below, the condition in which the air/fuel ratio is abruptly enriched is inferred by the judgement means, the fuel injection amount from the fuel injection valve is limited simultaneously with the feed of the fuel vapor or the restriction of the fuel vapor.

An example of controlling FPG will now be described with reference to FIG. 56. This executes the feature of (6-1). The FPG control may be used together with the DPG control as described above.

When the process shifts to this routine, first of all, _ ECU 30 judges in step 1101 whether or not the rich spike control is currently effected. Then, in the case where it is judged that the rich spike control is effected, it is judged that the feed of the fuel vapor is not suitable. In step 1106, the fuel vapor compensation amount FPG is made zero to once complete the process thereafter. Namely, in the case where it is judged that the rich spike control is executed, the final injection fuel amount is the sum of the basic injection fuel amount and K0 (where K0 is the reducer amount coefficient determining the amount of the reducer (HC) needed for purifying NOx) in accordance with the above-described formula (1).

On the other hand, in step 1101, in the case where it is judged that the rich spike control is not currently effected, the process shifts to step 1102. It is judged whether or not the count value of the rich spike condition establishment counter exceeds a predetermined value $C_0$ set in advance. The rich spike condition establishment counter value is counted by the ECU 30 on the basis of the predetermined conditions in accordance with the flowchart shown in FIG. 47 as mentioned above. It is reset after the completion of the rich spike control and is recounted. It is judged that the count value of the rich spike condition establishment counter is equal to or less than the predetermined value $C_0$, the duty ration DPG is calculated in step 1107 on the basis of the differential pressure dp between the atmospheric pressure and the pressure within the intake duct 20. The precess thereafter is once stopped.

Incidentally, the function f used in this calculation is conventionally adopted corresponding to the differential pressure dp. The intake pressure obtained by the intake pressure sensor 46 in, for example, the engine start is recorded and utilized as the atmospheric pressure for calculating the differential pressure dp. On the other hand, the intake pressure obtained by the intake sensor 46 is utilized as the pressure of the intake duct 20 every time. Then, the fuel injection amount is controlled in accordance with the fuel vapor compensation amount on the basis of the equation FPG=f (dp) calculated.

Also, in step 1102, it is judged that the count value of the rich spike condition establishment counter exceeds the predetermined value $C_0$, for a while, it is inferred that the rich spike control is effected. The process shifts to step 1103. In step 1103, a predetermined value $\alpha$ is subtracted from the previous duty ratio $DPG_{i-1}$.

The fact that FPG is reduced in comparison with the previous one means that the fuel injection amount to be finally fed to the engine is increased, according to the formula (1). Thereafter, the process shifts to step 1104.

Figure 61:
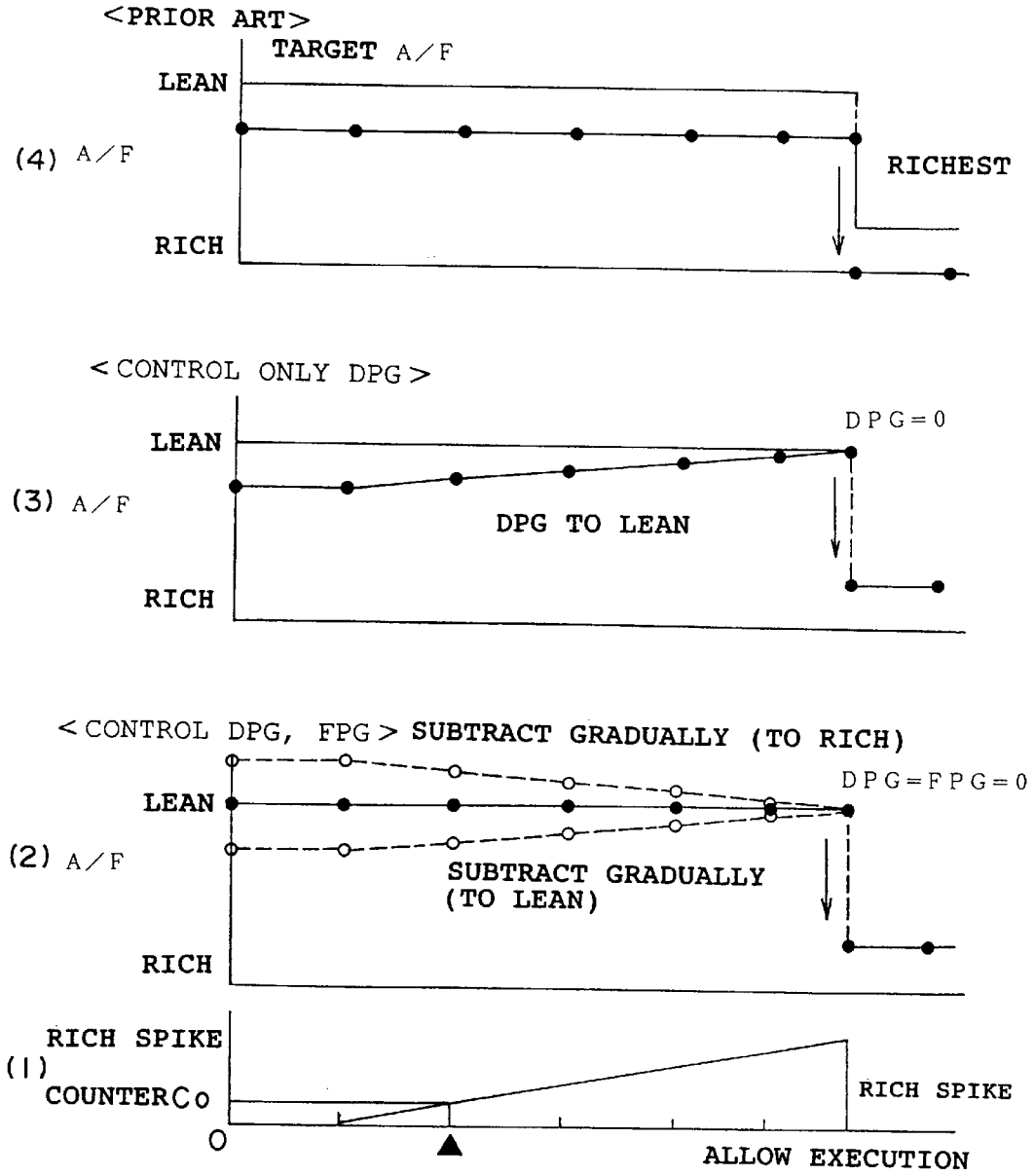
FIGS. 61(1) to 61(4) are timing charts showing a relationship between the rich spike control and the purge control.

In the meanwhile, as is apparent from FIG. 61(2), the DPG is gradually reduced and directed in the lean direction, and the FPG is gradually reduced and directed in the rich direction. Accordingly, the air/fuel ratio is kept at the required value.

In step 1104, it is judged whether or not the above-described duty ratio FPG is zero. In the case where it is judged that the above-described duty ratio FPG is not zero, the process thereafter is once stopped. The final fuel injection amount is increased on the basis of the FPG obtained in step 1103 until the fuel vapor compensation amount is made zero by the step 1103. Namely, the air/fuel ratio is shifted to the air/fuel ratio on the rich side corresponding to the rich spike.

Then, in step 1104, it is judged that the above-described duty ratio FPG is zero, the process shifts to step 1105. In step 1105, the execution of the rich spike control is allowed. The process thereafter is once completed.

Subsequently, the difference in control between the prior art and the embodiment will be described with reference to FIG. 61.

FIG. 61(1) shows a state in which the rich spike counter is counted up as explained in conjunction with FIG. 47. FIG. 61(4) shows the change of the air/fuel ratio before and after. the rich spike in the conventional purge execution and shows that a condition in which the air/fuel ratio is shifted to a richer air/fuel ratio than the necessary air/fuel ratio by the affect of the purge against the necessary air/fuel ratio before the rich spike is continued. If the rich spike is executed under the condition that the air/fuel ratio is deviated from the required air/fuel ratio without any change, the air/fuel ratio is kept in the condition that it is richer than that corresponding to the rich spike. Finally, there is a fear that the rich misfire would occur.

On the other hand, FIG. 61(3) shows a case where the DPG is only controlled in accordance with the embodiment. The DPG is gradually changed to the air/fuel ratio required by the condition in which the air/fuel ratio is richer than the necessary air/fuel ratio, by gradually subtracting it until the rich spike is executed. As a result, when the rich spike is executed, it may meet the air/fuel ratio corresponding to the rich spike. Accordingly, it is possible to prevent the generation of the rich misfire. Also, since the DPG is gradually subtracted, it is possible to suppress the turbulence of the air/fuel ratio to stabilize the combustion. Furthermore, since the DPG is gradually subtracted, the purge execution time is longer than that of the method in which the DPG is abruptly decreased and the air/fuel ratio is identified with the necessary air/fuel ration. It is therefore possible to sufficiently keep the purge amount.

Figure 56:
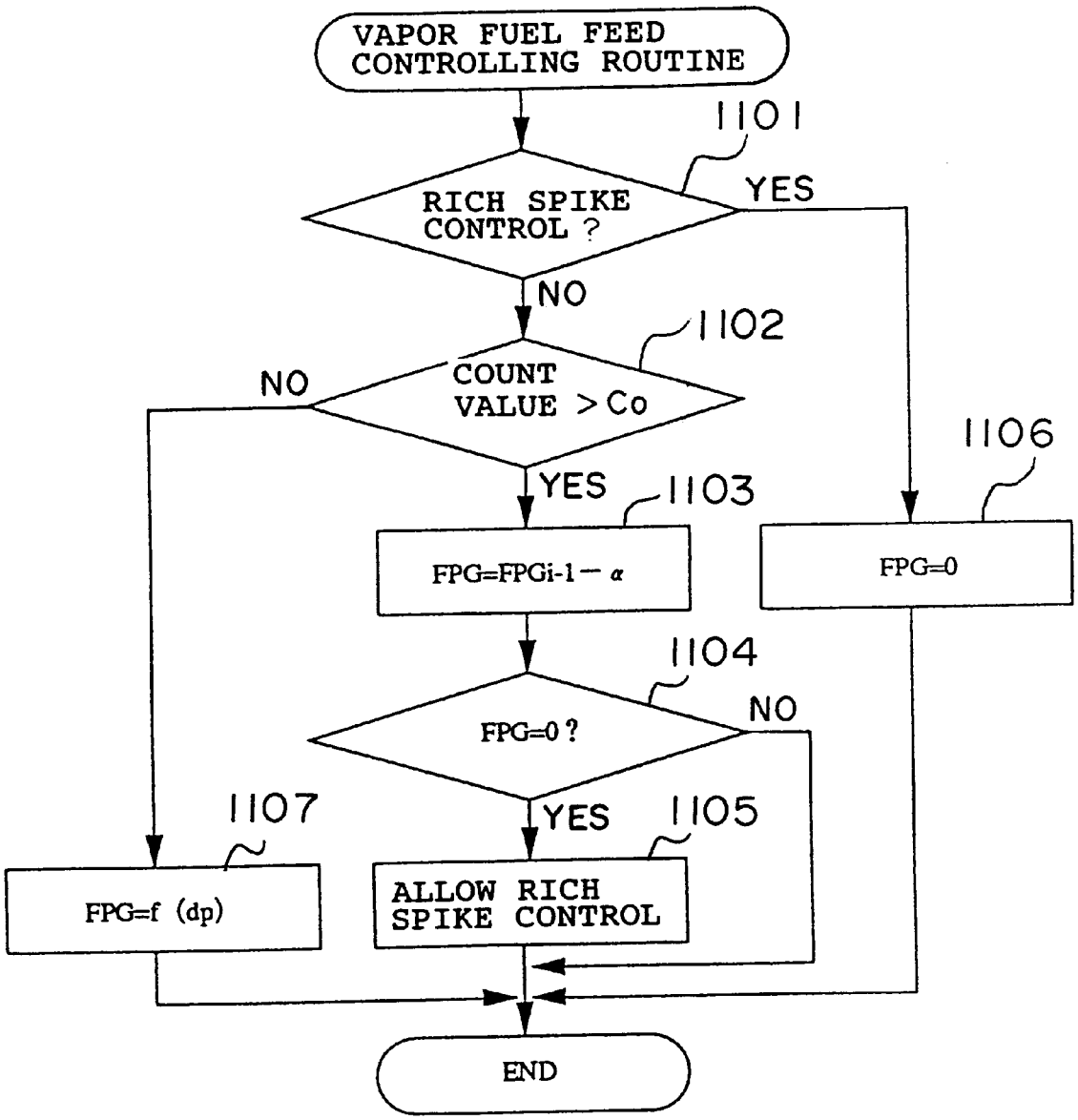
FIG. 56 is a flowchart showing a "fuel vapor feed controlling routing" according to another embodiment of the invention.

Next, FIG. 61(2) corresponds to the embodiment shown in FIG. 56 and shows a case where the DPG and FPG are gradually subtracted to be close to zero. If the DPg is subtracted, the air/fuel ratio is shifted on the lean side, whereas the FPG is subtracted, the air/fuel ratio is shifted on the rich side. Accordingly, it is possible to identify the air/fuel ratio with the necessary air/fuel ratio if the DPG and FPG are subtracted in synchronism with each other.

Thus, according to the form of this embodiment, in a synergy with the DPG control, it is possible to identify the air/fuel ratio with the necessary air/fuel ration in the period until the execution of the rich spike. In the rich spike control, the affect given to the air/fuel ratio by the fuel vapor is reduced. Accordingly, the air/fuel ratio is well controlled and there is no turbulence. As a result, it is possible to prevent the generation of the rich misfire or the like. Finally, it is possible to maintain the drivability.

Incidentally, in the fourth embodiment of the invention, the predetermined value $\alpha$ of the FPG which is to be subtracted is the constant value. It is possible to use a variable in response to the operation condition.

Also, in the fourth embodiment, in step 1103, the subtraction of the predetermined value $\alpha$ from the FPG is repeated and the FPG is gradually reduced down to zero. However, it is possible to make the FPG zero at once.

<fifth form of fifth feature>

A fifth form embodying the present invention will now be explained. However, the structure or the like is substantially the same as that of the form of the second embodiment. Only the difference is that the object to be controlled is changed from DPG to FPG. Then, the FPG control exhibits the effect of FIG. 61(2) with a synergy with the DPG control according to the second embodiment. This example executes the features of (6-2) and (6-3).

Figure 57:
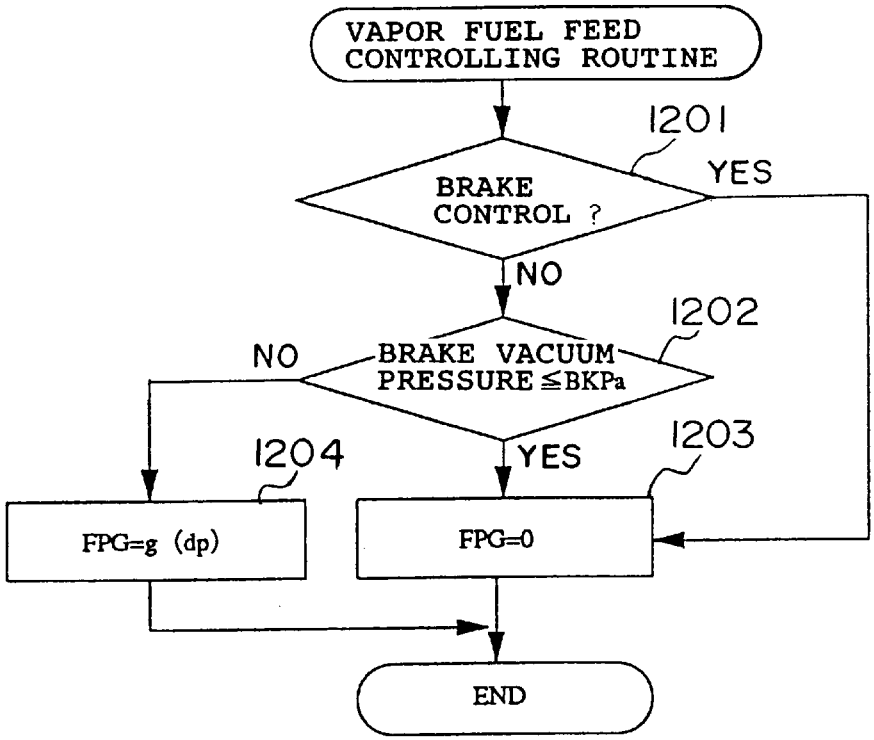
FIG. 57 is a flowchart showing a "fuel vapor feed controlling routing" according to still another embodiment of the invention.

FIG. 57 is a flowchart showing a "fuel vapor control routine" for executing the control of the fuel vapor in this embodiment, and to be executed by ECU 30 as a main routine.

When the process shifts to this routine, first of all, ECU 30 judges in step 1201 whether or not the brake control is currently effected. Then, in the case where it is judged that the brake control is effected, it is judged that the feed of the fuel vapor is not suitable. In step 1203, the fuel vapor amount compensation amount FPG is made zero to once complete the process thereafter. Namely, in the case where it is judged that the brake control is executed, the final injection fuel amount is the sum of the basic fuel injection amount of the basic fuel injection amount and K1 in accordance with the formula (1), where K1 is the compensation coefficient of the fuel injection amount for identifying the air/fuel ratio with the necessary air/fuel ratio in the brake vacuum pressure maintenance. Since the throttle is driven in a direction in which the air/fuel ratio is identical with the necessary air/fuel ratio in the brake vacuum pressure maintenance, as a result, the air/fuel ratio is changed on the rich side. Accordingly, it is safe to say that the K1 is the compensation coefficient for identifying the air/fuel ratio with the necessary air/fuel ratio, for example, the stoichiometric air/fuel ratio or a predetermined lean air/fuel ratio at the interrupt of the purge.

On the other hand, in step 1201, in the case where it is judged that the brake control is not currently effected, the process shifts to step 1202. In step 1202, it is judged whether or not the brake vacuum pressure exceeds a predetermined value BkPa (absolute value) set in advance. In this case, the predetermined BkPa means the value at which the brake vacuum pressure maintenance process is executed in the case where the brake vacuum pressure becomes the above-described value +a constant value. If it is judged that the brake vacuum pressure exceeds the predetermined value BkPa, in step 1204, the duty ratio DPG is calculated on the basis of the above-described differential pressure dp to once finish the process thereafter.

Namely, the duty ratio FPG is calculated as a function g of the differential pressure dp. Then, the fuel injection amount is controlled by the fuel vapor amount compensation amount on the basis of the calculated FPG=g(dp).

In the meanwhile, as is apparent from FIG. 61(2), the case of the DPG control and the value of the FPG control are offset with each other so that the air/fuel ratio may be identified with the necessary air/fuel ratio.

Also, in step 1202, in the case where it is judged that the brake vacuum pressure is equal to or less than the above-described predetermined value BkPa, it is inferred that, for a while, a process for maintaining the brake vacuum pressure (process for temporarily closing the throttle valve 23 and enriching the air/fuel ratio close to the stoichiometric air/fuel ratio) is executed. In step 1203, the duty ratio FPG is made zero and the process thereafter is once stopped. Namely, in the case where it is judged that the brake vacuum pressure maintenance process will be executed soon, the fuel vapor feed is interrupted. Namely, the final injection fuel amount is the sum of the basic fuel injection amount and K1 in accordance with the formula (1), (where K1 is the compensation coefficient of the fuel injection amount when the brake vacuum pressure is maintained). This means that the air/fuel ratio is more changed on the rich side than before the brake.

As a result, as shown in FIG. 61(2), the DPG control shown in FIG. 57 is performed until the brake vacuum pressure becomes the value as necessary. When the FPG is close to zero, and the air/fuel ratio is changed on the rich side so that the DPG is also close to zero and the air fuel ratio is changed on the lean side. It is therefore possible to relatively make the air/fuel ratio to the target lean condition.

In accordance with this embodiment, since the brake operation is assisted by the vacuum pressure in the stratified combustion condition, the air/fuel ratio is likely to be enriched when the vacuum pressure within the brake booster 71 is maintained. However, the ECU 30 reduces the FPG zero in the former stage of the vacuum maintenance and keeps constant the air/fuel ratio in synergy with the DPG control to exclude the affect given to the air/fuel ratio by the fuel vapor in the process of the brake vacuum pressure maintenance. Accordingly, the air/fuel ratio is well controlled and would not be disturbed. As a result, it is possible to prevent the generation of the rich misfire or the like, which leads to the maintenance of the good drivability.

In particular, in the sleeve interior injection type internal combustion engine, since the throttle valve is normally operated at a full throttle in many cases, when the brake is effected, the brake booster vacuum pressure has to be generated every time. The production of the vacuum pressure is attained by temporarily closing the throttle valve. However, in this case, the air/fuel ratio is temporarily enriched to bring about a fear of misfire. Accordingly, in such a case, as described above, the feed of the fuel vapor is restricted to thereby prevent the misfire. Thus, this example is very effective for the sleeve interior injection type internal combustion engine.

In the fifth embodiment, the FPG is made zero at once in step 1203. However, it is possible to gradually make the FPG zero.

<sixth form of fifth feature>

A sixth form embodying the present invention will now be described. H6wever, the structure or the like is substantially the same as that of the form of the third embodiment. This example executes the feature of (6-4).

Figure 58:
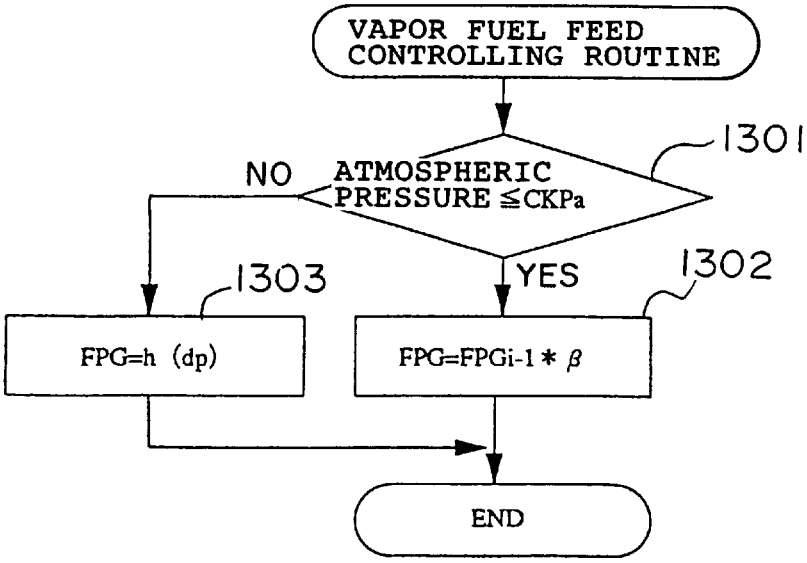
FIG. 58 is a flowchart showing a "fuel vapor feed controlling routing" according to still another embodiment of the invention.

FIG. 58 is a flowchart showing a "fuel vapor control routine" for executing the control of the fuel vapor in this embodiment, and to be executed by ECU as a main routine. Incidentally, this process may be used together with the DPG control of FIG. 50 which is the third embodiment.

When the process shifts to this routine, first of all, ECU 30 judges in step 1301 whether or not the atmospheric pressure is higher than a predetermined value CkPa set in advance. Then, in the case where it is judged that the atmospheric pressure exceeds the above-described predetermined value CkPa, in step 1303, the duty ratio FPG is calculated on the basis of the differential pressure dp to once stop the process thereafter. Namely, it is judged that the reduction of the intake density is not effected, and the as usual, the duty ratio FPG is calculated as a function h of the differential pressure dp. Then, the final fuel injection amount is adjusted by the magnitude of FPG.

Also, in step 1301, it is judged that the atmospheric pressure is equal to or less than the above-described predetermined value CkPa, the value obtained by multiplying the previous duty ratio $FPG_{i-1}$ by a compensation coefficient β ($0 \leqq \beta \leqq 1$) obtained from the correspondence with the atmospheric pressure shown in FIG. 51 is set as a new FPG. The process thereafter is once stopped. Namely, through this step 1302, the FPG is gradually reduced. The FPG is gradually reduced, and the air/fuel ratio is changed on the lean side.

In contrast, in the DPG control, the air/fuel ratio is changed on the lean side. Accordingly, the air/fuel ratio is maintained at the necessary air/fuel ratio by the control of both.

In this embodiment, in the stratified combustion condition, since the air density (intake density) is low in a high land, the air/fuel ratio is likely to be enriched in comparison with the low land. For this, when the atmospheric pressure is low (air density is low), ECU 30 reduces the FPG, and the final fuel injection amount is increased.

However, at the same time, DPG is controlled so that the fuel vapor amount is decreased. It is therefore possible to control the air/fuel ratio as inherently required.

For this reason, it is possible to reduce the adverse affect to the air/fuel ratio by the fuel vapor in a high land. Accordingly, the air/fuel ratio is well controlled and would not be disturbed. As a result, it is possible to prevent the generation of the rich misfire or the like, which leads to the maintenance of the good drivability.

In the above-described sixth embodiment, as shown in FIG. 51, as the compensation coefficient β, the value that changes in a linear fashion corresponding to the atmospheric pressure is used. If this has the characteristic that it is gradually increased up to the predetermined value CkPa corresponding to the atmospheric pressure, it is possible to adopt any other desired curves.

<seventh form of the fifth feature>

A fifth form embodying the present invention will now be described. In the embodiment of this invention, the compensation coefficient β is changed to β' in response to the vapor concentration. Also, although no shown, the β' shown in FIG. 59 is utilized in the DPG control of FIG. 50 which is the third embodiment, and this may be used together with the form of this embodiment.

Incidentally, this example of this embodiment is an example for executing the feature of (6-6).

Figure 59:
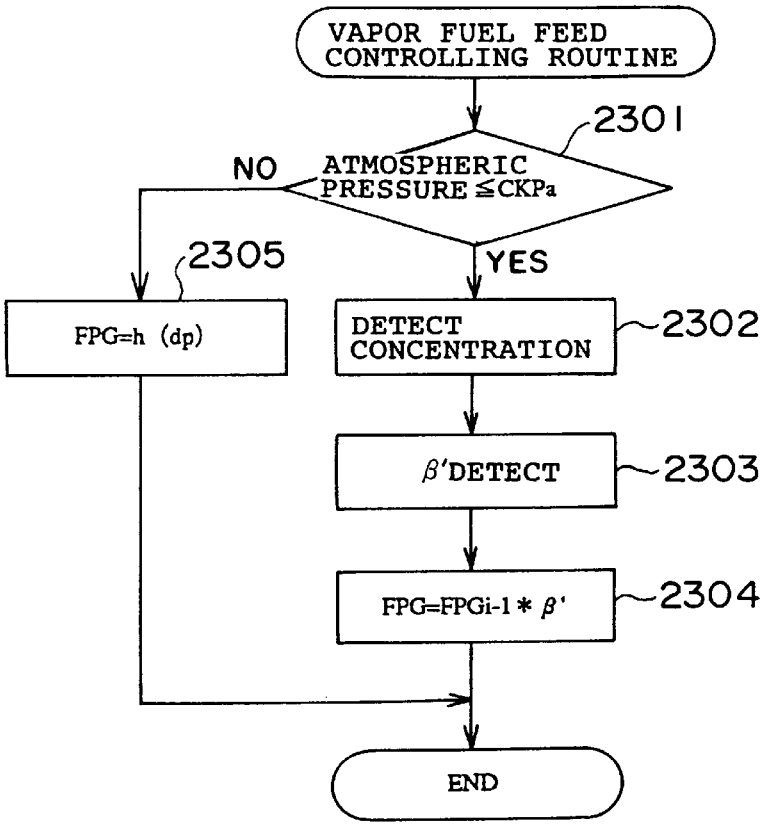
FIG. 59 is a flowchart showing a "fuel vapor feed controlling routing" according to still another embodiment of the invention.

FIG. 59 is a flowchart showing a "fuel vapor control routine" for executing the control of the fuel vapor in this embodiment, and to be executed by ECU as a main routine.

When the process shifts to this routine, first of all, ECU 30 judges in step 2301 whether or not the atmospheric pressure is higher than a predetermined value CkPa set in advance. In the case where it is judged that the atmospheric pressure exceeds the above-described predetermined value CkPa, in step 2305, the FPG is calculated on the basis of the differential pressure dp to once stop the process thereafter. Namely, it is judged that the reduction of the intake density is not effected, and as usual, the duty ratio FPG is calculated as a function h of the differential pressure dp. Then, the final fuel injection amount is adjusted by the magnitude of the result.

Also, in step 2301, it is judged that the atmospheric pressure is equal to or less than the above-described predetermined value CkPa, the vapor concentration is detected by the HC sensor (not shown) as the concentration detecting means provided in the fuel vapor chamber 84 in step 2302. The compensation coefficient β' corresponding to the vapor concentration is calculated from the map shown in FIG. 60 in step 2303.

Figure 60:
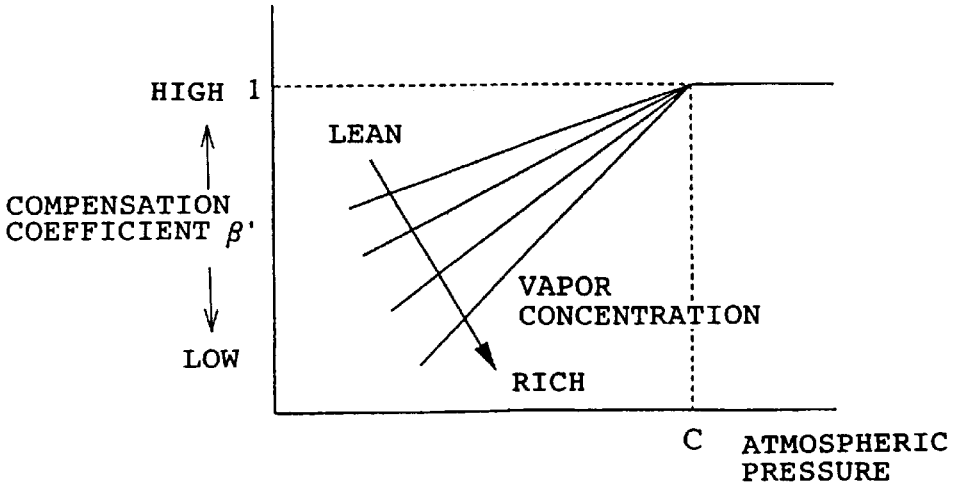
FIG. 60 is a m ap showing a relationship between the atmospheric pressure a nd the compensation coefficient relative to the vapor concentration.

Subsequently, the value obtained by multiplying the previous duty ratio $FPG_{i-1}$ by a compensation coefficient β' ($0 \leqq \beta' \leqq 1$) obtained from the correspondence with the atmospheric pressure shown in FIG. 60 is set as a new FPG. The process thereafter is once stopped. Namely, through this step 2302, the FPG is gradually reduced. The FPG is gradually reduced, and the air/fuel ratio is changed on the rich side.

In contrast, in the DPG control, the air/fuel ratio is changed on the lean side. Accordingly, the air/fuel ratio is maintained at the necessary air/fuel ratio by the control of both.

Next, the advantage and effect of this embodiment is the same as the sixth form, but in this case, it is further finely control the system in accordance with the change of the vapor concentration.

<eighth form of fifth feature>

Figure 62:
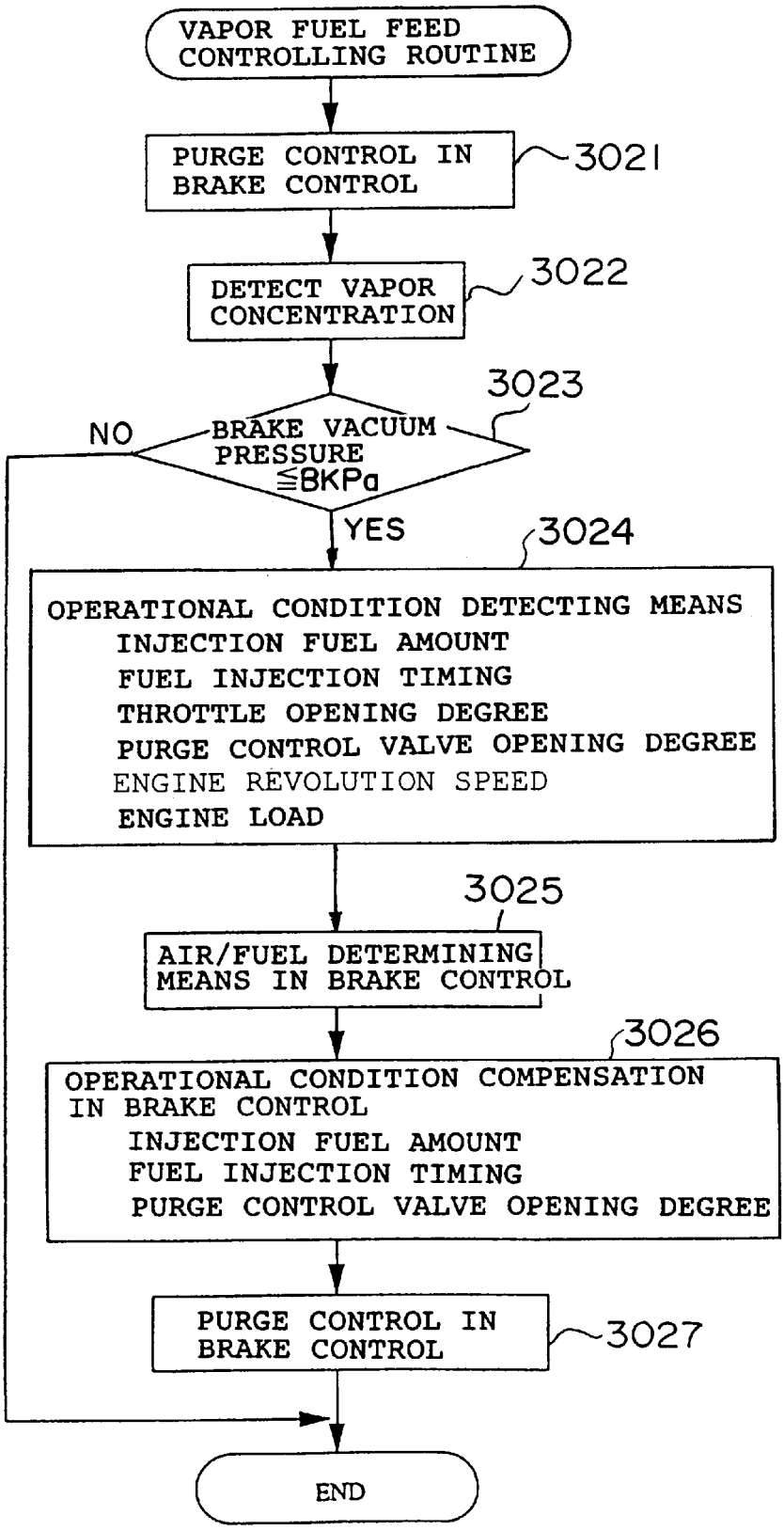
FIG. 62 is a flowchart showing a "fuel vapor feed controlling routing" according to still another embodiment of the invention.

A case where the fuel vapor concentration is detected to perform the purge control will now be described with reference to FIG. 62. This realizes the feature of (6-6). In the same manner as the feature of (6-5), when the brake control is effected, the purge amount is not zero, but the purge control valve is throttled to decrease the fuel vapor amount. On the other hand, the fuel injection amount to be fed from the injection valve is also restricted so that the necessary final fuel injection amount is obtained from the fuel vapor and the fuel injection from the fuel injection valve. In this case, in consideration of the concentration of the fuel vapor, the purge amount or the fuel injection condition is compensated for and controlled in response to the concentration.

First of all, the process shifts to a routine for performing the purge control of the brake control (step 3021). At this time, the vapor concentration is detected from the vapor concentration detecting means (step 3022).

Subsequently, it is judged whether or not the brake vacuum pressure is equal to or less than a reference value BKPa (step 3023). If so, the fuel injection amount, the fuel injection timing, the throttle opening degree, the purge control valve opening degree, the engine revolution speed, the engine load and the like are detected by the operational condition detecting means and inputted into the CPU (step 3024). Thereafter, the air/fuel ratio determining means in the brake control determines the air/fuel ratio (step 3025).

In order to determine the operational condition with the air/fuel ration determined in step 3025, in step 3026, the fuel injection amount in the brake control, the fuel injection timing and the compensation amount of the purge control valve are determined in response to the purge concentration by the operational condition compensation means in the brake control.

In consideration of the compensation amount, in order to obtain the air/fuel ratio as determined above, the fuel injection amount to be fed from the fuel injection valve and the feed amount of the fuel vapor by the purge control valve opening degree are determined. Namely, the final fuel injection amount is calculated from the map for determining the mutual relationship between the engine revolution speed and the accelerator opening degree and the basic fuel injection amount, 7. and is obtained by adding the fuel vapor amount to the fuel injection amount in view of the above-described compensation amount.

Figure 63:
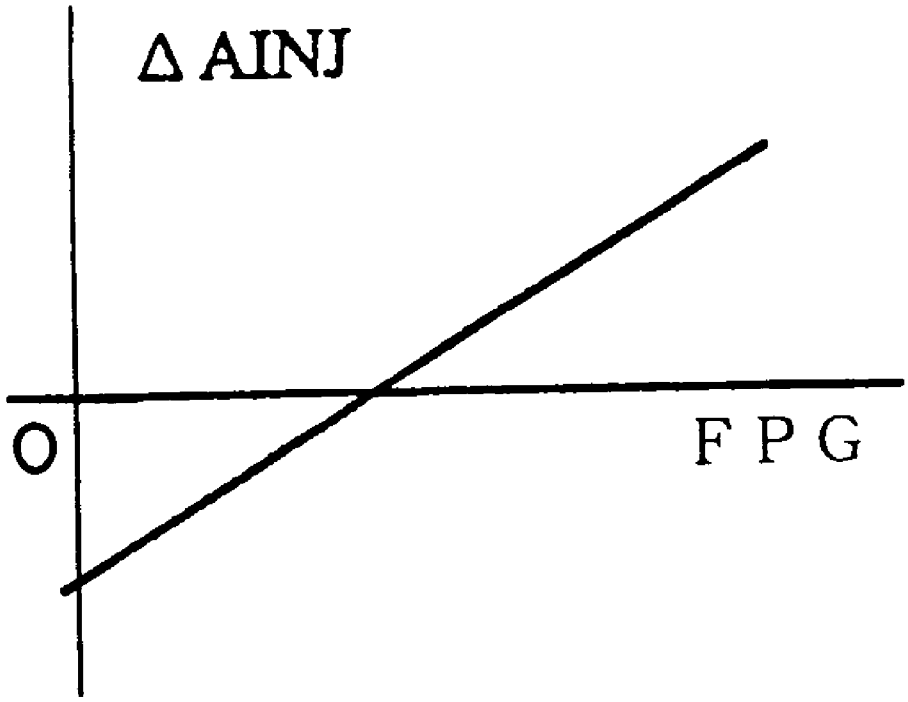
FIG. 63 is a map showing a relationship between the change amount ΔAINJ of the fuel injection timing and the fuel vapor amount compensation amount FPG.

When the fuel injection timing AINJO is determined, the map shown in FIG. 63 is referred to. This map determines the mutual relationship between the fuel vapor amount compensation amount FPG and the change amount ΔAINJ of the fuel injection timing and is stored in the ROM. In FIG. 63, an intersecting section between the line and the abscissa axis represents a stoichiometric air/fuel ration. The left portion of the intersecting section means the phenomenon that only the air is purged. The change amount ΔAINJ of the fuel injection timing corresponding to the fuel vapor amount compensation amount FPG is subtracted from the previous fuel injection timing AINJO to thereby calculate the current fuel injection amount.

In step 3027, the purge control in the brake operation is executed in accordance with the determined conditions.

Incidentally, in step 3023, it is judged that the brake vacuum pressure is higher than a reference value BKPa, the process is finished. It is possible to calculate the vapor concentration from the air/fuel sensor provided in the exhaust pipe and the oxygen sensor provided in the intake pipe in addition to the HC sensor as the vapor concentration detecting means.

In this case, since it is also possible to feed the purge gas in the brake control, the purge change is enhanced to avoid the discharge of the vapor to the atmosphere. Also, since the fuel injection amount or the fuel injection timing is determined in response to the vapor concentration, the optimum air/fuel ratio is realized to maintain the good drivability.

The embodiment of the invention is not limited to that shown above but may be modified as follows.

First of all, in the forms of the respective embodiments, the judgement as to the fact that the air/fuel ratio of the combustible mixture in the stratified combustion condition in the fuel vapor feed controlling routine is more enriched than the air/fuel ratio in the normal stratified combustion condition is individually or independently attained by the judgement as to whether the amount of NOx absorbed to the NOx absorbing reducing catalyst 61 exceeds the predetermined amount for the rich spike control, by the judgement as to whether the vacuum pressure within the brake booster 71 detected by the pressure sensor 72 is insufficient to the predetermined amount, or by the judgement as to whether the density of air of the intake duct 20 detected by the intake pressure sensor 46 is less than the reference value. However, it is possible to simultaneously execute the two or more judgements out of the above-described respective judgements to perform the reduction or interrupt of the fuel vapor.

The present invention is embodied to the sleeve interior injection type engine 1 in the foregoing embodiment but may be embodied to a type in which a general stratified combustion or weak stratified combustion is performed. For example, the present invention may be applied to a type in which the fuel is injected to a bottom side of each of the intake valves 6*a* and 6*b* of the intake ports 7*a* and 7*b*. Although the fuel injection valve is provided on the side of the intake valves 6*a* and 6*b*, it is possible to apply the invention to the arrangement in which the fuel is injected directly to the interior of the cylinder bore (combustion chamber 5).

Also, in the foregoing respective embodiments, the helical type intake ports are used to generate the swirls. However, it is not always necessary to generate the swirl. Accordingly, it is possible to omit the swirl control valve 17, the stepping motor 19 or the like in the forms of the embodiments, for example.

In the foregoing embodiment, the-invention is embodied to the gasoline engine 1 as the internal combustion engine, it is possible to apply the invention to a diesel engine or the like.

In the embodiments, the atmospheric pressure PA is detected by the intake pressure sensor 61. However, it is possible to separately provide an atmospheric pressure sensor to detect the atmospheric pressure.

Also, in the brake control, the purge amount is not always zero but the purge control valve is throttled to reduce the fuel vapor amount. On the other hand, the fuel injection amount to be fed from the injection valve is restricted so that the necessary final fuel amount from the fuel injection from the fuel injection valve and the fuel vapor as a whole may be reduced.

As described above in detail, according to the present invention, in the fuel vapor feed controlling system for the lean burn combustion engine provided with the adjusting means for adjusting the flow rate of the fuel vapor, it is possible to suitably control the air/fuel ratio in the stratified combustion condition so that the rich misfire or the like in accordance with the turbulence of the air/fuel ratio may be effectively prevented.

The six feature of the present invention will now be described with reference to FIGS. 64 to 79.

<first form of sixth feature>

Figure 64:
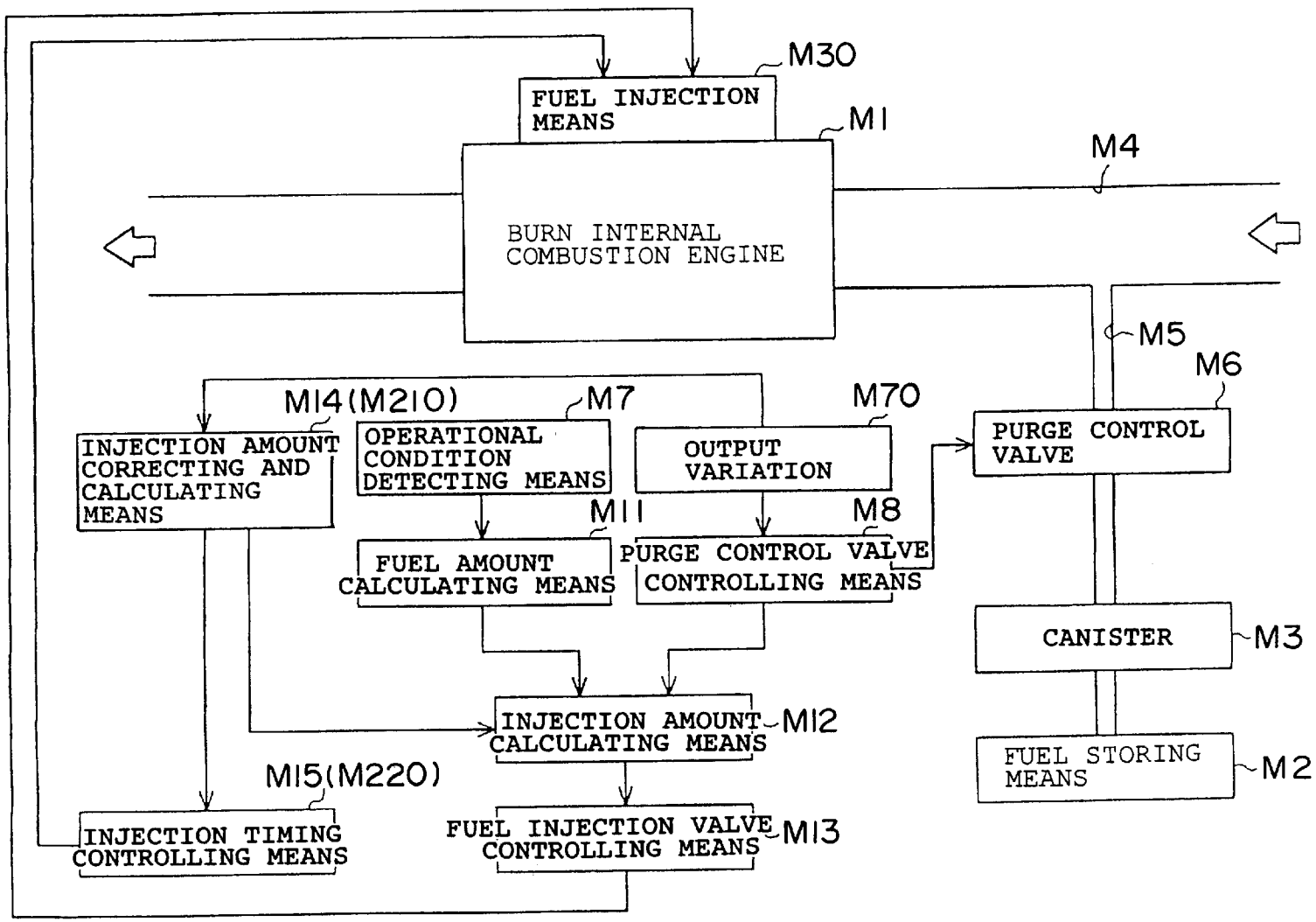
FIG. 64 is a conceptional structural view concerning the fifth feature.

As shown in FIG. 64, there are provided a canister M3 for storing the fuel vapor generated from a fuel storing means M2 for storing the fuel of an internal combustion engine M1 and a purge passage M5 for communicating an intake system M4 of the internal combustion engine M1 and the canister M3.

Furthermore, a purge control valve M6 is provided in the midway of the purge passage M5 for controlling the fuel vapor amount of the fuel vapor to be introduced into the intake passage M4.

An output variation detection means 70 is provided for detecting the output variation of the internal combustion engine M1. A purge control valve controlling means M8 is provided for controlling the purge control valve M6 in response to the detection result of the output variation detecting means M70.

Then, in order to attain the lean combustion, a fuel injection means M30 for feeding the fuel to the internal combustion engine M1 and the operational condition detecting means M7 for detecting the operational condition of the internal combustion engine M1 are provided. Furthermore, a fuel amount calculating means M11 for calculating the fuel amount to be fed to the internal combustion engine M1 on the basis of the detection result of the operational condition detecting means M7 and an injection amount calculating means for compensating for the fuel vapor amount to the calculation result of the fuel injection amount calculating means to change the fuel injection amount from the fuel injection means M30 to the internal combustion engine are provided.

Also, a fuel injection valve controlling means M13 for controlling the fuel injection means M30 (fuel feeding means) on the basis of the calculated fuel injection amount, an injection amount correcting and calculating means M14 for correcting and calculating the fuel injection amount by reducing the compensation amount of the fuel vapor amount in the case where the output variation is not degraded even by the purge control valve controlling means, and an injection timing controlling means M15 for controlling the fuel injection timing on an advance side in the case where the compensation amount of the fuel vapor amount is reduced by the injection amount correcting and calculating means M14 are provided.

In this case, the purge control valve M6 and the purge control valve controlling means M8 constitutes a purge control means for controlling the fuel vapor amount in response to the detection result of the operational condition detecting means M7 or the output variation detecting means M70.

The fuel injection amount calculating means M12 includes a fuel vapor compensating means and constitutes a fuel injection amount changing means. Also, the injection amount correcting and calculating means M14 and the injection timing controlling means M15 constitute a correction controlling means.

Also, in addition to this structure, an injection amount correcting and calculating means M210 for correcting and calculating the fuel injection amount by increasing the compensation amount corresponding to the fuel vapor amount in the case where the output variation is less than a predetermined value and an injection timing controlling means M220 for controlling the fuel injection timing on the retard side in the case where the compensation amount corresponding to the fuel vapor amount is increased by the injection amount correcting and calculating means M210 are provided.

The fuel injection amount correcting and calculating means M14 and the injection timing controlling means M15 are provided together with or separately from the injection amount correcting and calculating means M210 and the fuel injection timing controlling means M220.

As shown in FIG. 64, the fuel for the internal combustion engine M1 is received in the fuel storing means M2 and the fuel vapor generated from the fuel storing means M2 is stored in the canister M3. The fuel vapor stored in the canister M3 may be fed to the intake system M4 of the internal combustion engine M1 through the purge passage M5. An opening degree of the purge control valve M6 provided in the midway of the purge passage M5 is controlled to control the vapor amount of the fuel vapor to be fed into the intake system M4. Namely, the output variation of the internal combustion engine M1 is detected by the output variation detecting means M7, and the purge control valve M6 is opened and closed (duty controlled) by the purge control valve controlling means M8 in response to the detection result. In this case, when the fuel vapor to be introduced through the purge passage M5 and the intake passage M4 into the internal combustion engine M1 is increased, the total fuel amount to the internal combustion engine is increased whereby the output variation may be suppressed.

Also, the fuel is fed into the internal combustion engine M1 by the fuel injection means M9 for the lean combustion. The operational condition of the internal combustion engine M1 is detected by the operational condition detecting means M7 and the basic fuel amount to be fed into the internal combustion engine M1 is calculated on the basis of the detecting result in the fuel amount calculating means M11. Then, in the injection amount calculating means M12, the compensation corresponding to the fuel vapor amount is effected to the calculation result of the fuel amount calculating means M11 to thereby calculate the fuel injection amount from the fuel injection means M9. In the fuel injection valve controlling means M13, the fuel injection means M9 is controlled on the basis of the calculated fuel injection amount.

By the way, according to the present invention, if the output variation is not lowered even by the purge control valve controlling means M8, the compensation amount corresponding to the fuel vapor amount is subtracted by the injection amount correcting and calculating means M14 to thereby correct and calculate the fuel injection amount. Accordingly, the fuel amount to be injected from the fuel injection means M30 is substantially increased so that the output variation may be positively suppressed. Also, in the case where the compensation amount corresponding to the fuel vapor amount is reduced by the fuel injection correcting and calculating means M14, the injection amount is increased. At this time, if the ignition timing and the injection timing are fixed intact, the fuel amount around the spark plug at the ignition timing is excessive. In contract, according to the present invention, the fuel injection timing is controlled on the advance side by the injection timing controlling means M15. For this reason, the fuel amount around the spark plug at the ignition timing may be kept at an optimum value for the combustion.

Also, in the case where the injection amount correcting and calculating means M210 and the fuel injection timing controlling means M220 are used instead of the fuel injection amount correcting and calculating means M14 and the injection timing controlling means M15, when the output variation is lower than the predetermined value by the purge control valve controlling means M8, the compensation amount corresponding to the fuel vapor amount is increased by the injection amount correcting and calculating means M210 to thereby correct and calculate the fuel injection amount. For this reason, the fuel amount to be injected from the fuel injection means M30 is substantially decreased, and the output variation is kept within a minimum limit to thereby enhance the fuel consumption rate. Also, in the case where the compensation amount corresponding to the fuel vapor amount is reduced by the fuel injection correcting and calculating means M210, the injection amount is decreased. At this time, if the ignition timing and the injection timing are fixed intact, the fuel amount around the spark plug at the ignition timing is too small. In contract, according to the present invention, the fuel injection timing is controlled on the retard side by the injection timing controlling means M220. For this reason, the fuel amount around the spark plug at the ignition timing may be kept at an optimum value for the combustion.

Furthermore, in the case the output variation to be detected by the output variation detecting means is higher than the predetermined value, the purge control valve controlling means may be constituted to control the purge control valve in order to increase the feed amount of the fuel vapor. Accordingly, in this case, the fuel vapor is increased and the output variation is suppressed by the increase of the fuel vapor. Also, in the case the output variation to be detected by the output variation detecting means is lower than the predetermined value, the purge control valve controlling means may be constituted to control the purge control valve in order to decrease the feed amount of the fuel vapor. Accordingly, in this case, the fuel vapor is decreased and the fuel consumption is suppressed.

Incidentally, the "predetermined" value used in the above may take different values.

In the form of the embodiment, the fuel vapor feed controlling apparatus for the sleeve interior injection type engine mounted on the vehicle is the same as schematically shown in FIG. 3.

Also, the combustion chamber structure of each cylinder 1*a* of the engine 1 is the same as shown in FIG. 4. Furthermore, the structure of the ECU 30 is the same as shown in FIG. 5.

The programs relating to the variety of the controls concerning the form of the embodiment of the fuel vapor feed controlling apparatus for the engine provided with the above-described structures will be described with the flowcharts.

First of all, the basic purge control program will be described with reference to the flowchart shown in FIG. 65.

First of all, the engine revolution speed NE and the accelerator opening degree ACA are inputted (step 681). Subsequently, the basic fuel injection amount QALL is calculated in accordance with the inputted engine revolution speed and accelerator opening degree (step 682). Incidentally, a plurality of maps are prepared in correspondence with the operational condition or combustion condition as an injection amount map. One is selectively used from the maps.

In step 683, it is judged whether or not the purge is effected. If it is in the purge, the throttle valve opening degree TA and the engine revolution speed NE are read in (step 684).

Next, the fuel vapor amount compensation amount (FPG) is calculated (step 685). This calculation is effected from the mutual relationship between the fuel vapor amount compensation amount (FPG) and the throttle valve opening degree TA and the engine revolution speed NE stored in the ROM in the form of map in advance. Incidentally, in FIG. 66, HIGH, INTERMEDIATE and LOW are drawn to the engine revolution speeds. The smaller the engine revolution speed, the more the fuel vapor amount compensation amount will become.

In the case where, in step 683, the operation is out of the purge, in step 687, the fuel vapor amount compensation amount is zero.

After the fuel vapor amount compensation amount FPG is determined in steps 685 and 687, the process shifts to step 686 to determine the final fuel injection amount QALLINJ. In this case, the final fuel injection amount QALLINJ is determined by subtracting the fuel vapor amount compensation amount FPG from the basic fuel injection amount QALL calculated in advance in step 682.

Thereafter the fuel injection is effected in accordance with the fuel injection program determined separately.

Figure 67:
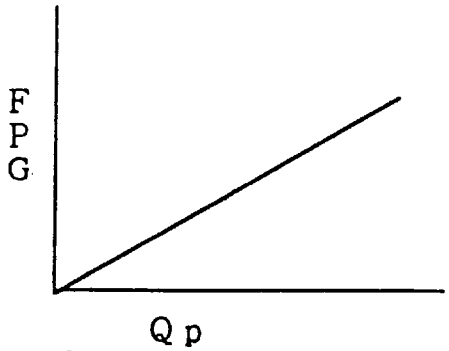
FIG. 67 is a map showing a relationship between the fuel vapor amount compensation amount FPG and the purge gas amount Qp.
Figure 68:
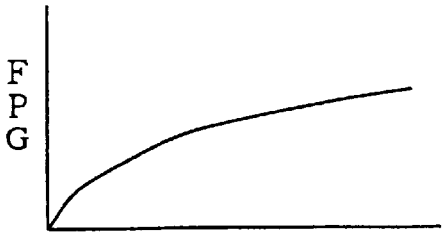
FIG. 68 is a map for determining a relationship between the fuel vapor amount compensation amount FPG and the difference between the atmospheric pressure and the intake manifold pressure.

Incidentally, other calculation methods of the fuel vapor amount compensation amount (FPG) are typically exemplified as a method for obtaining it from the purge gas amount Qp as shown in FIG. 67 and a method for obtaining it from the intake manifold pressure as shown in FIG. 68.

Figure 65:
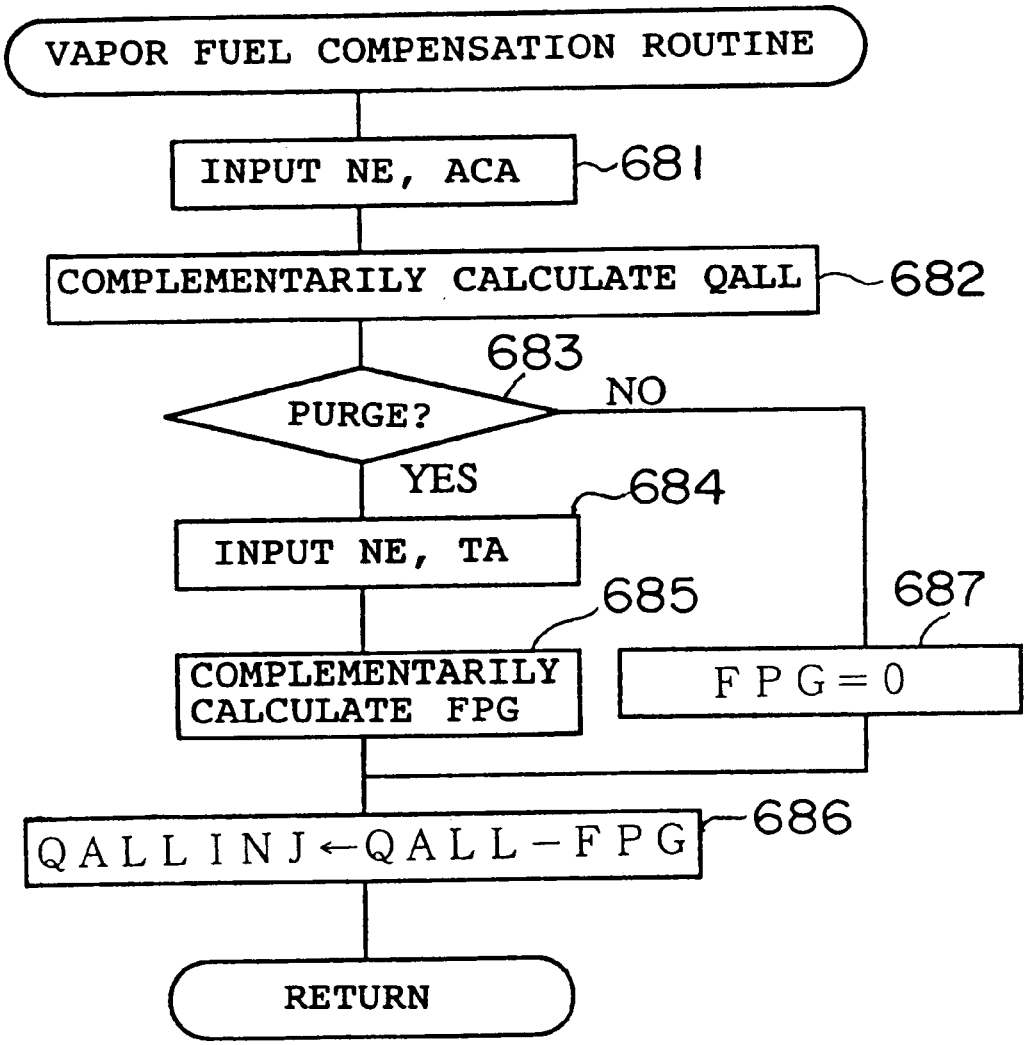
FIG. 65 is a flowchart showing an example of the compensation control of the fuel vapor amount.
Figure 66:
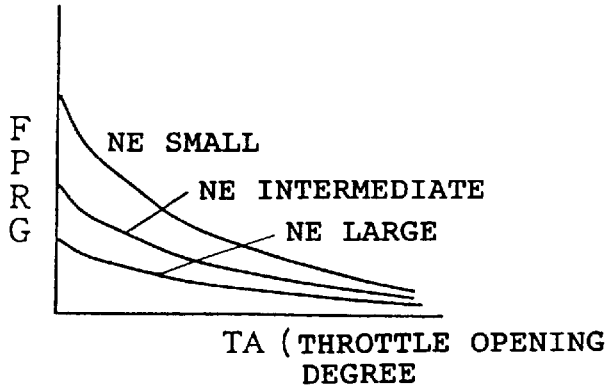
FIG. 66 is a map showing a relationship among the throttle valve opening degree TA, the fuel vapor amount —compensation amount FPG and the engine revolution speed NE.

Incidentally, the routine shown in FIG. 65 is repeatedly executed at a predetermined time interval. Also, the purge execution conditions in the sleeve interior direct injection type internal combustion engine are: the warming-up completion, i.e., the state where the cooling water temperature has been raised exceeding a predetermined temperature, and a state where a predetermined time, i.e., 30 sec has lapsed after the cranking completion. If the purge execution conditions are established, rising from the duty ratio of zero, the magnitude of the duty ratio is controlled in accordance with a predetermined control. At the time of the receipt of the purge prohibition command, for example, a fuel interrupt execution command, the duty ratio is regarded as zero.

Since the fuel vapor compensation amount is detected by such a compensation routine, particularly, steps 684 and 685, a large amount of fuel vapor may be processed without any adverse affect to the drivability or the emission.

The process in the case where the torque variation occurs in such a control will be described with reference to FIG. 69.

Figure 69:
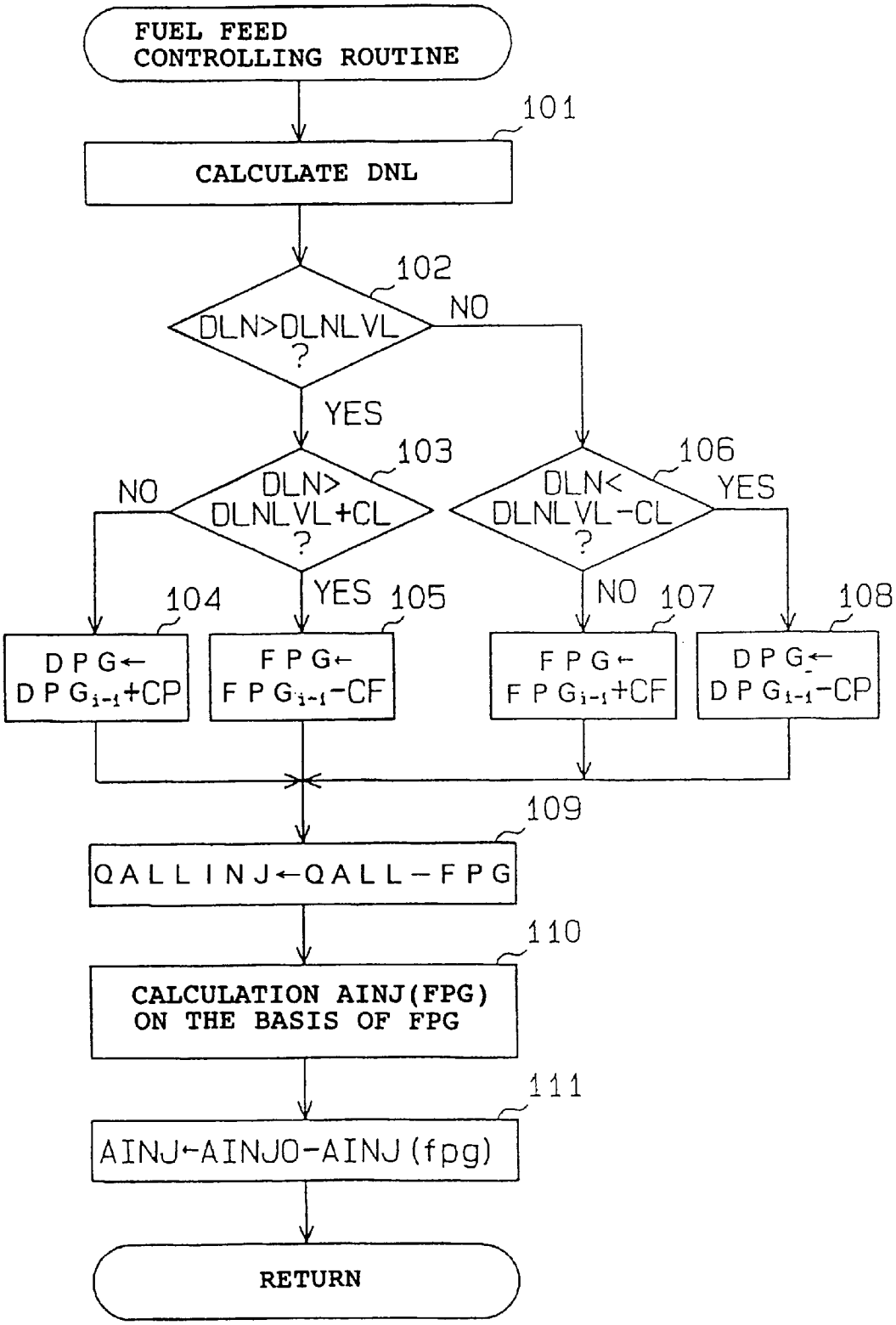
FIG. 69 is a flowchart showing a "fuel feed controlling routine" executed by the ECU.
Figure 70:
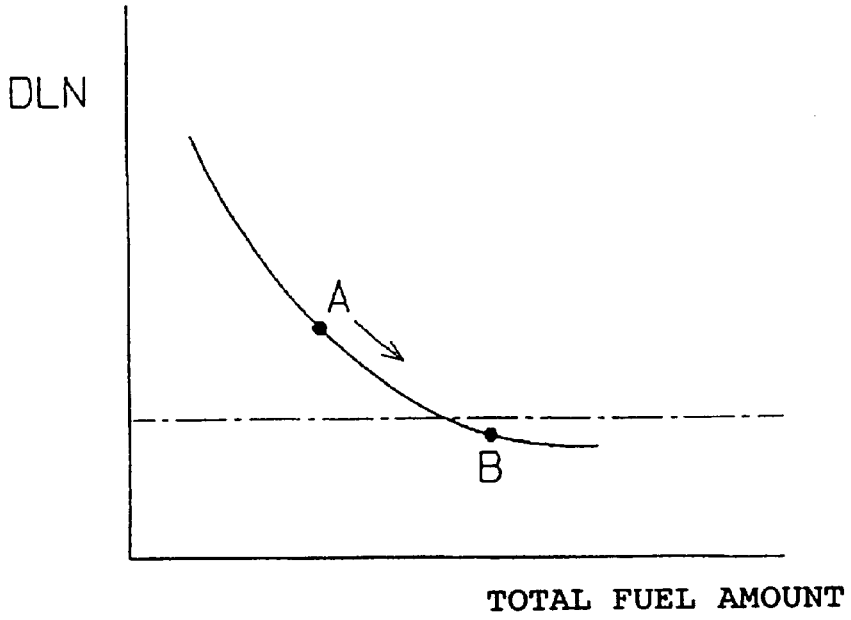
FIG. 70 is a graph showing a relationship of the torque variation relative to the total fuel addition amount.

Namely, FIG. 69 is a flowchart showing a "fuel feed controlling routine" for controlling the fuel injection amount, the injection timing, purge amount or the like by controlling the solenoid valve 81, the fuel injection valve 11 or the like according to the embodiment of the invention. Instead of the steps 684 to 686 of FIG. 65, the present process is executed, and an interrupt at every predetermined crank angle is executed by the ECU 30.

When the process shifts to this routine, first of all, ECU 30 calculates the output variation (torque variation) DLN of the engine 1 on the basis of the output pulse from the top dead sensor 27 and the crank angle sensor 28 in step 101. The torque variation DLN is an average value of the torque variation generated in each cylinder la. The torque T generated in every combustion in each cylinder la is given by the following relationship:

$$T\ (30°/tb)^2-(30°/ta)^2$$

where ta is the time needed for the crankshaft of the engine 1 to pass through a predetermined crank angle θ1 including the top dead center, and tb is the time needed for the crankshaft of the engine 1 to advance from the top dead center and pass from that point through a predetermined crank angle e2. Incidentally, the crank angle θ1 and the crank angle 62 are the same value, for example, 30°.

Then, for example, the torque variation DLN1 generated in a certain cylinder la is calculated by the difference of the torque T generated at every combustion in the cylinder 1*a* as follows:

$$DLN1=\{(30°/t_{bi})^2-(30°/t_{ai})^2\}-\{(30°/t_{bi-1})^2-(30°/t_{ai-1})^2\}$$

Then, next, in step 102, it is judged whether or not the torque variation DLN currently calculated exceeds (becomes worse) the target torque variation DLNLVL. In this case, the target torque variation DLNLVL is determined in another routine by a basic fuel injection amount QALL (determined on the basis of the engine revolution speed NE and the accelerator opening degree ACA) and the engine revolution speed every time. This may be a constant value. Then, in the case where the torque variation DLN exceeds the target torque variation DLNLVL, it is necessary to suppress the torque variation DLN to shift to step 103.

In step 103, it is judged whether or not the torque variation DLN exceeds a value obtained by adding a predetermined value CL to the target torque variation DLNLVL. Then, in the case where the torque variation DLN does not exceed the value obtained by adding the predetermined value CL to the target torque variation DLNLVL, the torque variation is worse but this is not worst (region α in FIG. 72). The process shift to step 104.

Then, in step 104, a value obtained by adding the predetermined value CP to the previous duty ratio $DPG_{i-1}$ is set as the new duty ratio DPG for controlling the solenoid valve 81. The amount (purge amount) of the fuel vapor flowing through the connection pipe 71 to the engine 1 is increased.

Figure 72:
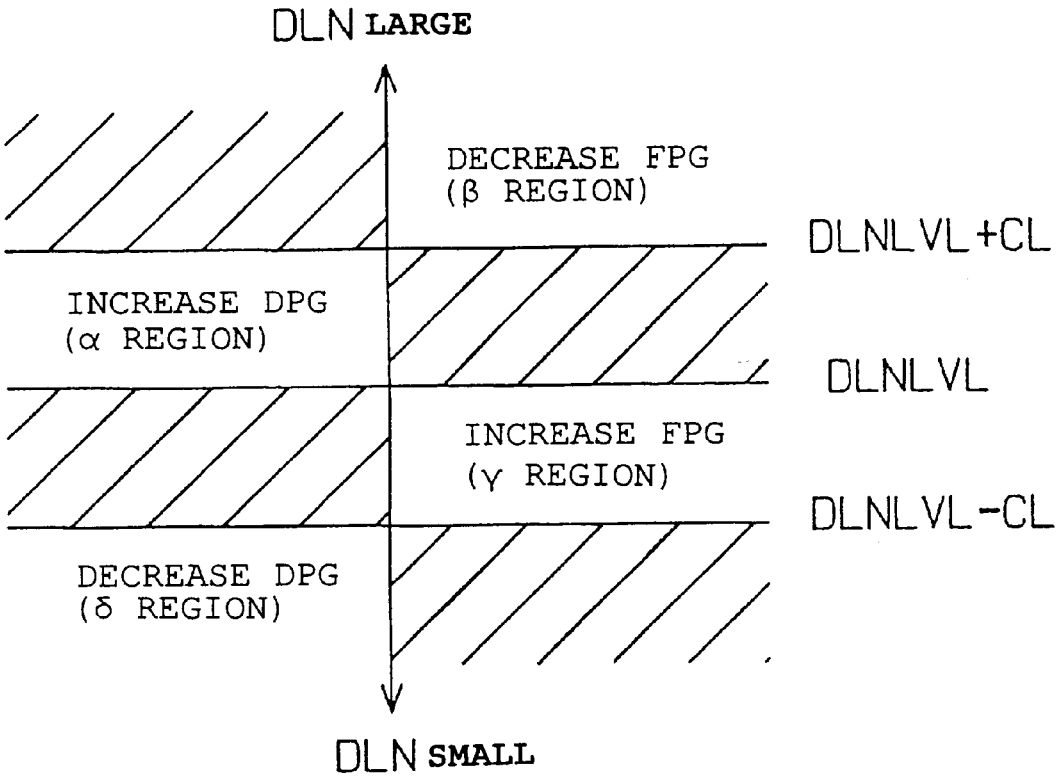
FIG. 72 is a diagram showing the control contents set in response to the value of the torque variation relative to the target torque variation.

On the other hand, in the case where the torque variation DLN exceeds the value obtained by adding a predetermined value CL to the target torque variation DLNLVL, the torque variation DLN is very bad (region β in FIG. 72). The process shift to step 105.

Then, in step 105, a value obtained by subtracting a predetermined value CF from the previous fuel compensation amount (fuel vapor amount compensation amount) $FPG_{i-1}$ in the purge gas is set as a new fuel compensation amount (fuel vapor amount compensation amount) FPG in the purge gas.

Also, in the case where, in step 102, the torque variation DLN does not exceed the target torque variation DLNLVL, there is no problem even if the magnitude of the torque variation DLN is somewhat increased. The process shifts to step 106.

In step 106, it is judged whether or not the torque variation DLN is less than a value obtained by subtracting the predetermined value CL from the target torque variation DLNLVL. Then, in the case where the torque variation DLN exceeds the value obtained by subtracting the predetermined value CL from the target torque variation DLNLVL, the torque variation is very good (region γ in FIG. 72). The process shift to step 107.

Then, in step 107, a value obtained by adding the predetermined value CF to the previous fuel vapor amount compensation amount $FPG_{i-1}$ is set as the new fuel vapor amount compensation amount FPG.

On the other hand, in the case where the torque variation DLN exceeds the value obtained by subtracting the predetermined value CL to the target torque variation DLNLVL, the torque variation DLN is judged as being extremely bad, and the process shift to step 105(region λ in FIG. 72).

Then, in step 108, a value obtained by subtracting the predetermined value CP from the previous duty ratio $DPG_{i-1}$ is set as the new duty ratio DPG for controlling the solenoid valve 81. The amount (purge amount) of the fuel vapor flowing through the connection pipe 71 to the engine 1 is decreased.

By the way, from the above-described steps 104, 105, 107 and 108, in step 109, a value obtained by subtracting the currently calculated fuel vapor amount compensation amount FPG from the above-described basic fuel injection amount QALL is set as the final fuel injection amount QALLINJ to be injected from the fuel injection valve 11. Accordingly, in the case where, in the above-described step 105, the fuel vapor amount compensation amount FPG is reduced, the final fuel injection amount QALLINJ is substantially increased. Also, in the case where, in step 107, the fuel vapor amount compensation amount FPG is increased, the final fuel injection amount QALLINJ is substantially decreased.

Figure 71:
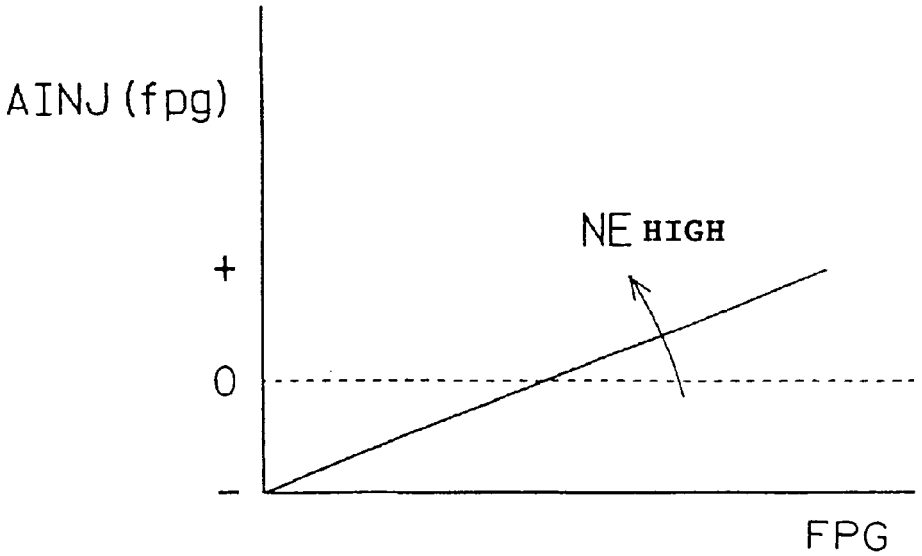
FIG. 71 is a map showing a relationship of the injection timing item relative to the fuel vapor compensation amount.

Furthermore, in the following step 110, the fuel injection timing compensation item AINJ (FPG) is calculated on the basis of the engine revolution speed NE read in currently and the fuel vapor amount compensation amount FPG currently calculated. In this case, when the fuel injection timing compensation item AINJ (FPG) is calculated, the map shown in FIG. 71 is referred to. Namely, the more the current engine revolution speed NE is, or the more the fuel vapor amount compensation amount FPG becomes, the more the injection timing compensation item AINJ (FPG) will be set.

Then, finally, in step 111, a value obtained by the currently calculated injection timing compensation item AINJ (FPG) from the basic injection timing AINJ0 calculated in another routine is set as a final fuel injection timing AINJ. Thereafter, the process is once finished. For this reason, the smaller the fuel injection timing compensation item AINJ (FPG) by reduction becomes, the more on the advance side the injection timing will be compensated. As the injection timing compensation item AINJ (FPG) is increased by the addition, the injection timing is compensated for on the retard side.

Thus, in the above-described "fuel feed controlling routine", the solenoid valve 81, i.e., the purge amount is controlled in the current output variation. Also, the final fuel injection amount QALLINJ and the fuel injection timing AINJ are controlled.

The effect and operation of the embodiment will now be described.

(a) According to the embodiment, in the case where the torque variation DLN exceeds the target torque variation DLNLVL but does not exceed the value obtained by adding a predetermined value CL to the target torque variation DLNLVL ($\alpha$ region in FIG. 72), it is judged that the torque variation DLN is bad but this state is not so bad. In this case, the duty ratio DPG is controlled to be increased to increase the purge amount. In this case, it is known that if the total fuel amount is increased, the torque variation DLN is lowered. As described above, if the purge amount is increased, the total fuel amount is basically increased. For this reason, it is possible to suppress the torque variation DLN by such a control.

(b) Also, even if the duty ratio DPG is increased and the purge amount is increased as described above, in some cases, the torque variation is not lowered but increased. In such a case (in the case where the torque variation DLN exceeds the value obtained by adding a predetermined value CL to the target torque variation DLNLVL), it is judged that the state of the torque variation DLN is very bad. Then, in this case, the fuel vapor amount compensation amount FPG is reduced. For this reason, the final fuel injection amount QALLINJ to be injected from the fuel injection valve 11 is increased. As a result, even if the fuel is not contained in the purge gas, the fuel amount to be directed injected is increased in this manner so that the torque variation DLN may be positively suppressed.

(c) Furthermore, in this case, the final fuel injection amount QALLINJ is increased but at this time, if the ignition timing and the injection timing are fixed intact, the fuel amount around the spark plug 10 at the ignition timing is excessive. In contrast according to the embodiment, if the final fuel injection amount QALLINJ is thus increased, the fuel injection timing AINJ is controlled on the advance side. For this reason, the fuel amount around the spark plug 10 at the ignition timing is maintained at an optimum value for combustion. As a result, it is possible to keep a good combustion.

Also, the level of the advance angle, i.e., the absolute value of the fuel injection timing compensation item AINJ (FPG) is variable in response to the fuel vapor amount compensation amount FPG. It is therefore possible to keep the fuel amount around the spark plug 10 in response to the increment of the final fuel injection amount QALLINJ. Thus, the above-described effect may be more ensured.

(d) In addition, in this embodiment, in the case where the torque variation DLN is less than a value obtained by subtracting the predetermined value CL from the target torque variation DLNLVL, there is no problem even if the torque variation DLN is somewhat increased ($\gamma$ region in FIG. 72). Then, in this case, the duty ratio DPG is controlled to be reduced to reduce the purge amount. For this reason, the torque variation DLN is worse than before to such an extent that there is no problem. However, the consumption of fuel may be suppressed inversely.

(e) In addition, in the embodiment, in the case where the torque variation DLN does not exceed the target torque variation DLNLVL but exceeds the value obtained by subtracting a predetermined value CL from the target torque variation DLNLVL, the fuel vapor amount compensation amount FPG is increased so that the final fuel injection amount QALLINJ to be injected from the fuel injection valve 11 is decreased. For this reason, the fuel amount to be directly injection is decreased to thereby positively enhance the fuel consumption rate.

Figure 73:
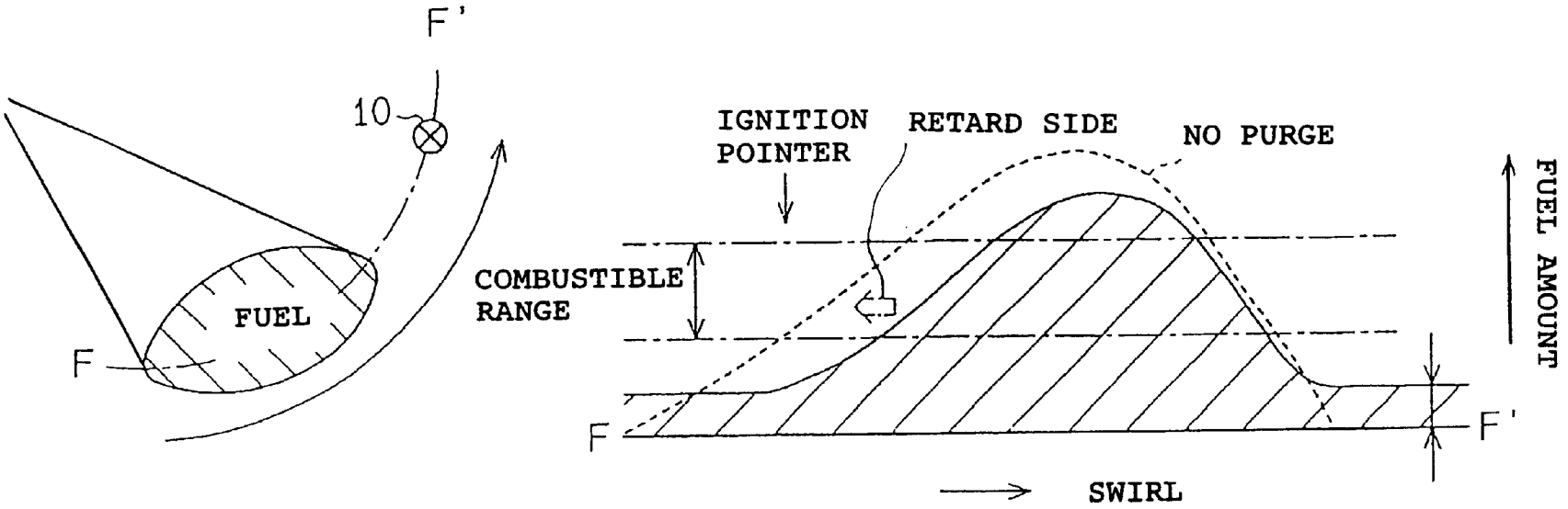
FIG. 73 is a schematic view showing a relation or the like of the fuel amount in the case where the swirl is generated along the line F–F' and the behavior of the fuel around the spark plug.

(f) Furthermore, as shown in FIG. 73, in this case, the final fuel injection amount QALLINJ is decreased. However, at this time, if the ignition timing and the injection timing are fixed intact, the fuel amount around the spark plug 10 at the ignition timing (ignition point) is too small (solid line in FIG. 73). In contrast according to the embodiment, if the final fuel injection amount QALLINJ is thus decreased, the fuel injection timing AINJ is controlled on the retard side. For this reason, the fuel amount around the spark plug 10 at the ignition timing is maintained at an optimum value for combustion. As a result, it is possible to keep a good combustion.

Also, the level of the retard angle, i.e., the absolute value of the fuel injection timing compensation item AINJ (FPG) is variable in response to the fuel vapor amount compensation amount FPG. It is therefore possible to keep the fuel amount around the spark plug 10 in response to the decrement of the final fuel injection amount QALLINJ. Thus, the above-described effect may be more ensured.

(g) In addition, in the embodiment, it is possible to suitably calculate the fuel vapor amount compensation amount even if the conventional oxygen sensors or the like are not used even in the homogenous combustion condition. As a result, it is possible to suitable perform the fuel feed control without the oxygen sensors or the like.

Incidentally, the predetermined values CP and CF of the steps 104, 105, 107 and 108 of FIG. 69 may be values determined in response to the operational condition of the engine or the combustion condition. For example, the values are large in the homogeneous combustion, and small in the stratified combustion. Thus, it is possible to enhance the controllability to stabilize the combustion.

<second form of sixth feature>

Figure 74:
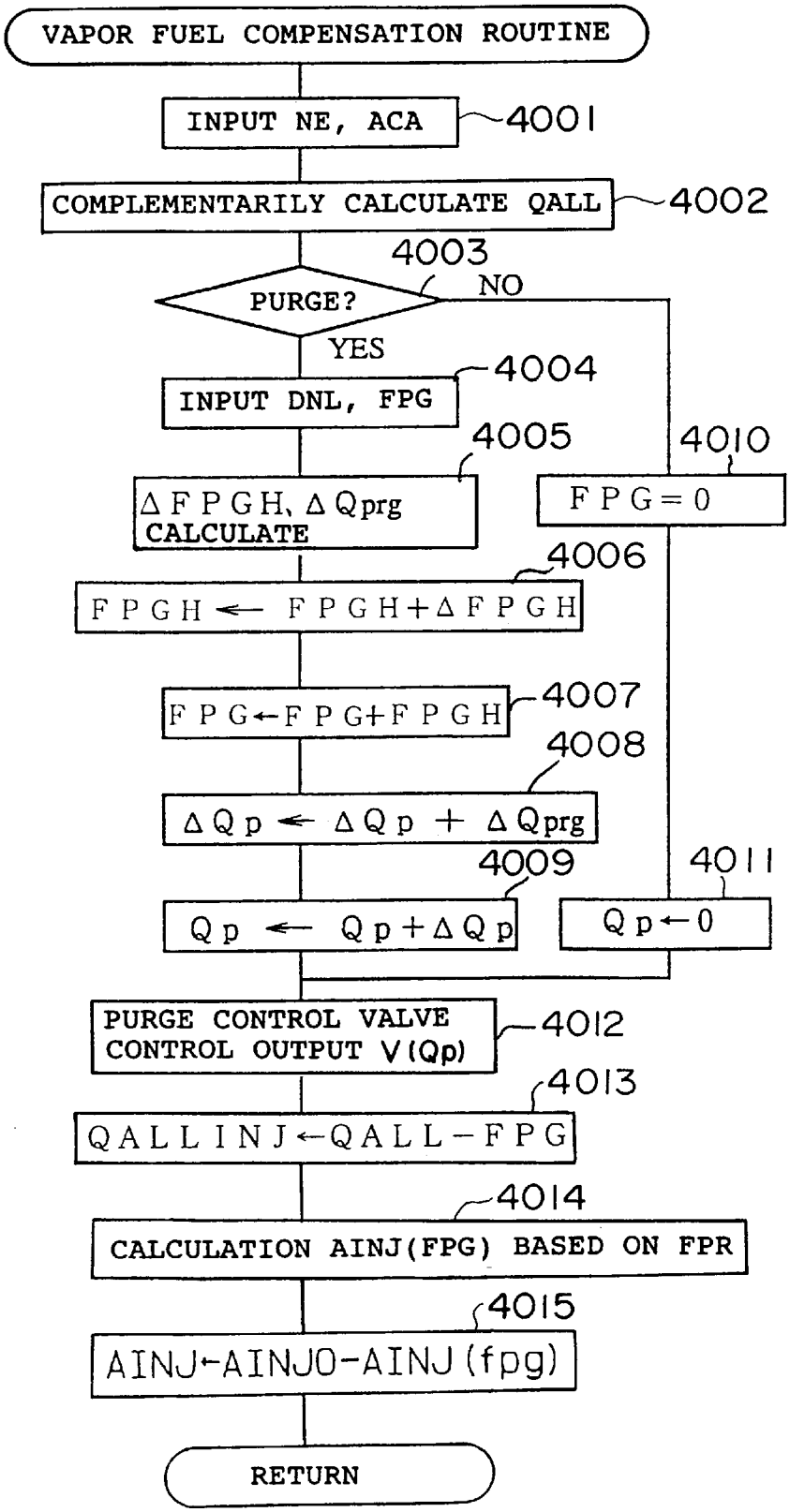
FIG. 74 is a flowchart showing another embodiment.
Figure 75:
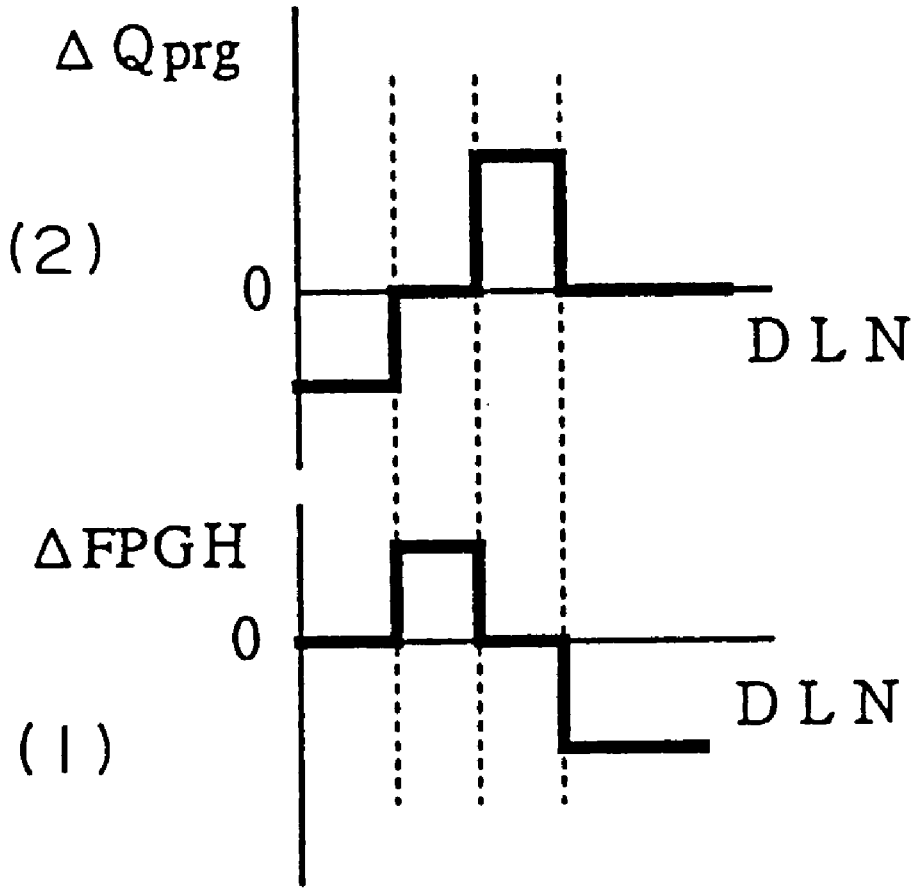
FIG. 75(1) is a map showing a relationship between DLN and ΔQprg, and FIG. 75(2) is a map showing a relationship between DLN and a fuel vapor amount compensation amount ΔFPRFGH.

The second embodiment will now be described with reference to FIGS. 74 and 75.

This example shows a case in which the purge gas amount Qp or the fuel vapor amount compensation amount FPG is controlled in response to the torque variation.

First of all, the engine revolution speed NE and the accelerator opening degree ACA are inputted (step 4001). Subsequently, the basic fuel injection amount QALL is complementally calculated in accordance with the inputted engine revolution speed and accelerator opening degree (step 4002). This is the same as the above-described step 682 of FIG. 65.

In step 4003, it is judged whether or not the purge is effected. If it is in the purge, in step 4004, the torque variation DLN and the fuel vapor amount compensation amount FPG are inputted. The torque variation is obtained by numerically converting the difference between the old torque before a predetermined time and the current torque by the torque variation detecting means. The fuel vapor amount compensation amount FPG is calculated in the same method as that of the step 685 of FIG. 65.

Subsequently, in step 4005, the compensation amount ΔFPGH of the fuel vapor amount compensation amount FPG is calculated in response to the torque variation. The map shown in FIG. 75(1) is referred to in calculating the compensation amount ΔFPGH of the fuel vapor amount compensation amount FPG. The map in FIG. 75(1) shows the mutual relationship between the torque variation magnitude on the horizontal axis and the compensation amount ΔFPGH of the vapor compensation amount FPG corresponding to the torque variation magnitude on the vertical axis.

Also, in step 4005, the purge gas compensation amount ΔQprg corresponding to the torque variation is calculated. The map shown in FIG. 75(2) is referred to in calculating the purge gas compensation amount ΔQprg. The map in FIG. 75(2) shows the mutual relationship between the torque variation magnitude on the horizontal axis and the purge gas compensation amount ΔQprg corresponding to the torque variation magnitude on the vertical axis.

Then, in step 4006, the compensation amount ΔFPGH of the fuel vapor amount compensation amount FPG obtained in step 4005 is added to the previous compensation amount FPGH of the fuel vapor amount compensation amount FPG to obtain the new compensation amount FPGH of the fuel vapor amount compensation amount FPG.

Subsequently, in step 4007, the new compensation amount FPGH of the fuel vapor amount compensation amount FPG is added to the fuel vapor amount compensation amount FPG obtained previously to obtain the new fuel vapor amount compensation amount FPG.

Furthermore, in step 4008, the purge gas compensation amount ΔQprg is added to the previous purge gas variation amount ΔQp to obtain a new purge gas variation ΔQp. Then, the purge gas variation amount ΔQp obtained in step 4008 is added to the previous purge gas amount ΔQp to obtain the compensated purge gas amount Qp. Incidentally, the previous purge gas amount Qp means Qp obtained in advance or Qp obtained during the previous routine execution.

In step 4003, if the purge is not effected, the fuel vapor amount compensation amount FPG is zero (in step 4010). Furthermore, the purge gas amount Qp is zero (step 4011).

In step 4012, the opening degree of the purge control valve is controlled in accordance with the purge gas amount Qp obtained in steps 4009 and 4011. This control is performed with reference to the map (not shown) representing the mutual relationship between the purge gas amount Qp and the opening degree V (Qp) of the purge control valve. The map shown is stored in advance in the ROM. As the opening degree of the purge control valve is greater, the purge gas amount is increased substantially in proportion thereto.

Subsequently, in step 4013, the final fuel injection amount is determined. In this case, the fuel vapor amount compensation amount FPG is subtracted from the basic fuel injection amount calculated in step 4002 to thereby determine the final fuel injection amount.

Furthermore, in the following steps 4014 and 4015, the fuel injection timing control is performed. The content of this step is the same as that of the steps 110 and 111 shown in FIG. 69. Namely, in step 4014, the fuel injection timing compensation item AINJ (FPG) is calculated on the engine revolution speed NE read in currently and the fuel vapor amount compensation amount FPG currently calculated. In this case, when the fuel injection timing compensation item AINJ (FPG) is calculated, the map shown in FIG. 71 is referred to. Namely, the more the current engine revolution speed NE, or the more the fuel vapor amount compensation amount FPG, the more the injection timing compensation item AINJ (FPG) will be set.

Then, finally, in step 4015, a value obtained by the currently calculated injection timing compensation item AINJ (FPG) from the basic injection timing AINJO calculated in another routine is set as a final fuel injection timing AINJ. Thereafter, the process is once finished. For this reason, the smaller the fuel injection timing compensation item AINJ (FPG) by reduction, the more on the advance side the injection timing will be compensated. As the injection timing compensation item AINJ (FPG) is increased by the addition, the injection timing is compensated for on the retard side.

<Third form of sixth feature>

The third form will be described with reference to FIGS. 76 to 78.

In the third form, the purge amount and the fuel vapor amount compensation amount FPG are compensated for in accordance with the output variation and the output variation change.

In this example, the change rate (ΔDLN) of the torque variation and the torque variation change (ΔTDLN) of the internal combustion engine are referred to as the ope rational conditions and at least one of the fuel vapor amount and the final fuel injection amount is compensated from the change rate of the torque variation and the torque variation change by a compensating means. Incidentally, in this embodiment, the change rate (ΔDLN) of the torque variation is a difference between the current torque variation and the target torque variation DLN0, and the torque variation change (ΔTDLN) is the difference between anthe current torque variation and t he previous torque variation.

The compensating means is formed by the program and is realized on the CPU by its execution.

Figure 76:
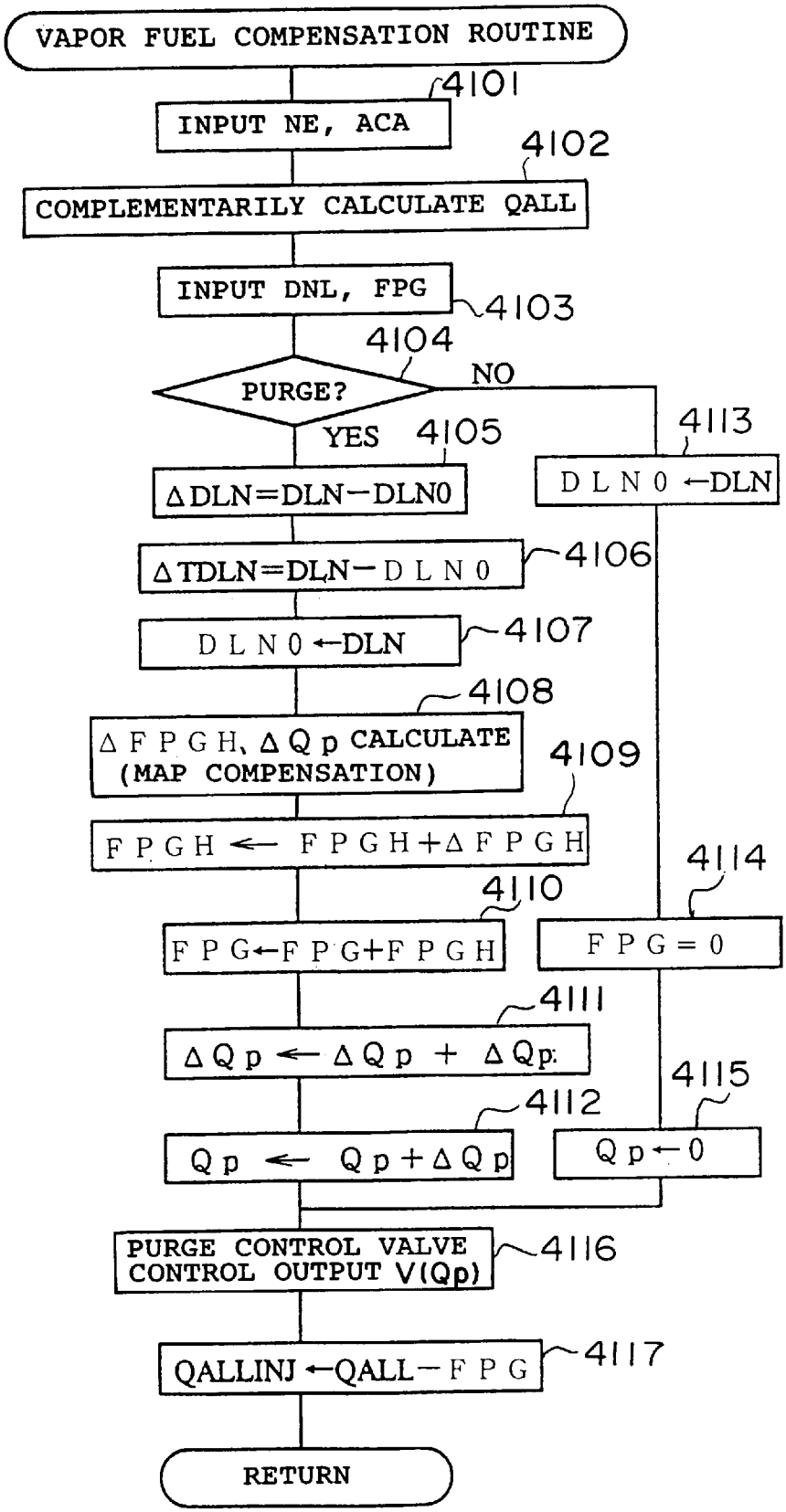
FIG. 76 is a flowchart of another embodiment.
Figure 77:
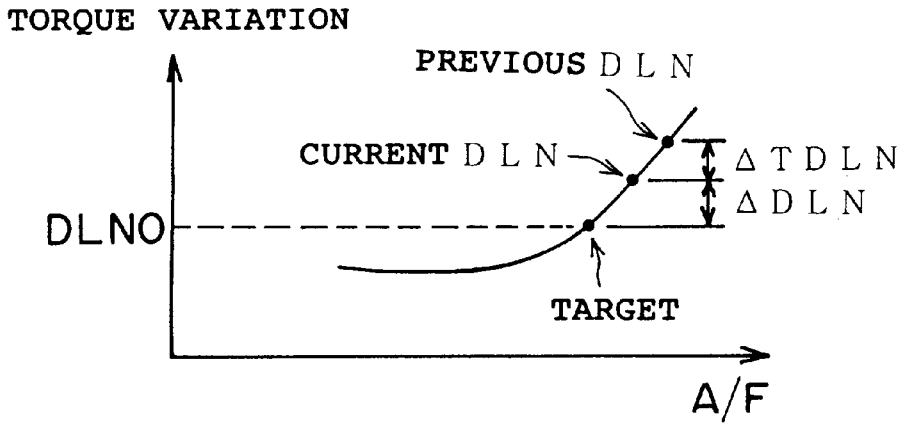
FIG. 77 is a map for determining the relationship among the torque variation, the air/fuel ratio A/F and the target torque variation.

As shown in FIG. 76, first of all, the engine revolution speed NE and the accelerarto opening degree ACA are inputted (step 4101). Subsequently, the basic fuel injection amount QALL is complementally calculated in accordance with the inputted engine revolution speed and accelerator opening degree (step 4102). This is the same as the above-described step 682 of FIG. 65.

In step 4103, the torque variation DLN a nd the fuel vapor amount compensation amount FPG are inputted. The torque variation is obtained by numerically converting the difference between the old torque before a predetermined time and the current torque by the torque variation detecting means. The fuel vapor amount compensation amount FPG is calculated in the same method as that of the step 685 of FIG. 65.

In step 4104, it is judged whether or not the purge is effected, if so, in step 4105, the target torque variation DLNO is subtracted from the torque variation DLN to calculate the change rate ΔDLN of the torque variation. Subsequently, in step 4106, the previous torque variation DLN0 is subtracted from the current torque variation DLN to calculate the torque variation change ΔTDLN. If the respective variation amounts are calculated, the current torque variation DLN is replaced for the previous torque variation (step 4107). Incidentally, ΔDLN and ΔTDLN are shown in FIG. 77. In FIG. 77, the vertical axis represents the torque variation and the horizontal axis represents the air/fuel ratio A/F.

Subsequently, in step 4108, with reference to the torque variation change ΔTDLN obtained in the step 4106 and the change rate ΔDLN of the torque variation obtained in the step 4105 from the map shown in FIG. 78, the compensation amount ΔFPGH of the fuel vapor amount compensation amount FPG and the purge gas variation amount ΔQp is calculated. In FIG. 78, the horizontal axis represents the change rate ΔDLN of the torque variation and the vertical axis represents the torque variation change ΔTDLN. FIG. 78 determines the mutual relationship between the compensation amount ΔFPGH of the fuel vapor amount compensation amount FPG and the purge gas variation amount ΔQp.

The meaning of FIG. 78 will be described in detail.

Figure 79:
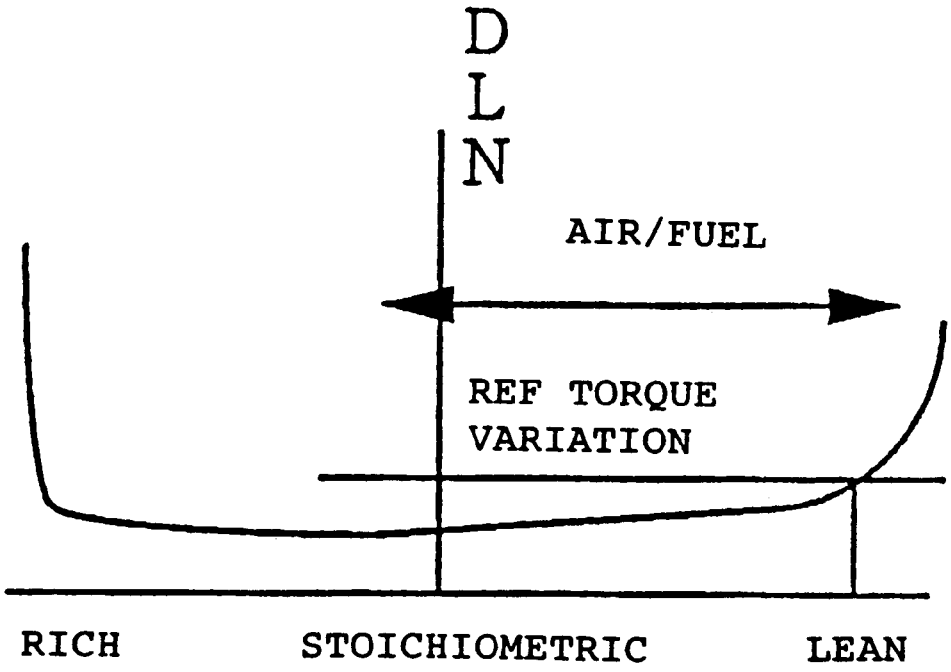
FIG. 79 is a graph showing a relationship between the torque variation and the air/fuel ratio.

In general, in an internal combustion engine, as shown in FIG. 79, the output variation relative to the air/fuel ratio exceeds the combustion limit to become unstable when the mixture is too lean. The torque variation is remarkable. Also, if the mixture is too rich, the combustion limit is exceeded so that the flame is not formed, resulting in remarkable torque variation.

A width of the air/fuel ratio in the lean burn internal combustion engine, particularly, the sleeve interior injection type internal combustion engine is indicated by the two-headed arrow in FIG. 79. In case of the lean burn internal combustion engine, particularly, the sleeve interior injection type internal combustion engine, the air/fuel ratio exceeds the combustion limit and is likely to be too lean so that the torque variation would occur.

The following description should be understood in accordance with the magnitude of ΔDLN and ΔTDLN.

ΔDLN>0: air/fuel ratio is leaner than target one

ΔDLN<0: air/fuel ratio is richer than target one

ΔTDLN>0: showing air/fuel ratio changed on the lean side more than previous one

ΔTDLN<0: showing air/fuel ratio changed on the rich side more than previous one

In this case, the causes of "ΔDLN>0: air/fuel ratio is leaner than target one" are: 1-i) the FPG is too large, and the fuel injection amount is insufficient; and 1-ii) the purge amount Qp is too small and evaporated fuel contained in the actual purge gas is insufficient in comparison with the value of the FPG.

Accordingly, in case of 1-i), the FPG is made small, and in case of 1-ii), the purge amount Qp is increased so that the air/fuel ratio may be close to the target air/fuel ratio.

Also, the causes of "ΔDLN<0: air/fuel ratio is richer than target one" are: 2-i) the FPG is too small, and the fuel injection amount is too large; and 2-ii) the purge amount Qp is large and evaporated fuel contained in the actual purge gas exceed the value of the FPG.

Accordingly, in case of 2-i), the FPG is made large, and in case of 2-ii), the purge amount Qp is decreased so that the air/fuel ratio may be close to the target air/fuel ratio.

From the combination of ΔDLN and ΔTDLN, the purge gas concentration, the purge amount and the combustion condition are inferred so that these may be compensated for.

(FIG. 78, region i): ΔDLN>0, ΔLDLN>0)

Figure 78:
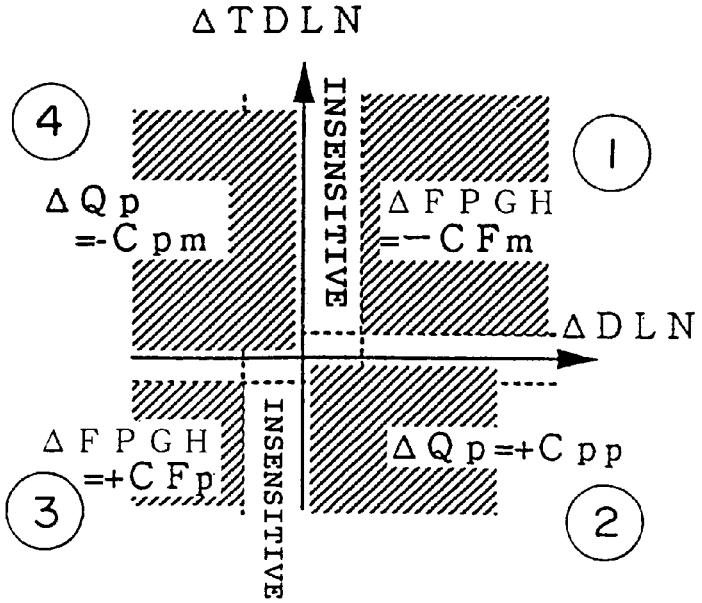
FIG. 78 is a map for determining relationships among ΔDLN and ΔTDLN and ΔQp and ΔFPGH.

The case where in FIG. 78 the current output variation is large (more than the target torque variation) (i.e., ΔDLN is positive) and the output variation is larger than the previous one (i.e., ΔTDLN is positive) corresponds to the region i) of FIG. 78. In this region, the air/fuel ratio is lean and the fuel amount within the sleeve is directed on the lean side. The causes of the lean air/fuel ratio are 1-i) and 1-ii). Since the lean tendency is developing, the purge gas concentration is low. Even if the purge amount Qp is increased, it is inferred that the fuel within the sleeve would not be increased. Accordingly, the fuel vapor amount compensation amount FPG is decreased and the combustion injection amount is increased.

(FIG. 78, region ii): ΔDLN>0, ΔLDLN<0)

The case where the current output variation is large (more than the target torque variation)(i.e., ΔDLN is positive) and the output variation is smaller than the previous one (i.e., ΔTDLN is negative) corresponds to the region ii) of FIG. 78. In this region, the air/fuel ratio is leaner than the target one and the fuel amount within the sleeve is compensated for closer to the target one than the previous fuel amount. In other words, the purge gas concentration is not lean. If the purge amount is increased, it is inferred that it is possible to feed the evaporated fuel into the sleeve. Therefore, in order to increase the purge amount, the FPG is not reduced but Qp is increased to compensate for the fuel within the sleeve.

(FIG. 78, region iii): ΔDLN<0, ΔLDLN<0) The case where the current output variation is smaller (less than the target torque variation)(i.e., ΔDLN is negative) and the output variation is smaller than the previous one (i.e., ΔTDLN is negative) corresponds to the region iii) of FIG. 78. In this region, the air/fuel ratio is richer than the target one and the fuel amount within the sleeve is richer than the previous one. In other words, the purge gas concentration is very rich (the vapor from the fuel reservoir is gradually increased). It is inferred that this would be further increased. Therefore, the fuel vapor amount compensation amount FPG is increased to decrease the fuel injection amount.

(FIG. 78, region iv): ΔDLN<0, ΔTDLN>0)

The case where the current output variation is smaller (less than the target torque variation)(i.e., ΔDLN is negative) and the output variation is larger than the previous one (i.e., ΔTDLN is positive) corresponds to the region iv) of FIG. 78. In this region, the air/fuel ratio is richer than the target one but the torque variation is increased more than the previous one. In other words, the purge gas concentration is very rich to reduce the fuel injection amount. However, the combustion becomes unstable. Accordingly, the purge gas amount Qp is reduced to avoid the worse combustion. Incidentally, in FIG. 78, Cpp is the amount for increasing the purge, Cpm is the amount for decreasing the purge, Cfp is the amount for increasing the estimation value of the concentration in the purge gas, and Cfm is the amount for decreasing the estimation value of the concentration in the purge gas.

Subsequently, in step 4109, the compensation amount ΔFPGH of the fuel vapor amount compensation amount FPG obtained in step 4108 is added to the previous compensation amount FPGH of the fuel vapor amount compensation amount FPG to obtain the new compensation amount FPGH of the fuel vapor amount compensation amount FPG.

In step 4110, the new compensation amount ΔFPGH of the fuel vapor amount compensation amount FPG obtained in step 4109 is added to the fuel vapor amount compensation amount FPG obtained previously to obtain the new fuel vapor amount compensation amount FPG.

Also, in step 4111, the purge gas compensation amount ΔQp obtained in step 4108, is added to the previous purge gas variation amount ΔQp to obtain a new purge gas variation amount ΔQp. Then, in step 4112, the new purge gas variation amount ΔQp is added to the previous purge gas amount Qp to obtain the compensated purge gas amount Qp.

In step 4104, if the purge is not effected, the current DLN is replaced for the previous DLN (in step 4113). The fuel vapor amount compensation amount FPG is zero (step 4114) and furthermore,, the purge gas amount Qp is zero (step 4115).

In step 4116, the opening degree of the purge control valve is controlled in accordance with the purge gas amount Qp obtained in steps 4112 and 4115. This control is performed with reference to the map representing the mutual relationship between the purge gas amount Qp and the opening degree V (Qp) of the purge control valve in the same manner as in the second embodiment.

Subsequently, in step 4117, the final fuel injection amount is determined. In this case, the fuel vapor amount compensation amount FPG is subtracted from the basic fuel injection amount calculated in step 4102 to thereby determine the final fuel injection amount.

Incidentally, the injection timing control thereafter is the same as the foregoing embodiment and the explanation therefor will be omitted.

<Other examples>

Incidentally, the form of the embodiments of the sixth feature is not limited to those shown above but may be changed as follows.

(1) In the foregoing embodiments, the control is performed in response to the torque variation DLN relative to the target torque variation DLNLVL as shown in FIG. 72, respectively. The control is not limited to such a relationship. For example, the sections may be further divided for control. The control contents of the γ region and the 5 region may be reversed to each other.

(2) The present invention is embodied to the sleeve interior injection type engine 1 in the foregoing embodiment but may be embodied to a type in which a general stratified combustion or weak stratified combustion is performed. For example, the present invention may be applied to an intake port injection valve type in which the fuel is injected to a bottom side of each of the intake valves 6*a* and 6*b* of the intake ports 7*a* and 7*b*. Although the fuel injection valve is provided on the side of the intake valves 6*a* and 6*b*, it is possible to apply the invention to the arrangement in which the fuel is injected directly to the interior of the cylinder bore (combustion chamber 5). Furthermore, the invention may be applied to an engine that may effect the lean combustion with the SCV 17.

Accordingly, in the specification, the lean combustion includes these meanings.

(3) In the foregoing embodiments, the invention is embodied to the gasoline engine 1 as the internal combustion engine, it is possible to apply the invention to a diesel engine or the like.

(4) In addition, it is possible to change the ignition timing in addition to the fuel injection timing.

In the above-described embodiments, it is possible to determine the degree of the advance or retard of the fuel injection timing in response to the compensation amount corresponding to the fuel vapor amount by the injection timing controlling means. With such a structure, at the ignition timing, it is possible to further ensure the suitable combustion.

Incidentally, the torque variation in the embodiments may be obtained directly from the torque sensor or it is possible to indirectly infer the torque variation from the change of Revolution speed and combustion pressure change.

As described above in detail, according to the present invention, in the fuel vapor feed controlling system for the lean burn internal combustion engine for feeding the fuel vapor to the lean burnt internal combustion engine, the output variation may be suppressed, the suitable fuel injection is maintained and the suitable combustion may be ensured.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A fuel vapor feed controlling apparatus for a lean burn internal combustion engine comprising:

a purge passage for purging fuel vapor, generated from a fuel storing means for storing fuel of the internal combustion engine, to an intake system of the internal combustion engine;

a purge controlling means for controlling a fuel vapor amount, to be introduced from said purge passage to said intake system, in response to an operational condition of said internal combustion engine; and a compensation means for compensating for the fuel vapor amount so that an engine revolution speed of said internal combustion engine may be identical with a target revolution speed, wherein said purge controlling means performs a purge control on the basis of a compensation value compensated for by said compensation means.

2. The fuel vapor feed controlling apparatus according to claim 1, wherein the target revolution speed of the internal combustion engine to be referred to by said first compensation means is an idle revolution speed.

3. The fuel vapor feed controlling apparatus according to claim 2, further comprising a fuel feed amount controlling means for adjusting a feed amount of the fuel in response to the compensation result by said first compensation means in the idle operation of a lean burn condition.

4. A fuel vapor feed controlling apparatus for a lean burn internal combustion engine comprising:

a purge passage for purging fuel vapor, generated from a fuel storing means for storing fuel of the internal combustion engine, to an intake system of the internal combustion engine;

a purge controlling means for controlling a fuel vapor amount, to be introduced from said purge passage to said intake system, in response to an operational condition of said internal combustion engine; and a compensation means for compensating for the fuel vapor amount in response to an engine revolution speed of said internal combustion engine, wherein said purge controlling means performs a purge control on the basis of a compensation value compensated for by said compensation means.

5. A fuel vapor feed controlling apparatus for a lean burn internal combustion engine comprising:

a purge passage for purging fuel vapor, generated from a fuel storing means for storing fuel of the internal combustion engine, to an intake system of the internal combustion engine;

a purge controlling means for controlling a fuel vapor amount, to be introduced from said purge passage to said intake system, in response to an operational condition of said internal combustion engine; and a compensation means for compensating for the fuel vapor amount in response to an output variation of said internal combustion engine, wherein said purge controlling means performs a purge control on the basis of a compensation value compensated for by said compensation means.

6. The fuel vapor feed controlling apparatus according to claim 5, further comprising a fuel feed amount controlling means for adjusting a feed amount of the fuel in response to the output variation of the internal combustion engine.

7. The fuel vapor feed controlling apparatus according to claim 5, further comprising an injection condition changing means for changing a fuel injection condition in response to the compensation of the fuel vapor amount.

8. The fuel vapor feed controlling apparatus according to claim 5, further comprising a concentration detecting means for detecting a concentration of the fuel vapor and a second compensation means for compensating for an opening degree of a purge valve or a fuel injection condition in response to the concentration of the fuel vapor.

9. The fuel vapor feed controlling apparatus according to claim 8, wherein said injection condition changing means changes the injection amount compensation amount as a fuel injection condition, and a change of the injection amount compensation amount is restricted by a guard value.

10. The fuel vapor feed controlling apparatus according to claim 6, further comprising an injection condition changing means for changing a fuel injection condition in response to the compensation of the fuel vapor amount.

11. The fuel vapor feed controlling apparatus according to claim 6, further comprising a concentration detecting means for detecting a concentration of the fuel vapor and a second compensation means for compensating for an opening degree of a purge valve or a fuel injection condition in response to the concentration of the fuel vapor.

12. The fuel vapor feed controlling apparatus according to claim 9, wherein an injection condition changing means changes an injection amount compensation amount as a fuel injection condition, and a change of the injection amount compensation amount is restricted by a guard value.

13. A fuel vapor feed controlling apparatus for a lean burn internal combustion engine comprising:

a purge passage for purging fuel vapor, generated from a fuel storing means for storing fuel of the internal combustion engine, to an intake system of the internal combustion engine;

a purge controlling means for controlling a fuel vapor amount, to be introduced from said purge passage to said intake system, in response to an operational condition of said internal combustion engine;

a fuel vapor compensation means for compensating for the fuel vapor amount in response to the output variation of said internal combustion engine;

an injection amount changing means for changing the fuel injection amount to the internal combustion engine on the basis of the compensated fuel vapor amount; and a correction controlling means for increasing and decreasing the fuel vapor amount in response to the operational condition after the injection amount change and for controlling a fuel injection timing on an advance side or on a retard side.

14. The fuel vapor feed controlling apparatus according to claim 13, wherein said correction controlling means decreases the fuel vapor amount and controls the fuel injection timing on the advance side when the operational condition after the injection amount change is unstable.

15. The fuel vapor feed controlling apparatus according to claim 13, wherein said correction controlling means increases the fuel vapor amount and controls the fuel injection timing on the retard side when the operational condition after the injection amount change is stable.

16. The fuel vapor feed controlling apparatus according to claim 13, further comprising:

a reference value setting means for setting a stability judgment standard of the operational condition in response to the engine revolution speed; and a stability judgement means for judging the stability of the internal combustion engine in accordance with a change width on the basis of the reference value set by said reference value setting means.

17. The fuel vapor feed controlling apparatus according to claim 13, wherein said operational condition includes a change rate ΔDLN of the torque variation of the internal combustion engine and a torque variation change ΔTDLN of the internal combustion engine, further comprising a compensation means for compensating for at least one of the fuel vapor amount and the fuel injection amount from the torque variation and the torque variation change.

18. A fuel vapor feed controlling apparatus for a lean burn internal combustion engine comprising:

a purge passage for purging fuel vapor, generated from a fuel storing means for storing fuel of the internal combustion engine, to an intake system of the internal combustion engine;

a purge controlling means for controlling a fuel vapor amount, to be introduced from said purge passage to said intake system, in response to an operational condition of said internal combustion engine;

a fuel vapor compensation means for compensating for the fuel vapor amount in response to the combustion condition of said internal combustion engine;

an injection amount changing means for changing the fuel injection amount to the internal combustion engine on the basis of the compensated fuel vapor amount; and a correction controlling means for increasing and decreasing the fuel vapor amount in response to the operational condition after the injection amount change and for controlling a fuel injection timing on an advance side or on a retard side.

19. The fuel vapor feed controlling apparatus according to claim 18, wherein said correction controlling means decreases the fuel vapor amount and controls the fuel injection timing on the advance side when the operational condition after the injection amount change is unstable.

20. The fuel vapor feed controlling apparatus according to claim 18, wherein said correction controlling means increases the fuel vapor amount and controls the fuel injection timing on the retard side when the operational condition after the injection amount change is stable.

21. The fuel vapor feed controlling apparatus according to claim 18, further comprising:

a reference value setting means for setting a stability judgment standard of the operational condition in response to the engine revolution speed; and a stability judgment means for judging the stability of the internal combustion engine in accordance with a change width on the basis of the reference value set by said reference value setting means.

22. The fuel vapor feed controlling apparatus according to claim 18, wherein said operational condition includes a change rate ΔDLN of the torque variation of the internal combustion engine and a torque variation change ΔTDLN of the internal combustion engine, further comprising a compensation means for compensating for at least one of the fuel vapor amount and the fuel injection amount from the torque variation and the torque variation change.

* * * * *

UNITED STATES PATENT AND TRADEMARK OFFICE

CERTIFICATE OF CORRECTION

PATENT NO. : 6,044,831
DATED : April 4, 2000
INVENTOR(S) : Naoya Takagi et al.

It is certified that error appears in the above-identified patent and that said Letters Patent is hereby corrected as shown below:

On the title page, section 30, line 4, replace November 12 1997 with November 21, 1997.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*